US012252975B2

(12) United States Patent
Yu et al.

(10) Patent No.: US 12,252,975 B2
(45) Date of Patent: Mar. 18, 2025

(54) DRILLING CONTROL

(71) Applicant: Schlumberger Technology Corporation, Sugar Land, TX (US)

(72) Inventors: Yingwei Yu, Katy, TX (US); Velizar Vesselinov, Sugar Land, TX (US); Richard Meehan, Houston, TX (US); Qiuhua Liu, Houston, TX (US); Wei Chen, Houston, TX (US); Minh Trang Chau, Sugar Land, TX (US); Yuelin Shen, Houston, TX (US); Sylvain Chambon, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/331,269

(22) Filed: Jun. 8, 2023

(65) Prior Publication Data

US 2023/0313664 A1 Oct. 5, 2023

Related U.S. Application Data

(63) Continuation of application No. 16/776,373, filed on Jan. 29, 2020, now Pat. No. 11,828,155.

(Continued)

(51) Int. Cl.

| | |
|---|---|
| ***E21B 44/00*** | (2006.01) |
| ***E21B 7/04*** | (2006.01) |
| ***E21B 47/024*** | (2006.01) |

(52) U.S. Cl.

CPC ..... *E21B 44/00* (2013.01); *E21B 7/04* (2013.01); *E21B 47/024* (2013.01)

(58) Field of Classification Search

CPC ..... E21B 44/00; E21B 7/04; E21B 47/024

See application file for complete search history.

(56) References Cited

U.S. PATENT DOCUMENTS

| | | | |
|---|---|---|---|
| 6,438,495 | B1 | 8/2002 | Chau et al. |
| 6,612,382 | B2 | 9/2003 | King |

(Continued)

FOREIGN PATENT DOCUMENTS

| | | | |
|---|---|---|---|
| AU | 2011283192 | A1 | 2/2013 |
| CA | 3026315 | A1 | 12/2017 |

(Continued)

OTHER PUBLICATIONS

DeepMind, "Safety-first AI for autonomous data centre cooling and industrial control," retrieved at https://deepmind.com/blog/safety-first-ai-autonomous-data-centre-cooling-and-industrial-control/ on Jan. 27, 2020.

(Continued)

*Primary Examiner* — Dany E Akakpo

(74) *Attorney, Agent, or Firm* — Michael West

(57) ABSTRACT

A system and method that include receiving sensor data during drilling of a portion of a borehole in a geologic environment. The system and method also include selecting a drilling mode from a plurality of drilling modes based at least on a portion of the sensor data. The system and method additionally include simulating drilling of the borehole using the selected drilling mode and generating a state of the borehole in the geologic environment based on the simulated drilling of the borehole. The system and method further include generating a reward using the state of the borehole and a planned borehole trajectory and using the reward through deep reinforcement learning to maximize future rewards for drilling actions.

20 Claims, 33 Drawing Sheets

Related U.S. Application Data

(60) Provisional application No. 62/850,865, filed on May 21, 2019.

(56) References Cited

U.S. PATENT DOCUMENTS

| | | | |
|---|---|---|---|
| 6,968,909 | B2 | 11/2005 | Aldred et al. |
| 7,085,696 | B2 | 8/2006 | King |
| 8,121,971 | B2 | 2/2012 | Edwards et al. |
| 8,849,460 | B2 | 9/2014 | Ye et al. |
| 9,482,055 | B2 | 11/2016 | Huang |
| 10,221,671 | B1 | 3/2019 | Zhang |
| 10,662,763 | B2 | 5/2020 | Alshawaf et al. |
| 11,396,804 | B2 | 7/2022 | Madasu et al. |
| 2006/0272861 | A1 | 12/2006 | Hutchinson |
| 2009/0132458 | A1 | 5/2009 | Edwards et al. |
| 2012/0024606 | A1 | 2/2012 | Pirovolou et al. |
| 2013/0127900 | A1 | 5/2013 | Pena et al. |
| 2013/0186687 | A1 | 7/2013 | Snyder |
| 2014/0351183 | A1 | 11/2014 | Germain et al. |
| 2015/0226052 | A1 | 8/2015 | Samuel et al. |
| 2015/0337640 | A1 | 11/2015 | Huang et al. |
| 2017/0306740 | A1 | 10/2017 | Song et al. |
| 2017/0328181 | A1 | 11/2017 | Kristjansson et al. |
| 2018/0087321 | A1 | 3/2018 | Johnston et al. |
| 2019/0003297 | A1 | 1/2019 | Brannigan et al. |
| 2019/0048706 | A1 | 2/2019 | Benson et al. |
| 2019/0048707 | A1* | 2/2019 | Benson ..... E21B 44/04 |
| 2019/0145240 | A1 | 5/2019 | Benson et al. |
| 2019/0330968 | A1 | 10/2019 | Boone et al. |
| 2020/0104544 | A1 | 4/2020 | Suryadi et al. |
| 2020/0157887 | A1 | 5/2020 | Alonso et al. |
| 2020/0370409 | A1 | 11/2020 | Yu et al. |
| 2021/0082129 | A1 | 3/2021 | Nazari et al. |
| 2021/0148213 | A1 | 5/2021 | Madasu et al. |
| 2021/0230998 | A1 | 7/2021 | Chen et al. |
| 2021/0310347 | A1* | 10/2021 | Panchal ..... G06N 20/00 |
| 2023/0124120 | A1 | 4/2023 | Yu et al. |

FOREIGN PATENT DOCUMENTS

| | | | |
|---|---|---|---|
| CA | 3061860 | A1 | 5/2020 |
| CN | 104040376 | A | 9/2014 |
| CN | 104508240 | A | 4/2015 |
| CN | 106437513 | A | 2/2017 |
| EA | 013694 | B1 | 6/2010 |
| EP | 1146200 | A1 | 10/2001 |
| EP | 1335108 | A2 | 8/2003 |
| EP | 1644800 | A2 | 4/2006 |
| EP | 2222937 | A2 | 9/2010 |
| EP | 2222937 | B1 | 12/2014 |
| EP | 2951720 | A1 | 12/2015 |
| EP | 3334897 | A1 | 6/2018 |
| EP | 3465282 | A1 | 4/2019 |
| EP | 3715579 | A1 | 9/2020 |
| GB | 2290330 | A | 12/1995 |
| GB | 2367843 | A | 4/2002 |
| WO | 0050735 | A1 | 8/2000 |
| WO | 03072907 | A1 | 9/2003 |
| WO | 2009058635 | A2 | 5/2009 |
| WO | 2010101473 | A1 | 9/2010 |
| WO | 2012015894 | A1 | 2/2012 |
| WO | 2012170273 | A1 | 12/2012 |
| WO | 2015200259 | A1 | 12/2015 |
| WO | 2016022388 | A1 | 2/2016 |
| WO | 2016032640 | A1 | 3/2016 |
| WO | 2016154723 | A1 | 10/2016 |
| WO | 2017030756 | A1 | 2/2017 |
| WO | 2017206157 | A1 | 12/2017 |
| WO | 2017206158 | A1 | 12/2017 |
| WO | 2018117890 | A1 | 6/2018 |
| WO | 2020028298 | A1 | 2/2020 |
| WO | 2020046351 | A1 | 3/2020 |
| WO | 2020172447 | A1 | 8/2020 |

OTHER PUBLICATIONS

Mnih et. al., "Asynchronous Methods for Deep Reinforcement learning," Proceedings of the 33rd International Conference on Machine Learning, New York, NY, USA, 2016.
Mnih et. al., "Human-level control through deep reinforcement learning," Nature vol. 518, pp. 529, Feb. 26, 2015.
Openai, "Learning Dexterity," retrieved at https://blog.openai.com/learning-dexterity/ on Jan. 27, 2020.
Pollock et. al., "Machine Learning for Improved Directional Drilling," Offshore Technology Conference held in Houston, TX USA, Apr. 30-May 3, 2018.
Yu et al, Approaches to Directional Drilling Using Machine Learning, U.S. Appl. No. 62/850,865, filed May 21, 2019.
Office Action received in U.S. Appl. No. 16/776,373 dated Mar. 18, 2021, 20 pages.
International Search Report and Written Opinion of International Patent Application No. PCT/US2020/015529 mailed on Jun. 1, 2020, 10 pages.
Ahmed Hamza, Mohamed Shamlooh, Ibnelwaleed A. Hussein, Mustafa Nasser, Saeed Salehi, Polymeric formulations used for loss circulation materials and wellbore strengthening applications in oil and gas wells: A review, Journal of Petroleum Science and Engineering, vol. 180, 2019, pp. 197-214 (Year: 2019).
Cayeux, Eric, Daireaux, Benoit, and Erik Wolden Dvergsnes. "Automation of Drawworks and Topdrive Management To Minimize Swab/Surge, and Poor-Downhole_Condition Effects", SPE Drilling Completions 26 (2011): 557-568. doi: https://doi.org/10.2118/128286-PA (Year: 2011).
Hegde, Chiranth, Wallace, Scott, and Ken Gray. "Real Time Prediction and Classification of Torque and Drag During Drilling Using Statistical Learning Methods", Paper presented at the SPE Eastern Regional Meeting, Morgantown, Wes Virginia, USA, Oct. 2015. doi: https://doi.org/10.2118/177313-MS (Year: 2015).
Lashari, S. et al., "Drilling performance monitoring and optimization: a data-driven approach", Journal of Petroleum Exploration and Production Technology, 2019, 9(4), pp. 2747-2756.
Tompkins, M. F. "Optimization Techniques for Task Allocation and Scheduling in Distributed Multi-Agent Operations", Jun. 2003, MIT, 107 pages.
Liu, H. et al., "A Reinforcement Based 3D Guided Drilling Method: Beyond Grund Control", in the Proceedings of the 2018 VII International Conference on Network Communication and Computing (ICNCC), Association for Computing Machinery, New York, NY, USA, pp. 44-48.
Kim et al., "Recent Advances in Multi-agent Reinforcement Learning", Communications of the Korean Institute of Information Scientists and Engineers, 2019, 37(11), pp. 8-17.
Office Action issued in U.S. Appl. No. 17/177,897 dated Jan. 11, 2024, 29 pages.
International Search Report and Written Opinion for the equivalent International Patent Application PCT/CN2017/082848 mailed on Jan. 19, 2018.
Office Action issued in U.S. Appl. No. 16/497,792 dated Jun. 24, 2021, 18 pages.
Guria, C et al., "Multi-objective optimization of oil well drilling using elitist non-dominated sorting genetic algorighm", Petroleum Science, 2014, 11(1), pp. 97-110.
Office Action issued in U.S. Appl. No. 16/497,792 dated Mar. 22, 2022, 36 pages.
Office Action issued in U.S. Appl. No. 16/497,792 dated May 1, 2024, 35 pages.
Advisory Action issued in U.S. Appl. No. 16/497,792 dated Jul. 25, 2022, 5 pages.
Search Report and Written Opinion of International Patent Application No. PCT/US2022/045200 dated Jan. 12, 2023, 10 pages.
SPE/IADC 67816 Meeting Future Drilling Planning and Decision Support Requirements Copyright 2001, Feb. 27-Mar. 1, 2001.
Bilgesu, H.I., et al., A New Approach for the Prediction of Rate of Penetration (ROP) Values, Society of Petroleum Engineers, Oct. 1997, pp. 175-179, SPE 39231.

(56) References Cited

OTHER PUBLICATIONS

Sinor, A. and Warren, T.M., Drag Bit Wear Model, SPE Drilling Engineering, Jun. 1989, pp. 128-136.
Irrangang, R., et al., A Case-Based System to Cut Drilling Costs, Society of Petroleum Engineers, Oct. 1999, pp. 1-17, SPE 56504.
Luo, Y, et al., Flow-Rate Predictions for Cleaning Deviated Wells, IADC/SPE, Feb. 1992, pp. 367-376, SPE 23884.
Bourgoyne, Jr., A., et al., Drilling Hydraulics, Applied Drilling Engineering, 1986, pp. 113-189, First Printing, Society of Petroleum Engineers, Richardson, TX.
International Search Report issued in PCT Application No. PCT/US2005/009119 dated Jul. 6, 2005, 3 pages.
Written Opinion issued in PCT Application No. PCT/US2005/009119 dated Jul. 6, 2005, 5 pages.
Office Action issued in U.S. Appl. No. 10/802,545 dated May 22, 2006, 6 pages.
Office Action issued in U.S. Appl. No. 10/802,545 dated Nov. 13, 2006, 6 pages.
Office Action issued in U.S. Appl. No. 10/802,545 dated Oct. 6, 2008, 8 pages.
Notice of Allowance issued in U.S. Appl. No. 10/802,545 dated Apr. 6, 2009, 6 pages.
International Search Report and Written Opinion issued in corresponding International Application No. PCT/US2014/034053, mailed Aug. 18, 2014 (20 pages).
First Office Action and Search Report issued in Chinese Patent Application No. 201480020646.4 on Jul. 31, 2017, 18 pages.
Office Action issued in U.S. Appl. No. 14/252,726 dated May 8, 2017, 17 pages.
Office Action issued in U.S. Appl. No. 14/252,726 dated Dec. 13, 2017, 11 pages.
Kingma, Diederik et al., Adam: A Method for Stochastic Optimization, arXiv:1412.6980, v9, Jan. 30, 2017, 15 pages.
Ba et al., Positive Displacement Motor Modeling: Skyrocketing the Way We Design, Select, and Operate Mud Motors, Society of Petroleum Engineers, SPE-183298-MS, Abu Dhabi International Petroleum Exhibition Conference, Abu Dhabi, UAE, Nov. 7-10, 2016, 26 pages.
Evangelatos, G. I. et al., "Advanced BHA-5 ROP Modeling Including Neural Network Analysis of Drilling Performance Data", IADC/SPE Drilling Conference and Exhibition, 2016, 24 pages.
Wardana, R., "Build Rate Prediction Using Artificial Neural Network for Positive Displacement Motor Application in Field X", Journal Petro, 2018, VII(1), 6 pages.
Office Action issued in U.S. Appl. No. 16/408,514 dated Sep. 24, 2021, 25 pages.
Office Action issued in U.S. Appl. No. 16/408,514 dated Mar. 21, 2022, 31 pages.

* cited by examiner

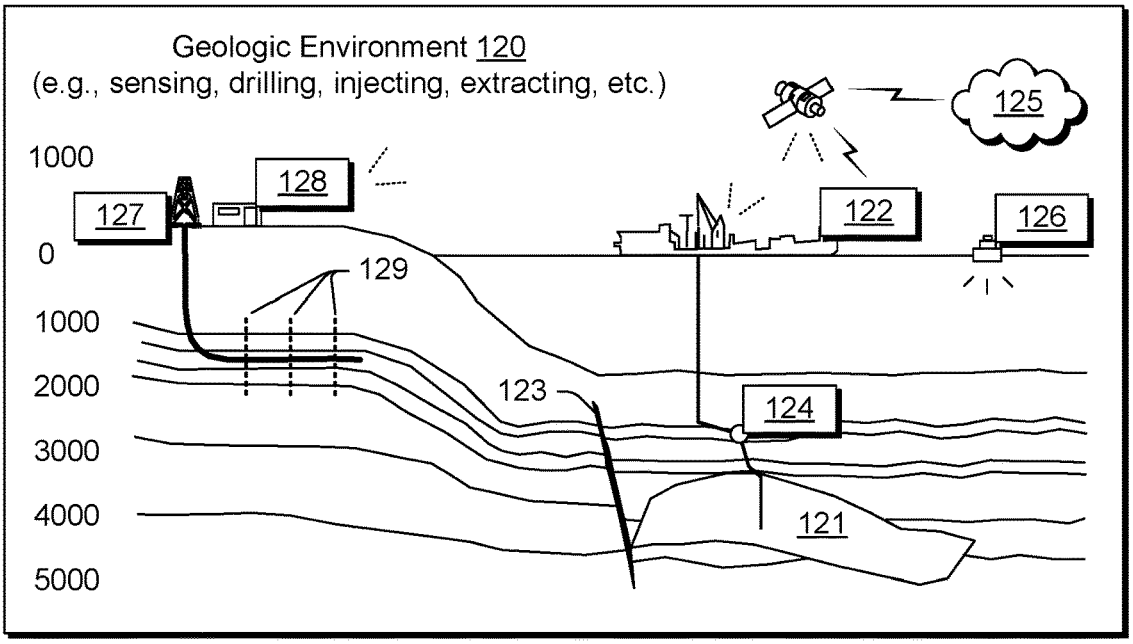
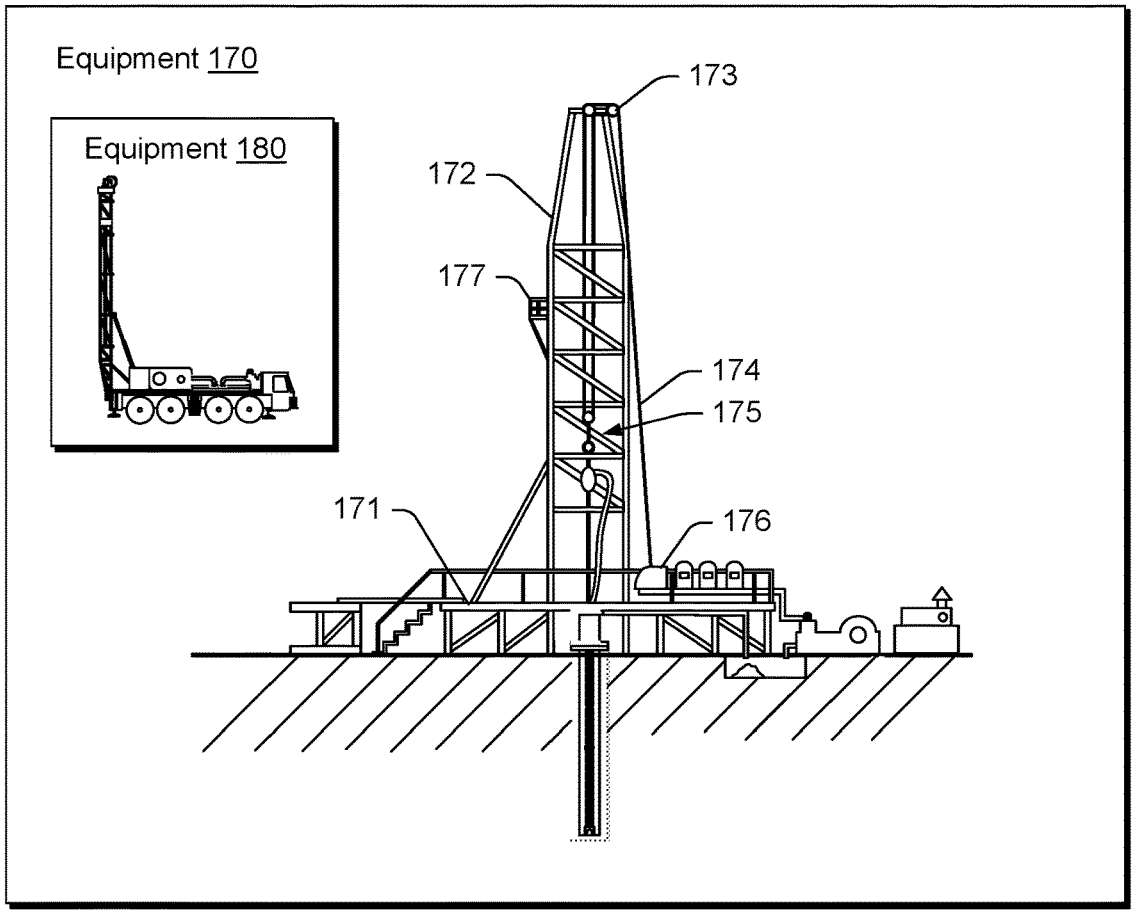
Fig. 1

| x | y | Depth | Pad Config. | Pad Orient. | Well Length | Vertical Spacing | Horiz. Spacing | Toe Height | Step Out | Initial Incl. | Kick Off |
|---|---|---|---|---|---|---|---|---|---|---|---|
| 11 | 93 | 217 | 2 | 90 | 2000 | 50 | 500 | 0 | 1000 | 0 | 0 |
| 11 | 94 | 384 | 1 | 90 | 1000 | 50 | 500 | 0 | 1000 | 0 | 0 |
| 12 | 95 | 282 | 1 | 90 | 1000 | 50 | 500 | 0 | 1000 | 0 | 0 |

GUI 1100

| | | ET(h) | TT (days) |
|---|---|---|---|
| | ▽Construct Well | | |
| | ▷Construct Section 17.5 in | 59.91 | 2.50 |
| | ▷Construct Section 12.5 in | 106.61 | 6.94 |
| | ▽Construct Section 8.5 in | | |
| | Drilling run (3530-6530ft) | | |
| | Safety Meeting | 0.25 | 6.95 |
| | Make up BHA | 2.04 | 7.03 |
| | Trip in to depth (0-1030ft) | 0.87 | 7.07 |
| | Drill shoe track (1030-3530ft) | 1.02 | 7.11 |
| 1110 | Drill to depth (3530-6530ft) | 102.08 | 11.37 |
| | Circulate to condition hole | 1.02 | 11.41 |
| | Conduct flow check | 0.25 | 11.42 |
| | Pump slug sweep pill spacer | 0.25 | 11.43 |
| | Trip out to depth (6530-0ft) | 5.54 | 11.66 |
| | Lay down BHA | 2.04 | 11.75 |
| | Wireline run | | |
| | Make up wireline toolstring | 2.04 | 11.83 |
| | Run in wireline to depth (0-6530ft) | 1.85 | 11.91 |
| | Up log wireline to depth (3070-0ft) | 5.09 | 12.12 |
| | Lay down wireline toolstring | 2.04 | 12.23 |
| | ⋮ | | |

Fig. 11

Method 1200

Method 1400
Q-Learning 1410
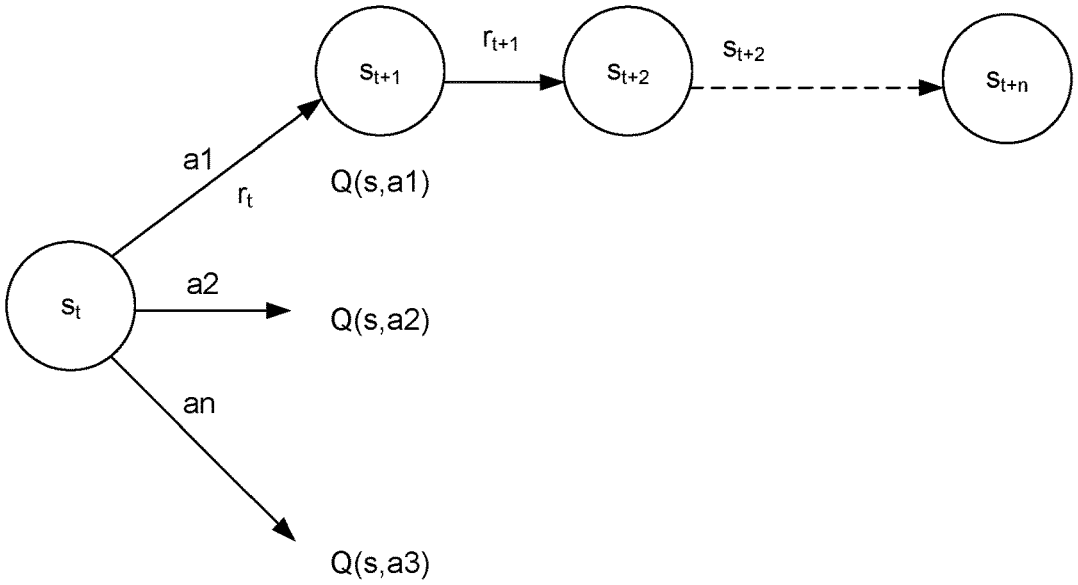
Graph 1430
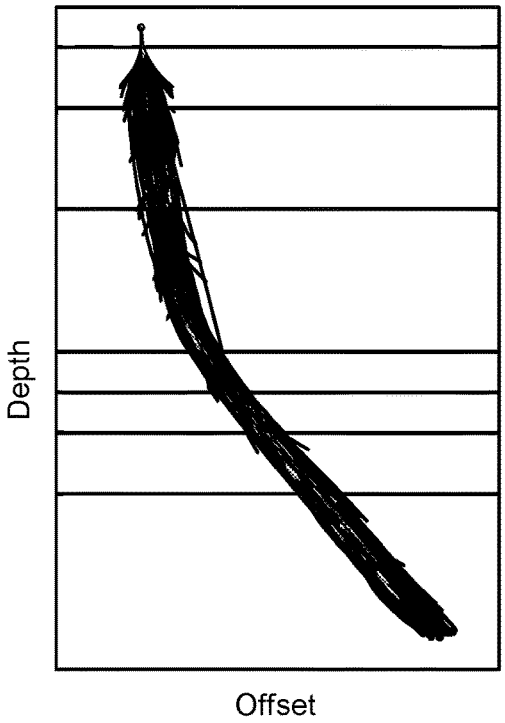
Graph 1450
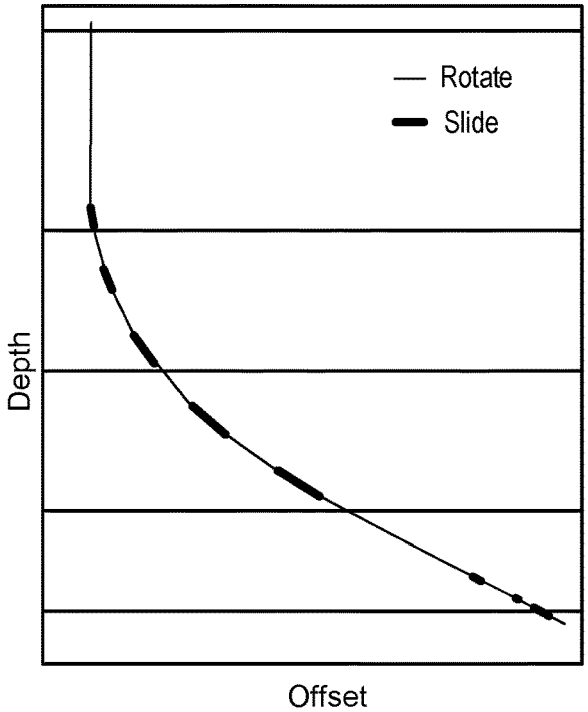
Fig. 14

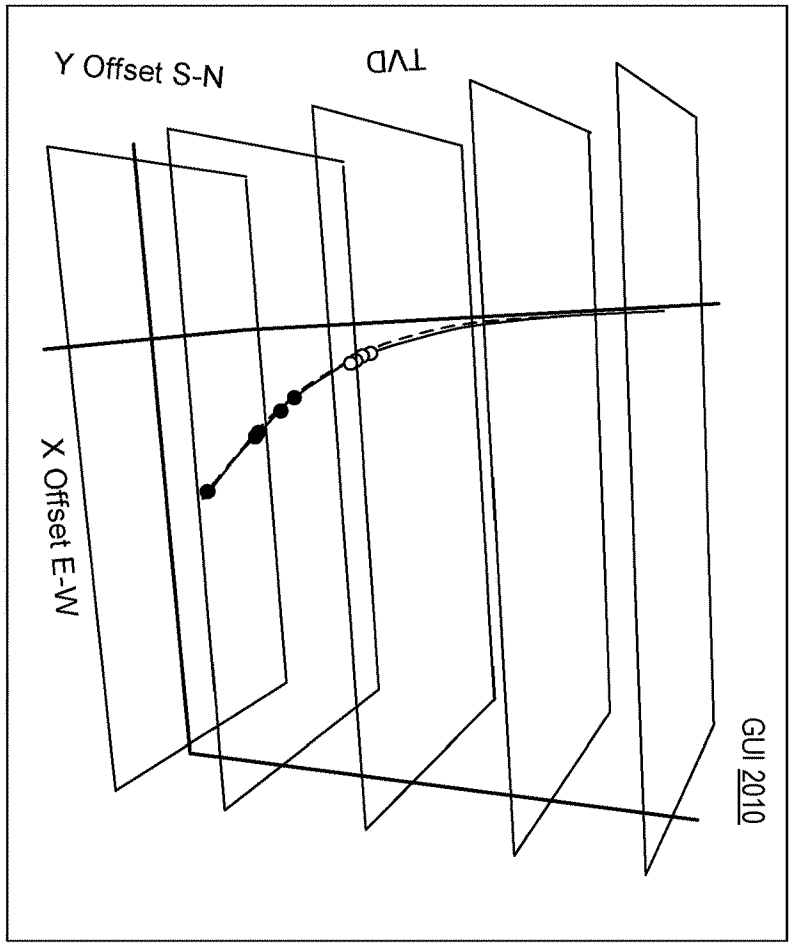
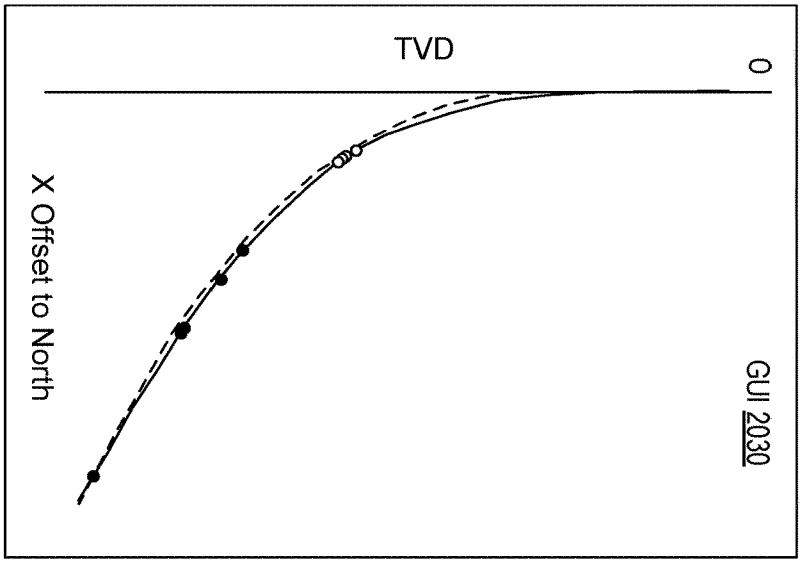
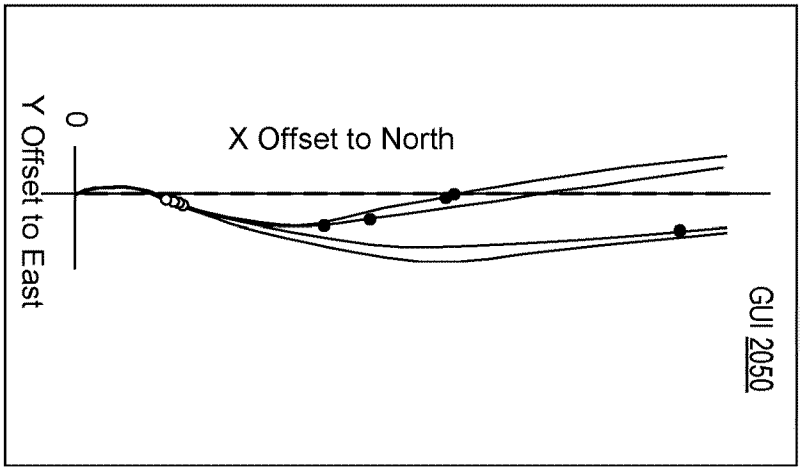
Fig. 20

GUI 2110
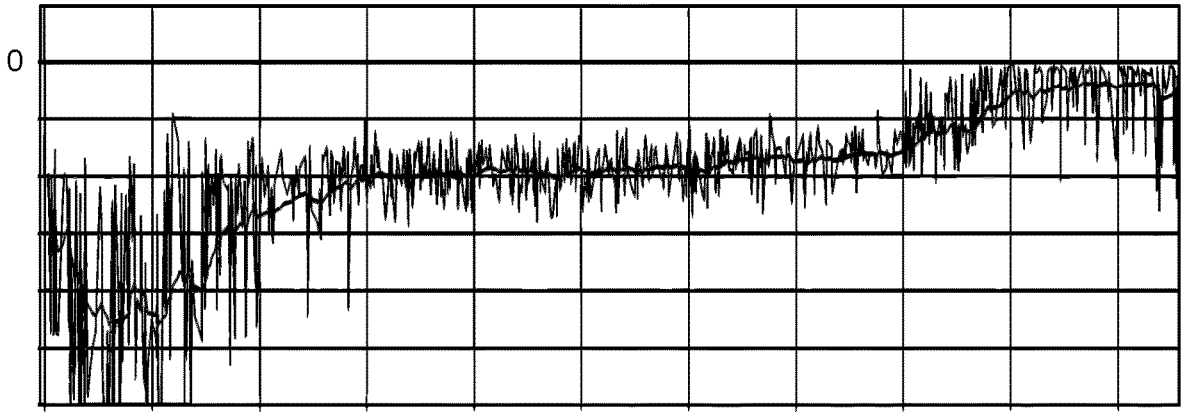
GUI 2130
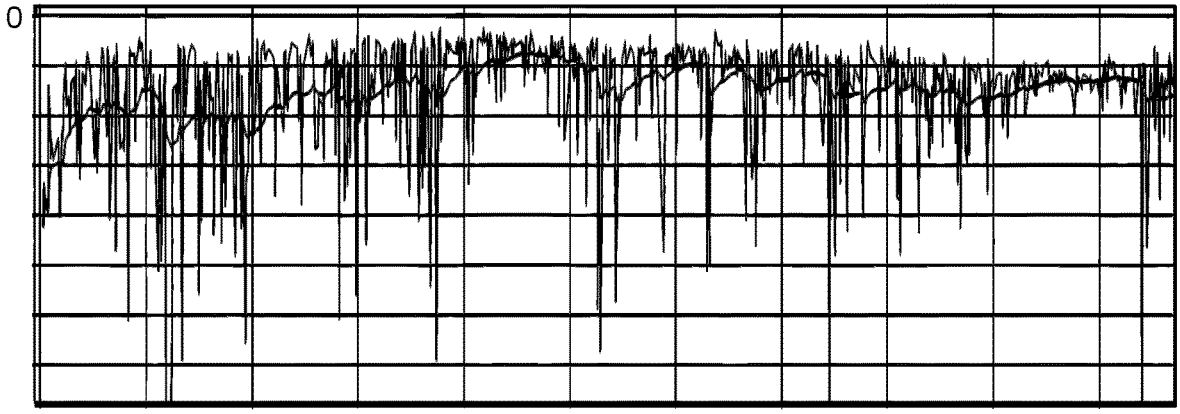
GUI 2150
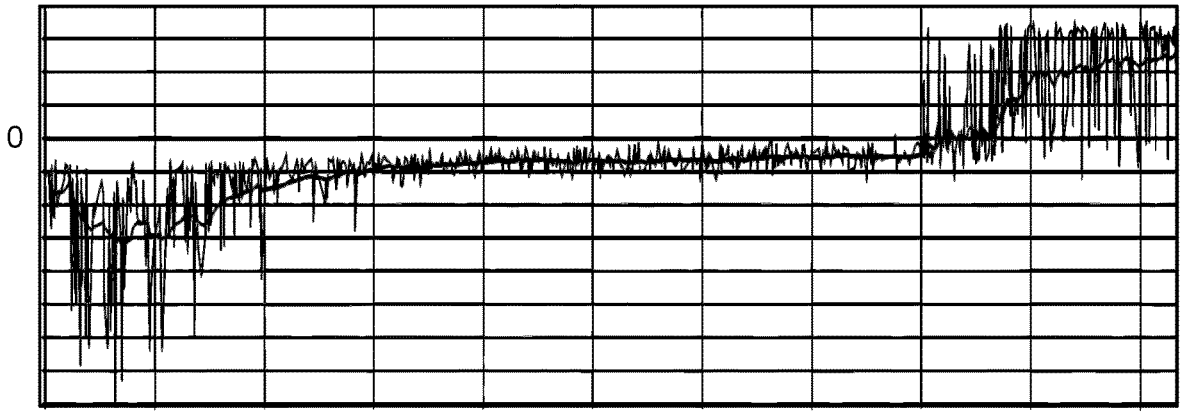
Fig. 21

System 2200
GUI 2201
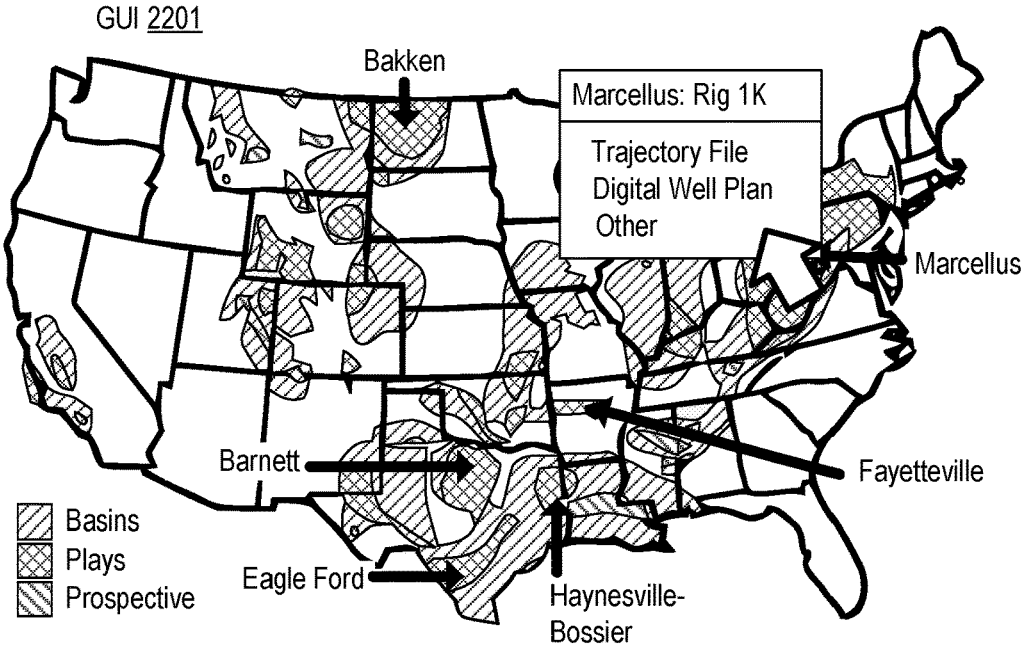
GUI 2202
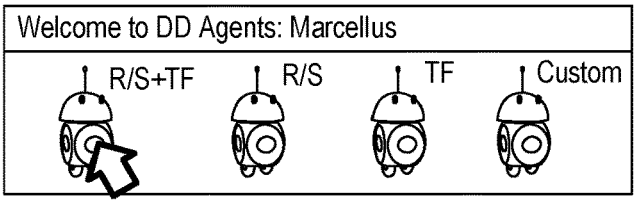
GUI 2203
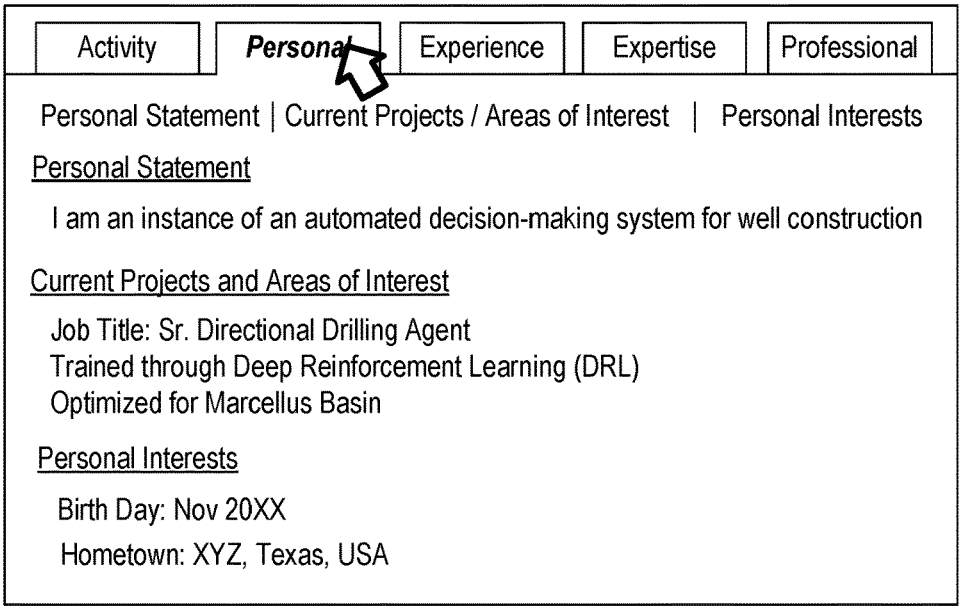
Fig. 22

2510
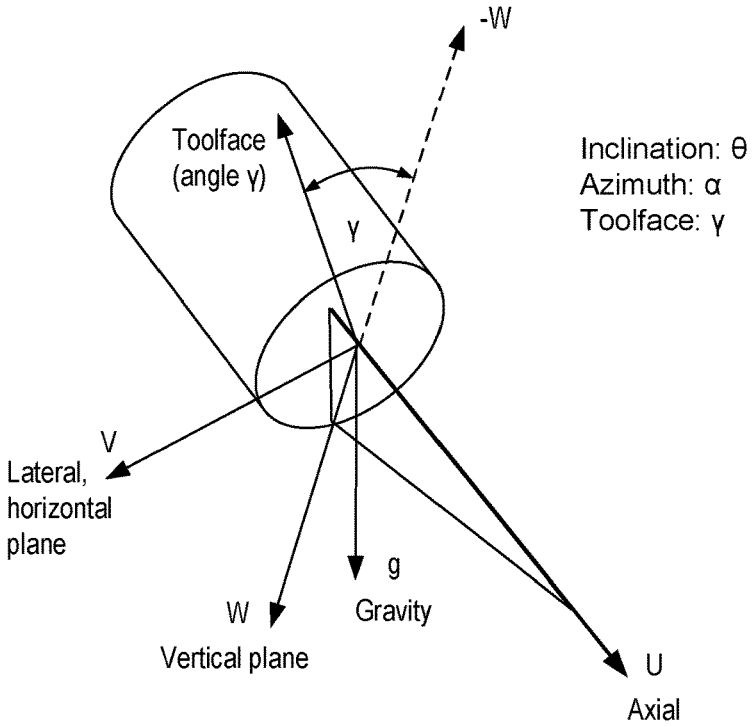
2530
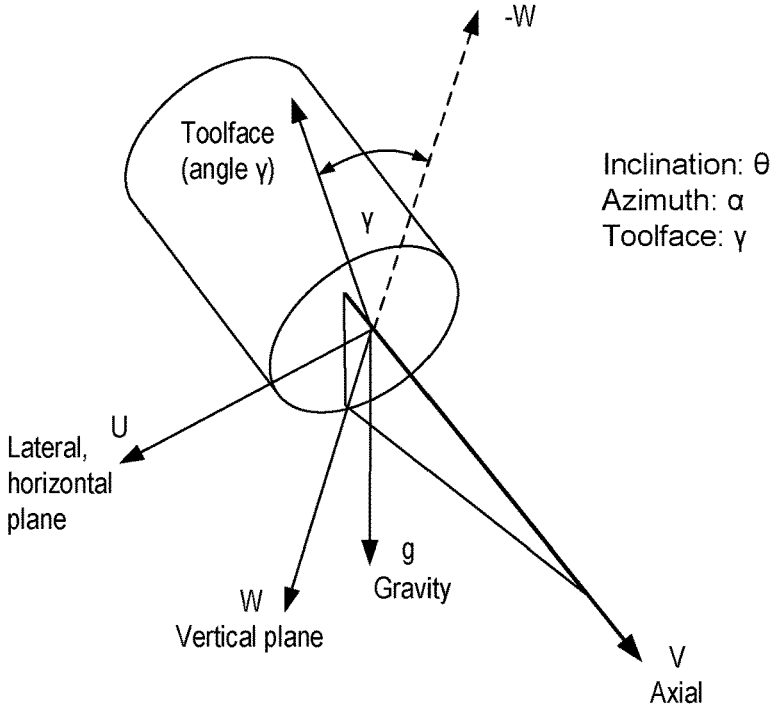
Fig. 25

DRILLING CONTROL

RELATED APPLICATION

This application is a continuation of, and claims priority to, U.S. application Ser. No. 16/776,373 filed 29 Jan. 2020, and now published as US 2020/0370409, which claims priority to and the benefit of a U.S. Provisional Application having Ser. No. 62/850,865, filed 21 May 2019, which is incorporated by reference herein.

BACKGROUND

A resource field can be an accumulation, pool or group of pools of one or more resources (e.g., oil, gas, oil and gas) in a subsurface environment. A resource field can include at least one reservoir. A reservoir may be shaped in a manner that can trap hydrocarbons and may be covered by an impermeable or sealing rock. A bore can be drilled into an environment where the bore (e.g., a borehole) may be utilized to form a well that can be utilized in producing hydrocarbons from a reservoir.

A rig can be a system of components that can be operated to form a bore in an environment, to transport equipment into and out of a bore in an environment, etc. As an example, a rig can include a system that can be used to drill a bore and to acquire information about an environment, about drilling, etc. A resource field may be an onshore field, an offshore field or an on- and offshore field. A rig can include components for performing operations onshore and/or offshore. A rig may be, for example, vessel-based, offshore platform-based, onshore, etc.

Field planning and/or development can occur over one or more phases, which can include an exploration phase that aims to identify and assess an environment (e.g., a prospect, a play, etc.), which may include drilling of one or more bores (e.g., one or more exploratory wells, etc.).

SUMMARY

A method can include receiving sensor data during drilling of a portion of a borehole in a geologic environment; selecting a drilling mode from a plurality of drilling modes based at least on a portion of the sensor data; simulating drilling of the borehole using the selected drilling mode and generating a state of the borehole in the geologic environment based on the simulated drilling of the borehole; generating a reward using the state of the borehole and a planned borehole trajectory and using the reward through deep reinforcement learning to maximize future rewards for drilling actions, wherein a sequence of decisions of rotating and sliding actions are determined through the deep reinforcement learning to follow the planned borehole trajectory and drill to a target. A system can include a processor; memory accessible to the processor; processor-executable instructions stored in the memory and executable by the processor to instruct the system to: receive sensor data during drilling of a portion of a borehole in a geologic environment; select a drilling mode from a plurality of drilling modes based at least on a portion of the sensor data; simulate drilling of the borehole using the selected drilling mode and generate a state of the borehole in the geologic environment based on the simulated drilling of the borehole; generate a reward using the state of the borehole and a planned borehole trajectory and use the reward through deep reinforcement learning to maximize future rewards for drilling actions, wherein a sequence of decisions of rotating and sliding actions are determined through the deep reinforcement learning to follow the planned borehole trajectory and drill to a target. A non-transitory computer-readable storage medium storing instructions that when executed by a computer, which includes a processor performs a method that can include receiving sensor data during drilling of a portion of a borehole in a geologic environment; selecting a drilling mode from a plurality of drilling modes based at least on a portion of the sensor data; simulating drilling of the borehole using the selected drilling mode and generating a state of the borehole in the geologic environment based on the simulated drilling of the borehole; generating a reward using the state of the borehole and a planned borehole trajectory and using the reward through deep reinforcement learning to maximize future rewards for drilling actions, wherein a sequence of decisions of rotating and sliding actions are determined through the deep reinforcement learning to follow the planned borehole trajectory and drill to a target. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

FIG. 1 illustrates examples of equipment in a geologic environment;

FIG. 11 illustrates an example of a graphical user interface;

FIG. 14 illustrates an example of a method;

FIG. 20 illustrates examples of graphical user interfaces;

FIG. 21 illustrates examples of graphical user interfaces;

FIG. 22 illustrates an example of a system;

FIG. 25 illustrates examples of representations of a drillstring toolface with respect to coordinate systems;

DETAILED DESCRIPTION

Figure 2:
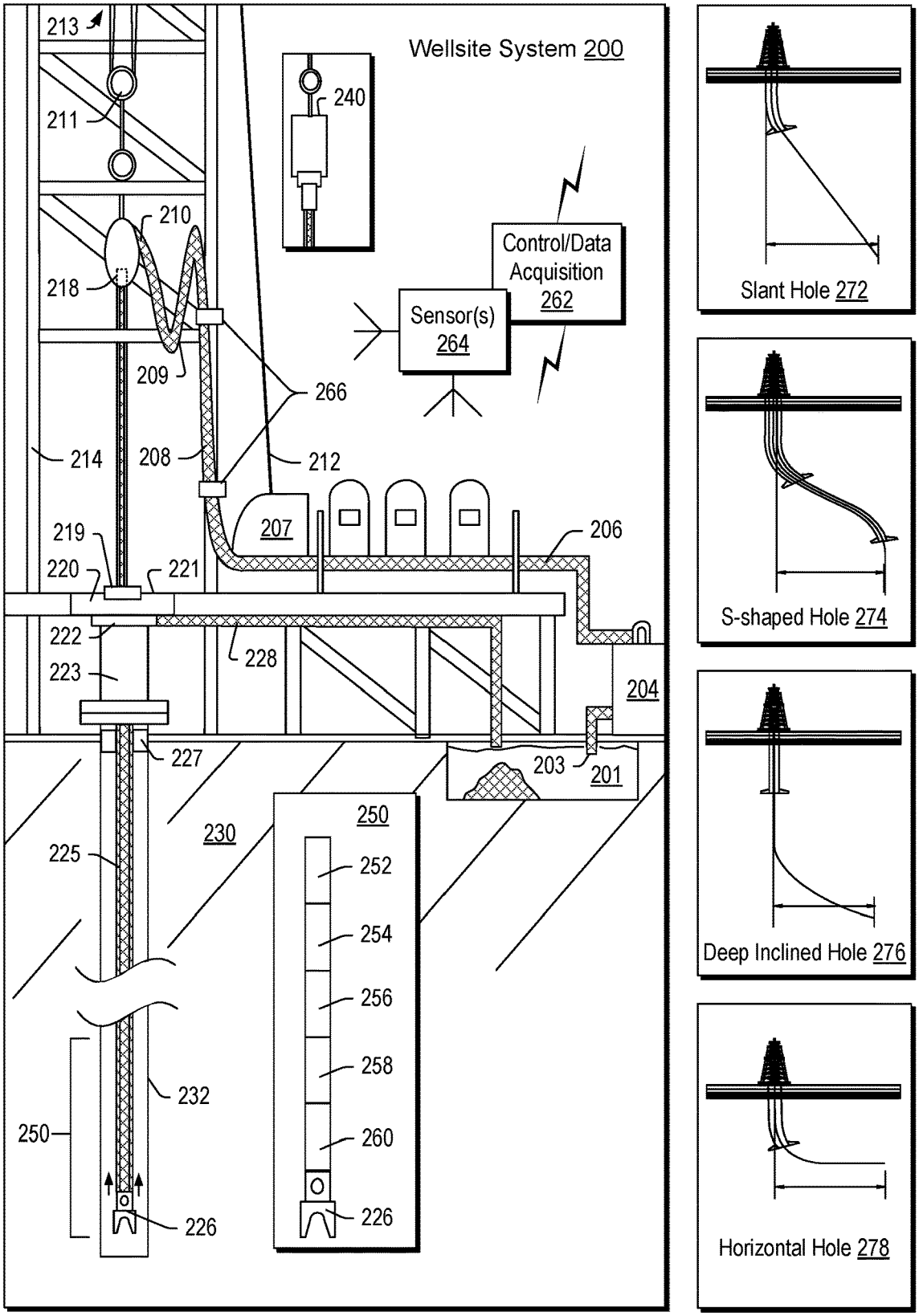
FIG. 2 illustrates examples of equipment and examples of hole types.

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

FIG. 1 shows an example of a geologic environment 120. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion (e.g., a lateral portion) that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, injection, production, etc. As an example, the equipment 127 and/or 128 may provide for measurement, collection, communication, storage, analysis, etc. of data such as, for example, production data (e.g., for one or more produced resources). As an example, one or more satellites may be provided for purposes of communications, data acquisition, etc.

FIG. 1 also shows an example of equipment 170 and an example of equipment 180. Such equipment, which may be systems of components, may be suitable for use in the geologic environment 120. While the equipment 170 and 180 are illustrated as land-based, various components may be suitable for use in an offshore system (e.g., an offshore rig, etc.).

The equipment 170 includes a platform 171, a derrick 172, a crown block 173, a line 174, a traveling block assembly 175, drawworks 176 and a landing 177 (e.g., a monkeyboard). As an example, the line 174 may be controlled at least in part via the drawworks 176 such that the traveling block assembly 175 travels in a vertical direction with respect to the platform 171. For example, by drawing the line 174 in, the drawworks 176 may cause the line 174 to run through the crown block 173 and lift the traveling block assembly 175 skyward away from the platform 171; whereas, by allowing the line 174 out, the drawworks 176 may cause the line 174 to run through the crown block 173 and lower the traveling block assembly 175 toward the platform 171. Where the traveling block assembly 175 carries pipe (e.g., casing, etc.), tracking of movement of the traveling block 175 may provide an indication as to how much pipe has been deployed.

A derrick can be a structure used to support a crown block and a traveling block operatively coupled to the crown block at least in part via line. A derrick may be pyramidal in shape and offer a suitable strength-to-weight ratio. A derrick may be movable as a unit or in a piece by piece manner (e.g., to be assembled and disassembled).

As an example, drawworks may include a spool, brakes, a power source and assorted auxiliary devices. Drawworks may controllably reel out and reel in line. Line may be reeled over a crown block and coupled to a traveling block to gain mechanical advantage in a "block and tackle" or "pulley" fashion. Reeling out and in of line can cause a traveling block (e.g., and whatever may be hanging underneath it), to be lowered into or raised out of a bore. Reeling out of line may be powered by gravity and reeling in by a motor, an engine, etc. (e.g., an electric motor, a diesel engine, etc.).

As an example, a crown block can include a set of pulleys (e.g., sheaves) that can be located at or near a top of a derrick or a mast, over which line is threaded. A traveling block can include a set of sheaves that can be moved up and down in a derrick or a mast via line threaded in the set of sheaves of the traveling block and in the set of sheaves of a crown block. A crown block, a traveling block and a line can form a pulley system of a derrick or a mast, which may enable handling of heavy loads (e.g., drillstring, pipe, casing, liners, etc.) to be lifted out of or lowered into a bore. As an example, line may be about a centimeter to about five centimeters in diameter as, for example, steel cable. Through use of a set of sheaves, such line may carry loads heavier than the line could support as a single strand.

As an example, a derrickman may be a rig crew member that works on a platform attached to a derrick or a mast. A derrick can include a landing on which a derrickman may stand. As an example, such a landing may be about 10 meters or more above a rig floor. In an operation referred to as trip out of the hole (TOH), a derrickman may wear a safety harness that enables leaning out from the work landing (e.g., monkeyboard) to reach pipe located at or near the center of a derrick or a mast and to throw a line around the pipe and pull it back into its storage location (e.g., fingerboards), for example, until it may be desirable to run the pipe back into the bore. As an example, a rig may include automated pipe-handling equipment such that the derrickman controls the machinery rather than physically handling the pipe.

As an example, a trip may refer to the act of pulling equipment from a bore and/or placing equipment in a bore. As an example, equipment may include a drillstring that can be pulled out of a hole and/or placed or replaced in a hole. As an example, a pipe trip may be performed where a drill bit has dulled or has otherwise ceased to drill efficiently and is to be replaced. As an example, a trip that pulls equipment out of a borehole may be referred to as pulling out of hole (POOH) and a trip that runs equipment into a borehole may be referred to as running in hole (RIH).

FIG. 2 shows an example of a wellsite system 200 (e.g., at a wellsite that may be onshore or offshore). As shown, the wellsite system 200 can include a mud tank 201 for holding mud and other material (e.g., where mud can be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (see, e.g., the derrick 172 of FIG. 1), a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use one or more directional drilling techniques, equipment, etc.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 can provide for operation of the drillstring 225 and other operations. As shown, the wellsite system 200 includes the traveling block 211 and the derrick 214 positioned over the borehole 232. As mentioned, the wellsite system 200 can include the rotary table 220 where the drillstring 225 pass through an opening in the rotary table 220.

As shown in the example of FIG. 2, the wellsite system 200 can include the kelly 218 and associated components, etc., or a top drive 240 and associated components. As to a kelly example, the kelly 218 may be a square or hexagonal metal/alloy bar with a hole drilled therein that serves as a mud flow path. The kelly 218 can be used to transmit rotary motion from the rotary table 220 via the kelly drive bushing 219 to the drillstring 225, while allowing the drillstring 225 to be lowered or raised during rotation. The kelly 218 can pass through the kelly drive bushing 219, which can be driven by the rotary table 220. As an example, the rotary table 220 can include a master bushing that operatively couples to the kelly drive bushing 219 such that rotation of the rotary table 220 can turn the kelly drive bushing 219 and hence the kelly 218. The kelly drive bushing 219 can include an inside profile matching an outside profile (e.g., square, hexagonal, etc.) of the kelly 218; however, with slightly larger dimensions so that the kelly 218 can freely move up and down inside the kelly drive bushing 219.

As to a top drive example, the top drive 240 can provide functions performed by a kelly and a rotary table. The top drive 240 can turn the drillstring 225. As an example, the top drive 240 can include one or more motors (e.g., electric and/or hydraulic) connected with appropriate gearing to a short section of pipe called a quill, that in turn may be screwed into a saver sub or the drillstring 225 itself. The top drive 240 can be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 can hold mud, which can be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via a the lines 206, 208 and 209 to a port of the kelly 218 or, for example, to a port of the top drive 240. The mud can then flow via a passage (e.g., or passages) in the drillstring 225 and out of ports located on the drill bit 226 (see, e.g., a directional arrow). As the mud exits the drillstring 225 via ports in the drill bit 226, it can then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drillstring 225 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drillstring 225 at a bottom of a wellbore, pumping of the mud commences to lubricate the drill bit 226 for purposes of drilling to enlarge the wellbore. As mentioned, the mud can be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud can cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measurement-while-drilling (MWD) module 256, an optional module 258, a rotary-steerable system (RSS) and/or motor 260, and the drill bit 226. Such components or modules may be referred to as tools where a drillstring can include a plurality of tools.

As to a RSS, it involves technology utilized for directional drilling. Directional drilling involves drilling into the Earth to form a deviated bore such that the trajectory of the bore is not vertical; rather, the trajectory deviates from vertical along one or more portions of the bore. As an example, consider a target that is located at a lateral distance from a surface location where a rig may be stationed. In such an example, drilling can commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; however, a mud motor can present some challenges depending on factors such as rate of penetration (ROP), transferring weight to a bit (e.g., weight on bit, WOB) due to friction, etc. A mud motor can be a positive displacement motor (PDM) that operates to drive a bit (e.g., during directional drilling, etc.). A PDM operates as drilling fluid is pumped through it where the PDM converts hydraulic power of the drilling fluid into mechanical power to cause the bit to rotate.

As an example, a PDM may operate in a combined rotating mode where surface equipment is utilized to rotate a bit of a drillstring (e.g., a rotary table, a top drive, etc.) by rotating the entire drillstring and where drilling fluid is utilized to rotate the bit of the drillstring. In such an example, a surface RPM (SRPM) may be determined by use of the surface equipment and a downhole RPM of the mud motor may be determined using various factors related to flow of drilling fluid, mud motor type, etc. As an example, in the combined rotating mode, bit RPM can be determined or estimated as a sum of the SRPM and the mud motor RPM, assuming the SRPM and the mud motor RPM are in the same direction.

As an example, a PDM mud motor can operate in a so-called sliding mode, when the drillstring is not rotated from the surface. In such an example, a bit RPM can be determined or estimated based on the RPM of the mud motor.

A RSS can drill directionally where there is continuous rotation from surface equipment, which can alleviate the sliding of a steerable motor (e.g., a PDM). A RSS may be deployed when drilling directionally (e.g., deviated, horizontal, or extended-reach wells). A RSS can aim to minimize interaction with a borehole wall, which can help to preserve borehole quality. A RSS can aim to exert a relatively consistent side force akin to stabilizers that rotate with the drillstring or orient the bit in the desired direction while continuously rotating at the same number of rotations per minute as the drillstring.

The LWD module 254 may be housed in a suitable type of drill collar and can contain one or a plurality of selected types of logging tools. It will also be understood that more than one LWD and/or MWD module can be employed, for example, as represented at by the module 256 of the drillstring assembly 250. Where the position of an LWD module is mentioned, as an example, it may refer to a module at the position of the LWD module 254, the module 256, etc. An LWD module can include capabilities for measuring, processing, and storing information, as well as for communicating with the surface equipment. In the illustrated example, the LWD module 254 may include a seismic measuring device.

The MWD module 256 may be housed in a suitable type of drill collar and can contain one or more devices for measuring characteristics of the drillstring 225 and the drill bit 226. As an example, the MWD tool 254 may include equipment for generating electrical power, for example, to power various components of the drillstring 225. As an example, the MWD tool 254 may include the telemetry equipment 252, for example, where the turbine impeller can generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation can include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well can include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring can include a positive displacement motor (PDM).

As an example, a system may be a steerable system and include equipment to perform method such as geosteering. As mentioned, a steerable system can be or include an RSS. As an example, a steerable system can include a PDM or of a turbine on a lower part of a drillstring which, just above a drill bit, a bent sub can be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment can make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, can allow for implementing a geosteering method. Such a method can include navigating a subsurface environment, for example, to follow a desired route to reach a desired target or targets.

As an example, a drillstring can include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering can include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 can include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 can be provided for tracking pipe, tracking movement of at least a portion of a drillstring, etc.

As an example, the system 200 can include one or more sensors 266 that can sense and/or transmit signals to a fluid conduit such as a drilling fluid conduit (e.g., a drilling mud conduit). For example, in the system 200, the one or more sensors 266 can be operatively coupled to portions of the standpipe 208 through which mud flows. As an example, a downhole tool can generate pulses that can travel through the mud and be sensed by one or more of the one or more sensors 266. In such an example, the downhole tool can include associated circuitry such as, for example, encoding circuitry that can encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 can include a transmitter that can generate signals that can be transmitted downhole via mud (e.g., drilling fluid) as a transmission medium.

As an example, one or more portions of a drillstring may become stuck. The term stuck can refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this can refer to a portion of a drillstring that cannot be rotated or moved axially. As an example, a condition referred to as "differential sticking" can be a condition whereby the drillstring cannot be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking can have time and financial cost.

As an example, a sticking force can be a product of the differential pressure between the wellbore and the reservoir and the area that the differential pressure is acting upon. This means that a relatively low differential pressure (delta p) applied over a large working area can be just as effective in sticking pipe as can a high differential pressure applied over a small area.

As an example, a condition referred to as "mechanical sticking" can be a condition where limiting or prevention of motion of the drillstring by a mechanism other than differential pressure sticking occurs. Mechanical sticking can be caused, for example, by one or more of junk in the hole, wellbore geometry anomalies, cement, keyseats or a buildup of cuttings in the annulus.

Figure 3:
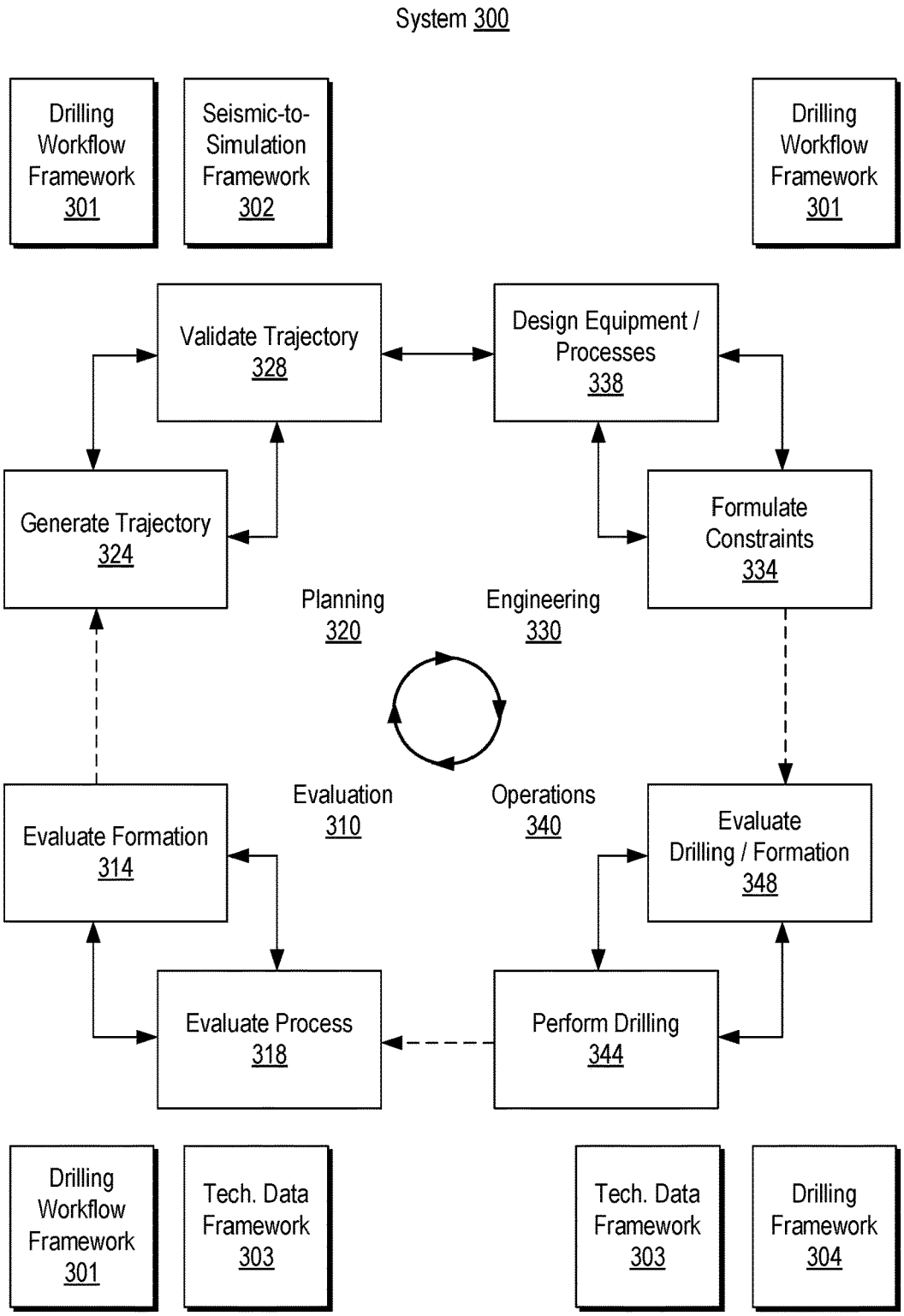
FIG. 3 illustrates an example of a system.

FIG. 3 shows an example of a system 300 that includes various equipment for evaluation 310, planning 320, engineering 330 and operations 340. For example, a drilling workflow framework 301, a seismic-to-simulation framework 302, a technical data framework 303 and a drilling framework 304 may be implemented to perform one or more processes such as a evaluating a formation 314, evaluating a process 318, generating a trajectory 324, validating a trajectory 328, formulating constraints 334, designing equipment and/or processes based at least in part on constraints 338, performing drilling 344 and evaluating drilling and/or formation 348.

In the example of FIG. 3, the seismic-to-simulation framework 302 can be, for example, the PETREL framework (Schlumberger, Houston, Texas) and the technical data framework 303 can be, for example, the TECHLOG framework (Schlumberger, Houston, Texas).

As an example, a framework can include entities that may include earth entities, geological objects or other objects such as wells, surfaces, reservoirs, etc. Entities can include virtual representations of actual physical entities that are reconstructed for purposes of one or more of evaluation, planning, engineering, operations, etc.

Entities may include entities based on data acquired via sensing, observation, etc. (e.g., seismic data and/or other information). An entity may be characterized by one or more properties (e.g., a geometrical pillar grid entity of an earth model may be characterized by a porosity property). Such properties may represent one or more measurements (e.g., acquired data), calculations, etc.

A framework may be an object-based framework. In such a framework, entities may include entities based on predefined classes, for example, to facilitate modeling, analysis, simulation, etc. An example of an object-based framework is the MICROSOFT .NET framework (Redmond, Washington), which provides a set of extensible object classes. In the .NET framework, an object class encapsulates a module of reusable code and associated data structures. Object classes can be used to instantiate object instances for use in by a program, script, etc. For example, borehole classes may define objects for representing boreholes based on well data.

As an example, a framework may be implemented within or in a manner operatively coupled to the DELFI cognitive exploration and production (E&P) environment (Schlumberger, Houston, Texas), which is a secure, cognitive, cloud-based collaborative environment that integrates data and workflows with digital technologies, such as artificial intelligence and machine learning. As an example, such an environment can provide for operations that involve one or more frameworks.

As an example, a framework can include an analysis component that may allow for interaction with a model or model-based results (e.g., simulation results, etc.). As to simulation, a framework may operatively link to or include a simulator such as the ECLIPSE reservoir simulator (Schlumberger, Houston Texas), the INTERSECT reservoir simulator (Schlumberger, Houston Texas), etc.

The aforementioned PETREL framework provides components that allow for optimization of exploration and development operations. The PETREL framework includes seismic to simulation software components that can output information for use in increasing reservoir performance, for example, by improving asset team productivity. Through use of such a framework, various professionals (e.g., geophysicists, geologists, well engineers, reservoir engineers, etc.) can develop collaborative workflows and integrate operations to streamline processes. Such a framework may be considered an application and may be considered a data-driven application (e.g., where data is input for purposes of modeling, simulating, etc.).

As mentioned with respect to the DELFI environment, one or more frameworks may be interoperative and/or run upon one or another. As an example, a framework environment marketed as the OCEAN framework environment (Schlumberger, Houston, Texas) may be utilized, which allows for integration of add-ons (or plug-ins) into a PETREL framework workflow. In an example embodiment, various components may be implemented as add-ons (or plug-ins) that conform to and operate according to specifications of a framework environment (e.g., according to application programming interface (API) specifications, etc.).

As an example, a framework can include a model simulation layer along with a framework services layer, a framework core layer and a modules layer. In a framework environment (e.g., OCEAN, DELFI, etc.), a model simulation layer can include or operatively link to a model-centric framework. In an example embodiment, a framework may be considered to be a data-driven application. For example, the PETREL framework can include features for model building and visualization. As an example, a model may include one or more grids where a grid can be a spatial grid that conforms to spatial locations per acquired data (e.g., satellite data, logging data, seismic data, etc.).

As an example, a model simulation layer may provide domain objects, act as a data source, provide for rendering and provide for various user interfaces. Rendering capabilities may provide a graphical environment in which applications can display their data while user interfaces may provide a common look and feel for application user interface components.

As an example, domain objects can include entity objects, property objects and optionally other objects. Entity objects may be used to geometrically represent wells, surfaces, reservoirs, etc., while property objects may be used to provide property values as well as data versions and display parameters. For example, an entity object may represent a well where a property object provides log information as well as version information and display information (e.g., to display the well as part of a model).

As an example, data may be stored in one or more data sources (or data stores, generally physical data storage devices), which may be at the same or different physical sites and accessible via one or more networks. As an example, a model simulation layer may be configured to model projects. As such, a particular project may be stored where stored project information may include inputs, models, results and cases. Thus, upon completion of a modeling session, a user may store a project. At a later time, the project can be accessed and restored using the model simulation layer, which can recreate instances of the relevant domain objects.

As an example, the system 300 may be used to perform one or more workflows. A workflow may be a process that includes a number of worksteps. A workstep may operate on data, for example, to create new data, to update existing data, etc. As an example, a workflow may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable at least in part in the PETREL framework, for example, that operates on seismic data, seismic attribute(s), etc.

As an example, seismic data can be data acquired via a seismic survey where sources and receivers are positioned in a geologic environment to emit and receive seismic energy where at least a portion of such energy can reflect off subsurface structures. As an example, a seismic data analysis framework or frameworks (e.g., consider the OMEGA framework, marketed by Schlumberger, Houston, Texas)

may be utilized to determine depth, extent, properties, etc. of subsurface structures. As an example, seismic data analysis can include forward modeling and/or inversion, for example, to iteratively build a model of a subsurface region of a geologic environment. As an example, a seismic data analysis framework may be part of or operatively coupled to a seismic-to-simulation framework (e.g., the PETREL framework, etc.).

As an example, a workflow may be a process implementable at least in part in a framework environment and by one or more frameworks. As an example, a workflow may include one or more worksteps that access a set of instructions such as a plug-in (e.g., external executable code, etc.). As an example, a framework environment may be cloud-based where cloud resources are utilized that may be operatively coupled to one or more pieces of field equipment such that data can be acquired, transmitted, stored, processed, analyzed, etc., using features of a framework environment. As an example, a framework environment may employ various types of services, which may be backend, frontend or backend and frontend services. For example, consider a client-server type of architecture where communications may occur via one or more application programming interfaces (APIs), one or more microservices, etc.

As an example, a framework may provide for modeling petroleum systems. For example, the modeling framework marketed as the PETROMOD framework (Schlumberger, Houston, Texas), which includes features for input of various types of information (e.g., seismic, well, geological, etc.) to model evolution of a sedimentary basin. The PETROMOD framework provides for petroleum systems modeling via input of various data such as seismic data, well data and other geological data, for example, to model evolution of a sedimentary basin. The PETROMOD framework may predict if, and how, a reservoir has been charged with hydrocarbons, including, for example, the source and timing of hydrocarbon generation, migration routes, quantities, pore pressure and hydrocarbon type in the subsurface or at surface conditions. In combination with a framework such as the PETREL framework, workflows may be constructed to provide basin-to-prospect scale exploration solutions. Data exchange between frameworks can facilitate construction of models, analysis of data (e.g., PETROMOD framework data analyzed using PETREL framework capabilities), and coupling of workflows.

As mentioned, a drillstring can include various tools that may make measurements. As an example, a wireline tool or another type of tool may be utilized to make measurements. As an example, a tool may be configured to acquire electrical borehole images. As an example, the fullbore Formation MicroImager (FMI) tool (Schlumberger, Houston, Texas) can acquire borehole image data. A data acquisition sequence for such a tool can include running the tool into a borehole with acquisition pads closed, opening and pressing the pads against a wall of the borehole, delivering electrical current into the material defining the borehole while translating the tool in the borehole, and sensing current remotely, which is altered by interactions with the material.

Analysis of formation information may reveal features such as, for example, vugs, dissolution planes (e.g., dissolution along bedding planes), stress-related features, dip events, etc. As an example, a tool may acquire information that may help to characterize a reservoir, optionally a fractured reservoir where fractures may be natural and/or artificial (e.g., hydraulic fractures). As an example, information acquired by a tool or tools may be analyzed using a framework such as the TECHLOG framework. As an example, the TECHLOG framework can be interoperable with one or more other frameworks such as, for example, the PETREL framework.

As an example, various aspects of a workflow may be completed automatically, may be partially automated, or may be completed manually, as by a human user interfacing with a software application that executes using hardware (e.g., local and/or remote). As an example, a workflow may be cyclic, and may include, as an example, four stages such as, for example, an evaluation stage (see, e.g., the evaluation equipment 310), a planning stage (see, e.g., the planning equipment 320), an engineering stage (see, e.g., the engineering equipment 330) and an execution stage (see, e.g., the operations equipment 340). As an example, a workflow may commence at one or more stages, which may progress to one or more other stages (e.g., in a serial manner, in a parallel manner, in a cyclical manner, etc.).

As an example, a workflow can commence with an evaluation stage, which may include a geological service provider evaluating a formation (see, e.g., the evaluation block 314). As an example, a geological service provider may undertake the formation evaluation using a computing system executing a software package tailored to such activity; or, for example, one or more other suitable geology platforms may be employed (e.g., alternatively or additionally). As an example, the geological service provider may evaluate the formation, for example, using earth models, geophysical models, basin models, petrotechnical models, combinations thereof, and/or the like. Such models may take into consideration a variety of different inputs, including offset well data, seismic data, pilot well data, other geologic data, etc. The models and/or the input may be stored in the database maintained by the server and accessed by the geological service provider.

As an example, a workflow may progress to a geology and geophysics ("G&G") service provider, which may generate a well trajectory (see, e.g., the generation block 324), which may involve execution of one or more G&G software packages. Examples of such software packages include the PETREL framework. As an example, a G&G service provider may determine a well trajectory or a section thereof, based on, for example, one or more model(s) provided by a formation evaluation (e.g., per the evaluation block 314), and/or other data, e.g., as accessed from one or more databases (e.g., maintained by one or more servers, etc.). As an example, a well trajectory may take into consideration various "basis of design" (BOD) constraints, such as general surface location, target (e.g., reservoir) location, and the like. As an example, a trajectory may incorporate information about tools, bottom-hole assemblies, casing sizes, etc., that may be used in drilling the well. A well trajectory determination may take into consideration a variety of other parameters, including risk tolerances, fluid weights and/or plans, bottom-hole pressures, drilling time, etc.

As an example, a workflow may progress to a first engineering service provider (e.g., one or more processing machines associated therewith), which may validate a well trajectory and, for example, relief well design (see, e.g., the validation block 328). Such a validation process may include evaluating physical properties, calculations, risk tolerances, integration with other aspects of a workflow, etc. As an example, one or more parameters for such determinations may be maintained by a server and/or by the first engineering service provider; noting that one or more model(s), well trajectory(ies), etc. may be maintained by a server and accessed by the first engineering service provider. For example, the first engineering service provider may include one or more computing systems executing one or more software packages. As an example, where the first engineering service provider rejects or otherwise suggests an adjustment to a well trajectory, the well trajectory may be adjusted or a message or other notification sent to the G&G service provider requesting such modification.

As an example, one or more engineering service providers (e.g., first, second, etc.) may provide a casing design, bottom-hole assembly (BHA) design, fluid design, and/or the like, to implement a well trajectory (see, e.g., the design block 338). In some embodiments, a second engineering service provider may perform such design using one of more software applications. Such designs may be stored in one or more databases maintained by one or more servers, which may, for example, employ STUDIO framework tools (Schlumberger, Houston, Texas), and may be accessed by one or more of the other service providers in a workflow.

As an example, a second engineering service provider may seek approval from a third engineering service provider for one or more designs established along with a well trajectory. In such an example, the third engineering service provider may consider various factors as to whether the well engineering plan is acceptable, such as economic variables (e.g., oil production forecasts, costs per barrel, risk, drill time, etc.), and may request authorization for expenditure, such as from the operating company's representative, well-owner's representative, or the like (see, e.g., the formulation block 334). As an example, at least some of the data upon which such determinations are based may be stored in one or more database maintained by one or more servers. As an example, a first, a second, and/or a third engineering service provider may be provided by a single team of engineers or even a single engineer, and thus may or may not be separate entities.

As an example, where economics may be unacceptable or subject to authorization being withheld, an engineering service provider may suggest changes to casing, a bottom-hole assembly, and/or fluid design, or otherwise notify and/or return control to a different engineering service provider, so that adjustments may be made to casing, a bottom-hole assembly, and/or fluid design. Where modifying one or more of such designs is impracticable within well constraints, trajectory, etc., the engineering service provider may suggest an adjustment to the well trajectory and/or a workflow may return to or otherwise notify an initial engineering service provider and/or a G&G service provider such that either or both may modify the well trajectory.

As an example, a workflow can include considering a well trajectory, including an accepted well engineering plan, and a formation evaluation. Such a workflow may then pass control to a drilling service provider, which may implement the well engineering plan, establishing safe and efficient drilling, maintaining well integrity, and reporting progress as well as operating parameters (see, e.g., the blocks 344 and 348). As an example, operating parameters, formation encountered, data collected while drilling (e.g., using logging-while-drilling or measuring-while-drilling technology), may be returned to a geological service provider for evaluation. As an example, the geological service provider may then re-evaluate the well trajectory, or one or more other aspects of the well engineering plan, and may, in some cases, and potentially within predetermined constraints, adjust the well engineering plan according to the real-life drilling parameters (e.g., based on acquired data in the field, etc.).

Whether the well is entirely drilled, or a section thereof is completed, depending on the specific embodiment, a workflow may proceed to a post review (see, e.g., the evaluation block 318). As an example, a post review may include reviewing drilling performance. As an example, a post review may further include reporting the drilling performance (e.g., to one or more relevant engineering, geological, or G&G service providers).

Various activities of a workflow may be performed consecutively and/or may be performed out of order (e.g., based partially on information from templates, nearby wells, etc. to fill in any gaps in information that is to be provided by another service provider). As an example, undertaking one activity may affect the results or basis for another activity, and thus may, either manually or automatically, call for a variation in one or more workflow activities, work products, etc. As an example, a server may allow for storing information on a central database accessible to various service providers where variations may be sought by communication with an appropriate service provider, may be made automatically, or may otherwise appear as suggestions to the relevant service provider. Such an approach may be considered to be a holistic approach to a well workflow, in comparison to a sequential, piecemeal approach.

As an example, various actions of a workflow may be repeated multiple times during drilling of a wellbore. For example, in one or more automated systems, feedback from a drilling service provider may be provided at or near real-time, and the data acquired during drilling may be fed to one or more other service providers, which may adjust its piece of the workflow accordingly. As there may be dependencies in other areas of the workflow, such adjustments may permeate through the workflow, e.g., in an automated fashion. In some embodiments, a cyclic process may additionally or instead proceed after a certain drilling goal is reached, such as the completion of a section of the wellbore, and/or after the drilling of the entire wellbore, or on a per-day, week, month, etc., basis.

Well planning can include determining a path of a well (e.g., a trajectory) that can extend to a reservoir, for example, to economically produce fluids such as hydrocarbons therefrom. Well planning can include selecting a drilling and/or completion assembly which may be used to implement a well plan. As an example, various constraints can be imposed as part of well planning that can impact design of a well. As an example, such constraints may be imposed based at least in part on information as to known geology of a subterranean domain, presence of one or more other wells (e.g., actual and/or planned, etc.) in an area (e.g., consider collision avoidance), etc. As an example, one or more constraints may be imposed based at least in part on characteristics of one or more tools, components, etc. As an example, one or more constraints may be based at least in part on factors associated with drilling time and/or risk tolerance.

As an example, a system can allow for a reduction in waste, for example, as may be defined according to LEAN. In the context of LEAN, consider one or more of the following types of waste: transport (e.g., moving items unnecessarily, whether physical or data); inventory (e.g., components, whether physical or informational, as work in process, and finished product not being processed); motion (e.g., people or equipment moving or walking unnecessarily to perform desired processing); waiting (e.g., waiting for information, interruptions of production during shift change, etc.); overproduction (e.g., production of material, information, equipment, etc. ahead of demand); over processing (e.g., resulting from poor tool or product design creating activity); and defects (e.g., effort involved in inspecting for and fixing defects whether in a plan, data, equipment, etc.). As an example, a system that allows for actions (e.g., methods, workflows, etc.) to be performed in a collaborative manner can help to reduce one or more types of waste.

As an example, a system can be utilized to implement a method for facilitating distributed well engineering, planning, and/or drilling system design across multiple computation devices where collaboration can occur among various different users (e.g., some being local, some being remote, some being mobile, etc.). In such a system, the various users via appropriate devices may be operatively coupled via one or more networks (e.g., local and/or wide area networks, public and/or private networks, land-based, marine-based and/or areal networks, etc.).

As an example, a system may allow well engineering, planning, and/or drilling system design to take place via a subsystems approach where a wellsite system is composed of various subsystem, which can include equipment subsystems and/or operational subsystems (e.g., control subsystems, etc.). As an example, computations may be performed using various computational platforms/devices that are operatively coupled via communication links (e.g., network links, etc.). As an example, one or more links may be operatively coupled to a common database (e.g., a server site, etc.). As an example, a particular server or servers may manage receipt of notifications from one or more devices and/or issuance of notifications to one or more devices. As an example, a system may be implemented for a project where the system can output a well plan, for example, as a digital well plan, a paper well plan, a digital and paper well plan, etc. Such a well plan can be a complete well engineering plan or design for the particular project.

Figure 4:
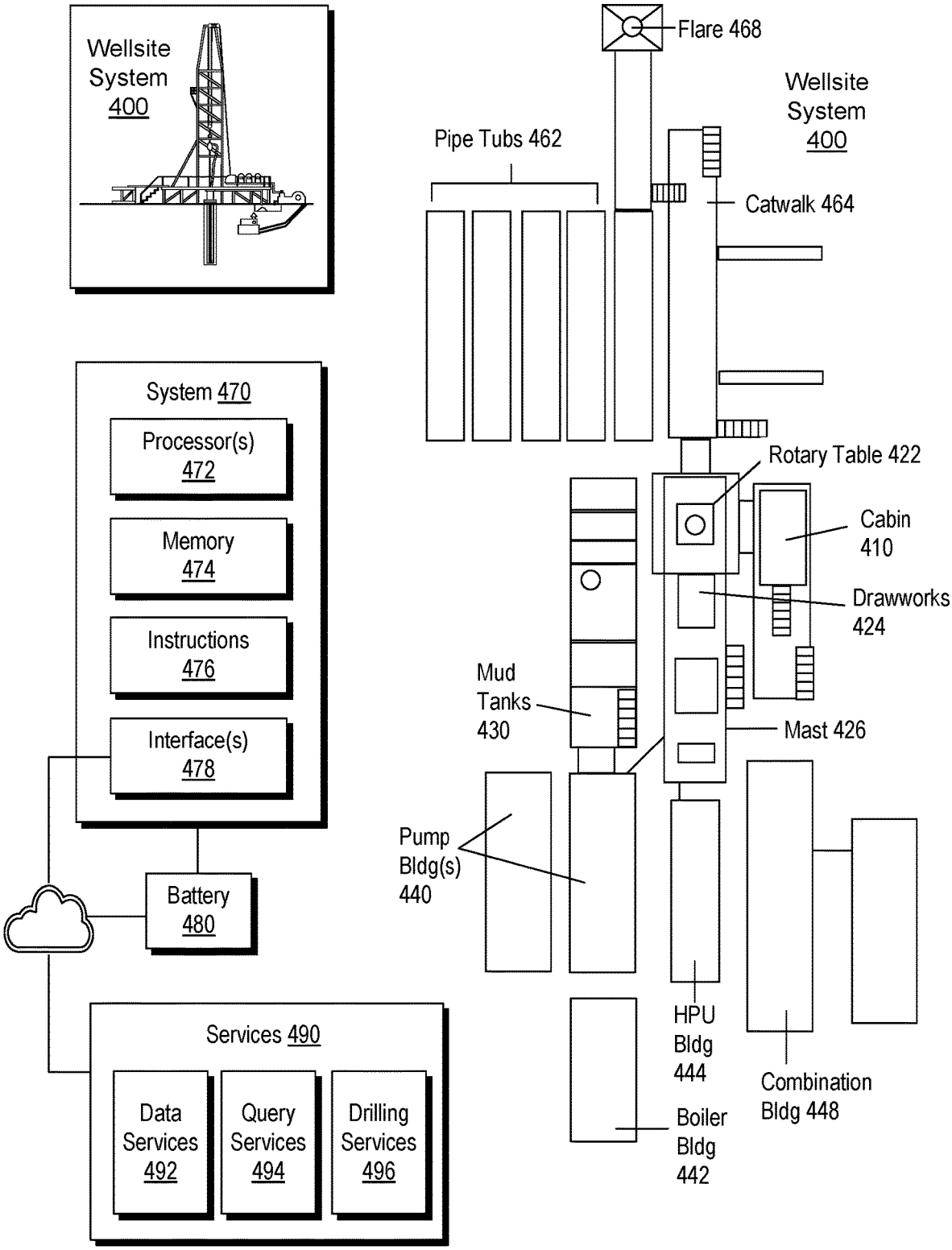
FIG. 4 illustrates an example of a wellsite system and an example of a computing system.

FIG. 4 shows an example of a wellsite system 400, specifically, FIG. 4 shows the wellsite system 400 in an approximate side view and an approximate plan view along with a block diagram of a system 470.

In the example of FIG. 4, the wellsite system 400 can include a cabin 410, a rotary table 422, drawworks 424, a mast 426 (e.g., optionally carrying a top drive, etc.), mud tanks 430 (e.g., with one or more pumps, one or more shakers, etc.), one or more pump buildings 440, a boiler building 442, an HPU building 444 (e.g., with a rig fuel tank, etc.), a combination building 448 (e.g., with one or more generators, etc.), pipe tubs 462, a catwalk 464, a flare 468, etc. Such equipment can include one or more associated functions and/or one or more associated operational risks, which may be risks as to time, resources, and/or humans.

As shown in the example of FIG. 4, the wellsite system 400 can include a system 470 that includes one or more processors 472, memory 474 operatively coupled to at least one of the one or more processors 472, instructions 476 that can be, for example, stored in the memory 474, and one or more interfaces 478. As an example, the system 470 can include one or more processor-readable media that include processor-executable instructions executable by at least one of the one or more processors 472 to cause the system 470 to control one or more aspects of the wellsite system 400. In such an example, the memory 474 can be or include the one or more processor-readable media where the processor-executable instructions can be or include instructions. As an example, a processor-readable medium can be a computer-readable storage medium that is not a signal and that is not a carrier wave.

FIG. 4 also shows a battery 480 that may be operatively coupled to the system 470, for example, to power the system 470. As an example, the battery 480 may be a back-up battery that operates when another power supply is unavailable for powering the system 470. As an example, the battery 480 may be operatively coupled to a network, which may be a cloud network. As an example, the battery 480 can include smart battery circuitry and may be operatively coupled to one or more pieces of equipment via a SMBus or other type of bus.

In the example of FIG. 4, services 490 are shown as being available, for example, via a cloud platform. Such services can include data services 492, query services 494 and drilling services 496. As an example, the services 490 may be part of a system such as the system 300 of FIG. 3.

As an example, the system 470 may be utilized to generate one or more sequences and/or to receive one or more sequences, which may, for example, be utilized to control one or more drilling operations. For example, consider a sequence that includes a sliding mode and a drilling mode and a transition therebetween.

Figure 5:
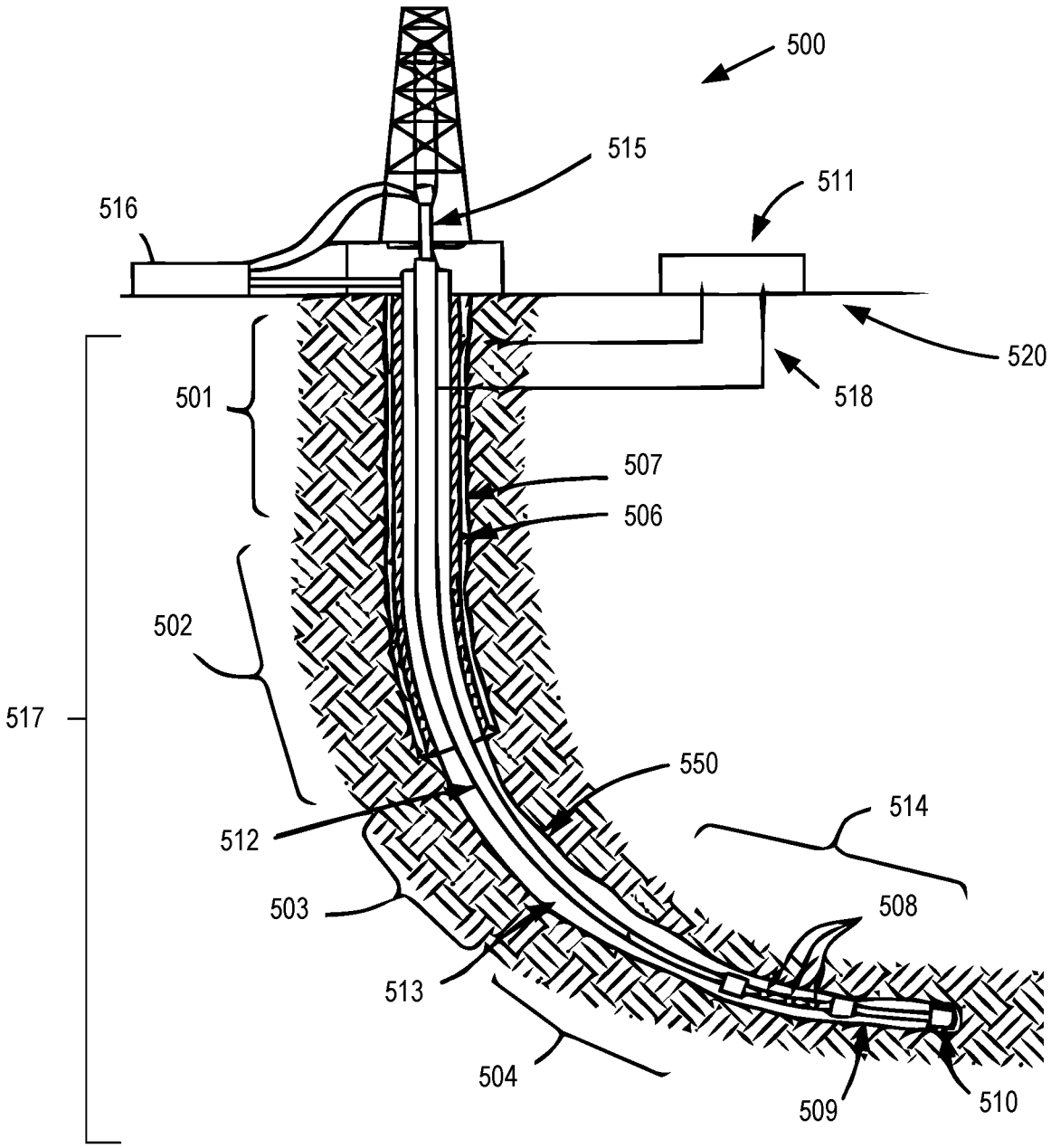
FIG. 5 illustrates an example of equipment in a geologic environment.

FIG. 5 shows a schematic diagram depicting an example of a drilling operation of a directional well in multiple sections. The drilling operation depicted in FIG. 5 includes a wellsite drilling system 500 and a field management tool 520 for managing various operations associated with drilling a bore hole 550 of a directional well 517. The wellsite drilling system 500 includes various components (e.g., drillstring 512, annulus 513, bottom hole assembly (BHA) 514, kelly 515, mud pit 516, etc.). As shown in the example of FIG. 5, a target reservoir may be located away from (as opposed to directly under) the surface location of the well 517. In such an example, special tools or techniques may be used to ensure that the path along the bore hole 550 reaches the particular location of the target reservoir.

As an example, the BHA 514 may include sensors 508, a rotary steerable system (RSS) 509, and a bit 510 to direct the drilling toward the target guided by a pre-determined survey program for measuring location details in the well. Furthermore, the subterranean formation through which the directional well 517 is drilled may include multiple layers (not shown) with varying compositions, geophysical characteristics, and geological conditions. Both the drilling planning during the well design stage and the actual drilling according to the drilling plan in the drilling stage may be performed in multiple sections (see, e.g., sections 501, 502, 503 and 504), which may correspond to one or more of the multiple layers in the subterranean formation. For example, certain sections (e.g., sections 501 and 502) may use cement 507 reinforced casing 506 due to the particular formation compositions, geophysical characteristics, and geological conditions.

In the example of FIG. 5, a surface unit 511 may be operatively linked to the wellsite drilling system 500 and the field management tool 520 via communication links 518. The surface unit 511 may be configured with functionalities to control and monitor the drilling activities by sections in real time via the communication links 518. The field management tool 520 may be configured with functionalities to store oilfield data (e.g., historical data, actual data, surface data, subsurface data, equipment data, geological data, geophysical data, target data, anti-target data, etc.) and determine relevant factors for configuring a drilling model and generating a drilling plan. The oilfield data, the drilling model, and the drilling plan may be transmitted via the communication link 518 according to a drilling operation workflow. The communication links 518 may include a communication subassembly.

During various operations at a wellsite, data can be acquired for analysis and/or monitoring of one or more operations. Such data may include, for example, subterranean formation, equipment, historical and/or other data.

Static data can relate to, for example, formation structure and geological stratigraphy that define the geological structures of the subterranean formation. Static data may also include data about a bore, such as inside diameters, outside diameters, and depths. Dynamic data can relate to, for example, fluids flowing through the geologic structures of the subterranean formation over time. The dynamic data may include, for example, pressures, fluid compositions (e.g. gas oil ratio, water cut, and/or other fluid compositional information), and states of various equipment, and other information.

The static and dynamic data collected via a bore, a formation, equipment, etc. may be used to create and/or update a three dimensional model of one or more subsurface formations. As an example, static and dynamic data from one or more other bores, fields, etc. may be used to create and/or update a three dimensional model. As an example, hardware sensors, core sampling, and well logging techniques may be used to collect data. As an example, static measurements may be gathered using downhole measurements, such as core sampling and well logging techniques. Well logging involves deployment of a downhole tool into the wellbore to collect various downhole measurements, such as density, resistivity, etc., at various depths. Such well logging may be performed using, for example, a drilling tool and/or a wireline tool, or sensors located on downhole production equipment. Once a well is formed and completed, depending on the purpose of the well (e.g., injection and/or production), fluid may flow to the surface (e.g., and/or from the surface) using tubing and other completion equipment. As fluid passes, various dynamic measurements, such as fluid flow rates, pressure, and composition may be monitored. These parameters may be used to determine various characteristics of a subterranean formation, downhole equipment, downhole operations, etc.

As an example, a system can include a framework that can acquire data such as, for example, real time data associated with one or more operations such as, for example, a drilling operation or drilling operations. As an example, consider the PERFORM toolkit framework (Schlumberger Limited, Houston, Texas).

As an example, a service can be or include one or more of OPTIDRILL, OPTILOG and/or other services marketed by Schlumberger Limited, Houston, Texas.

The OPTIDRILL technology can help to manage downhole conditions and BHA dynamics as a real time drilling intelligence service. The service can incorporate a rigsite display (e.g., a wellsite display) of integrated downhole and surface data that provides actionable information to mitigate risk and increase efficiency. As an example, such data may be stored, for example, to a database system (e.g., consider a database system associated with the STUDIO framework).

The OPTILOG technology can help to evaluate drilling system performance with single- or multiple-location measurements of drilling dynamics and internal temperature from a recorder. As an example, post-run data can be analyzed to provide input for future well planning.

As an example, information from a drill bit database may be accessed and utilized. For example, consider information from Smith Bits (Schlumberger Limited, Houston, Texas), which may include information from various operations (e.g., drilling operations) as associated with various drill bits, drilling conditions, formation types, etc.

As an example, one or more QTRAC services (Schlumberger Limited, Houston Texas) may be provided for one or more wellsite operations. In such an example, data may be acquired and stored where such data can include time series data that may be received and analyzed, etc.

As an example, one or more M-I SWACO services (M-I L.L.C., Houston, Texas) may be provided for one or more wellsite operations. For example, consider services for value-added completion and reservoir drill-in fluids, additives, cleanup tools, and engineering. In such an example, data may be acquired and stored where such data can include time series data that may be received and analyzed, etc.

As an example, one or more ONE-TRAX services (e.g., via the ONE-TRAX software platform, M-I L.L.C., Houston, Texas) may be provided for one or more wellsite operations. In such an example, data may be acquired and stored where such data can include time series data that may be received and analyzed, etc.

As an example, various operations can be defined with respect to WITS or WITSML, which are acronyms for well-site information transfer specification or standard (WITS) and markup language (WITSML). WITS/WITSML specify how a drilling rig or offshore platform drilling rig can communicate data. For example, as to slips, which are an assembly that can be used to grip a drillstring in a relatively non-damaging manner and suspend the drillstring in a rotary table, WITS/WITSML define operations such as "bottom to slips" time as a time interval between coming off bottom and setting slips, for a current connection; "in slips" as a time interval between setting the slips and then releasing them, for a current connection; and "slips to bottom" as a time interval between releasing the slips and returning to bottom (e.g., setting weight on the bit), for a current connection.

Well construction can occur according to various procedures, which can be in various forms. As an example, a procedure can be specified digitally and may be, for example, a digital plan such as a digital well plan. A digital well plan can be an engineering plan for constructing a wellbore. As an example, procedures can include information such as well geometries, casing programs, mud considerations, well control concerns, initial bit selections, offset well information, pore pressure estimations, economics and special procedures that may be utilized during the course of well construction, production, etc. While a drilling procedure can be carefully developed and specified, various conditions can occur that call for adjustment to a drilling procedure.

As an example, an adjustment can be made at a rigsite when acquisition equipment acquire information about conditions, which may be for conditions of drilling equipment, conditions of a formation, conditions of fluid(s), conditions as to environment (e.g., weather, sea, etc.), etc. Such an adjustment may be made on the basis of personal knowledge of one or more individuals at a rigsite. As an example, an operator may understand that conditions call for an increase in mudflow rate, a decrease in weight on bit, etc. Such an operator may assess data as acquired via one or more sensors (e.g., torque, temperature, vibration, etc.). Such an operator may call for performance of a procedure, which may be a test procedure to acquire additional data to understand better actual physical conditions and physical phenomena that may occur or that are occurring. An operator may be under one or more time constraints, which may be driven by physical phenomena, such as fluid flow, fluid pressure, compaction of rock, borehole stability, etc. In such an example, decision making by the operator can depend on time as conditions evolve. For example, a decision made at one fluid pressure may be sub-optimal at another fluid pressure in an environment where fluid pressure is changing. In such an example, timing as to implementing a decision as an adjustment to a procedure can have a broad ranging impact. An adjustment to a procedure that is made too late or too early can adversely impact other procedures compared to an adjustment to a procedure that is made at an optimal time (e.g., and implemented at the optimal time).

As an example, a system can include one or more automation assisted features. For example, consider a feature that can generate and/or receive one or more sequences that can be utilized to control a drilling operation. In such an example, a driller may utilize a generated sequence to control one or more pieces of equipment to drill a borehole. As an example, where automation can issue signals to one or more pieces of equipment, a controller can utilize a generated sequence or a portion thereof for automatic control. As explained, where a driller is involved in decision making and/or control, a generated sequence may facilitate drilling as the driller may rely on the generated sequence for making one or more adjustments to a drilling operation. Where one or more generated sequences are received in advance and/or in real-time, drilling operations can be performed more efficiently, for example, with respect to time to drill a section, a portion of a section, an entire borehole, etc. Such an approach may take equipment integrity (e.g., health, etc.) into consideration, for example, such an approach may account for risk of contact between a bit body and a formation and/or mud motor performance where a mud motor can be utilized to drive a bit.

Figure 6:
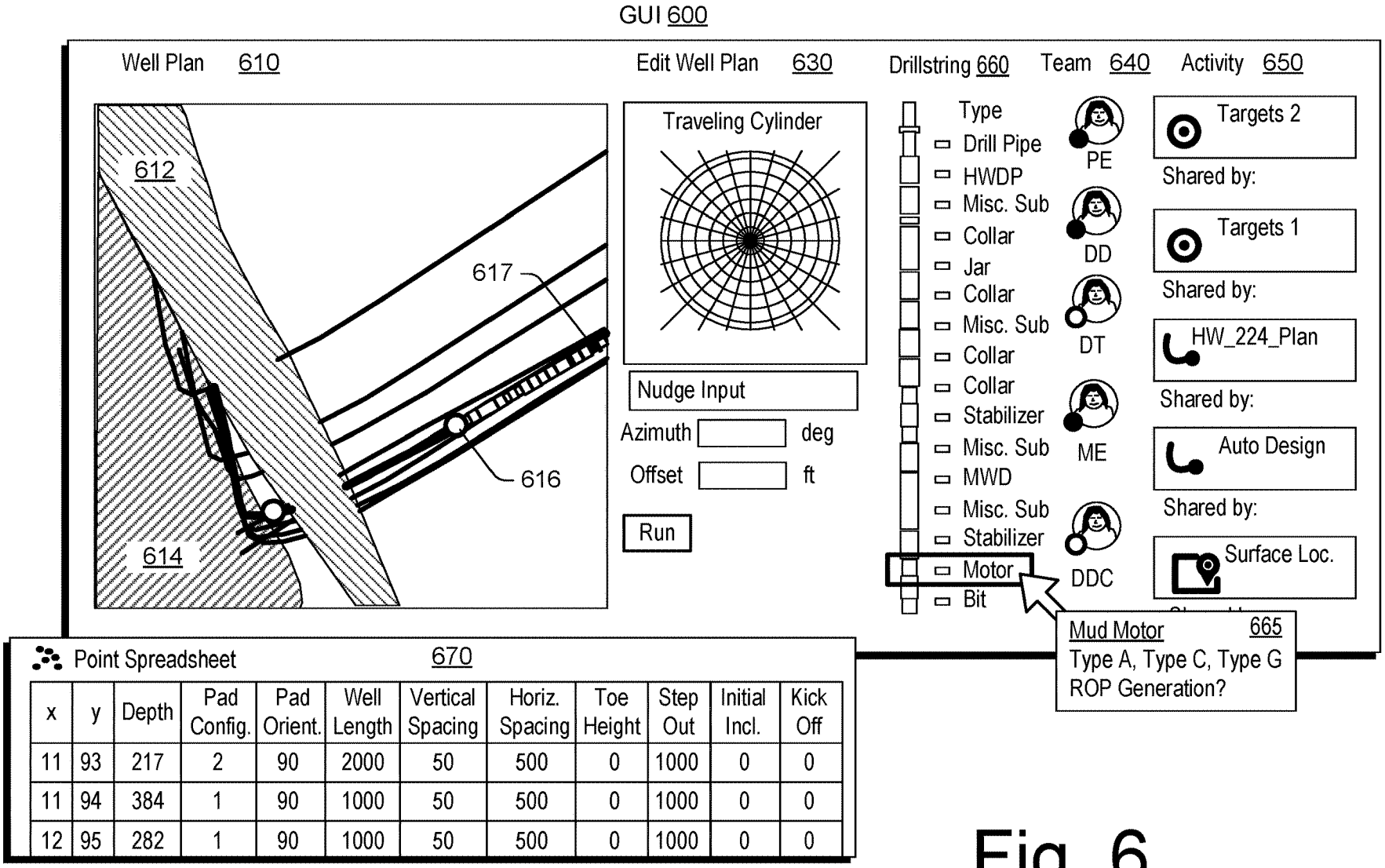
FIG. 6 illustrates an example of a graphical user interface.

FIG. 6 shows an example of a graphical user interface (GUI) 600 that includes information associated with a well plan. Specifically, the GUI 600 includes a panel 610 where surfaces representations 612 and 614 are rendered along with well trajectories where a location 616 can represent a position of a drillstring 617 along a well trajectory. The GUI 600 may include one or more editing features such as an edit well plan set of features 630. The GUI 600 may include information as to individuals of a team 640 that are involved, have been involved and/or are to be involved with one or more operations. The GUI 600 may include information as to one or more activities 650.

As shown in the example of FIG. 6, the GUI 600 can include a graphical control of a drillstring 660 where, for example, various portions of the drillstring 660 may be selected to expose one or more associated parameters (e.g., type of equipment, equipment specifications, operational history, etc.). In the example of FIG. 6, the drillstring graphical control 660 includes components such as drill pipe, heavy weight drill pipe (HWDP), subs, collars, jars, stabilizers, motor(s) and a bit. A drillstring can be a combination of drill pipe, a bottom hole assembly (BHA) and one or more other tools, which can include one or more tools that can help a drill bit turn and drill into material (e.g., a formation).

As an example, a workflow can include utilizing the graphical control of the drillstring 660 to select and/or expose information associated with a component or components such as, for example, a bit and/or a mud motor. As an example, in response to selection of a bit and/or a mud motor (e.g., consider a bit and mud motor combination), a computational framework (e.g., via a sequence engine, etc.) can generate one or more sequences, which may be utilized, for example, to operating drilling equipment in a particular mode (e.g., sliding mode, rotating mode, etc.). In the example of FIG. 6, a graphical control 665 is shown that can be rendered responsive to interaction with the graphical control of the drillstring 660, for example, to select a type of component and/or to generate one or more sequences, etc.

FIG. 6 also shows an example of a table 670 as a point spreadsheet that specifies information for a plurality of wells. As shown in the example table 670, coordinates such as "x" and "y" and "depth" can be specified for various features of the wells, which can include pad parameters, spacings, toe heights, step outs, initial inclinations, kick offs, etc.

Figure 7:
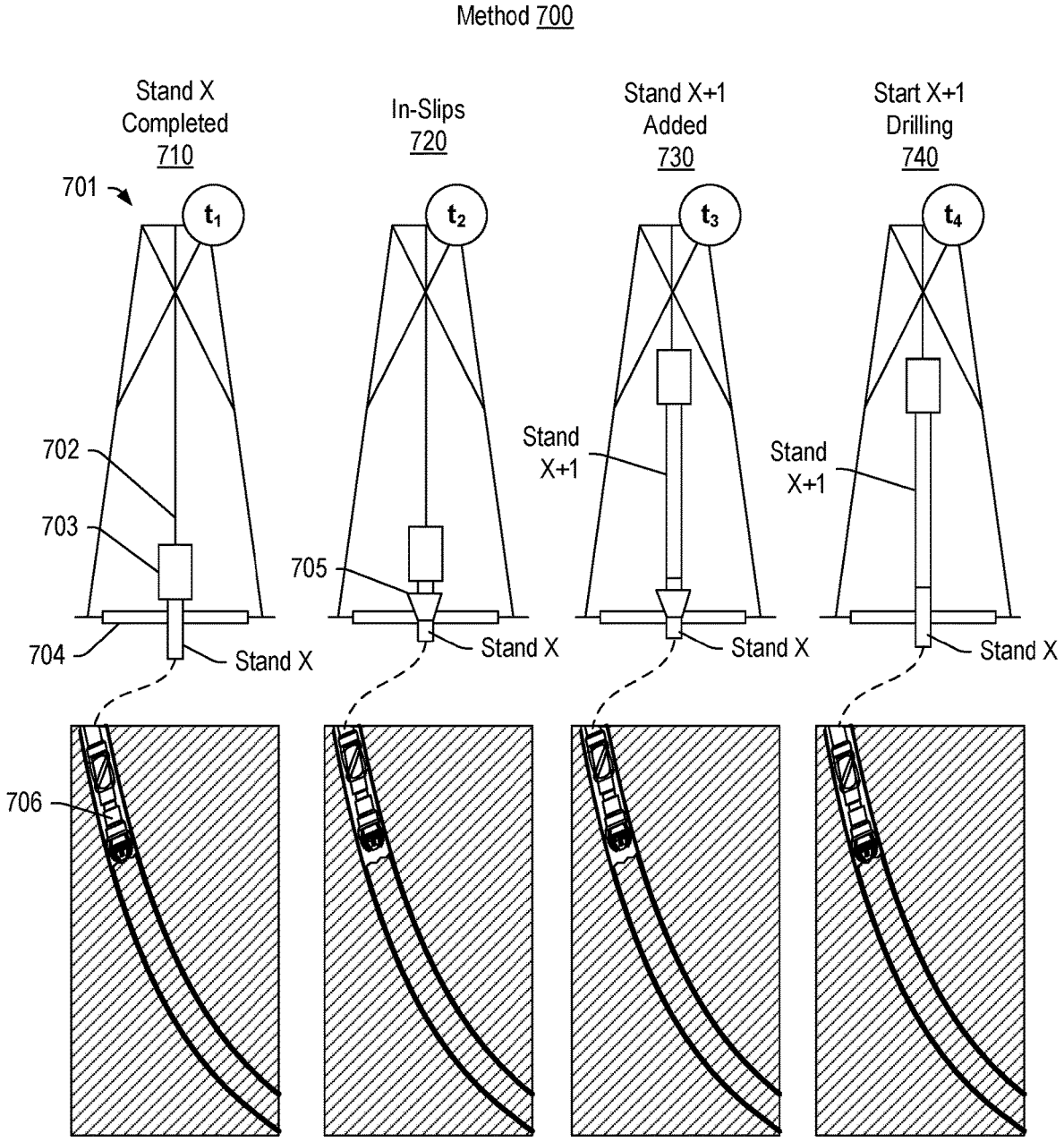
FIG. 7 illustrates an example of a method.

FIG. 7 shows an example of a method 700 that utilizes drilling equipment to perform drilling operations. As shown, the drilling equipment includes a rig 701, a lift system 702, a block 703, a platform 704, slips 705 and a bottom hole assembly 706. As shown, the rig 701 supports the lift system 702, which provides for movement of the block 703 above the platform 704 where the slips 705 may be utilized to support a drillstring that includes the bottom hole assembly 706, which is shown as including a bit to drill into a formation to form a borehole.

As to the drilling operations, they include a first operation 710 that completes a stand (Stand X) of the drillstring; a second operation 720 that pulls the drillstring off the bottom of the borehole by moving the block 703 upwardly and that supports the drillstring in the platform 704 using the slips 705; a third operation 730 that adds a stand (Stand X+1) to the drillstring; and a fourth operation 740 that removes the slips 705 and that lowers the drillstring to the bottom of the borehole by moving the block 703 downwardly. Various details of examples of equipment and examples of operations are also explained with respect to FIGS. 1, 2, 3, 4, 5 and 6.

As an example, drilling operations may utilize one or more types of equipment to drill, which can provide for various modes of drilling. As a borehole is deepened by drilling, as explained, stands can be added to a drillstring. A stand can be one or more sections of pipe; noting that a pipe-by-pipe or hybrid stand and pipe approach may be utilized.

In the example of FIG. 7, the operations 710, 720, 730 and 740 may take a period of time that may be of the order of minutes. For example, consider the amount of time it takes to position and connect a stand to another stand of a drillstring. A stand may be approximately 30 meters in length where precautions are taken to avoid detrimental contacting of the stand (metal or metal alloy) with other equipment or humans. During the period of time, one or more types of calculations, computations, communications, etc., may occur. For example, a driller may perform a depth of hole calculation based on a measured length of a stand, etc. As an example, a driller may analyze survey data as acquired by one or more downhole tools of a drillstring. Such survey data may help a driller to determine whether or not a planned or otherwise desired trajectory is being followed, which may help to inform the driller as to how drilling is to occur for an increase in borehole depth corresponding approximately to the length of the added stand.

As an example, where a top drive is utilized (e.g., consider the block 703 as including a top drive), as the top drive approaches the platform 704, rotation and circulation can be stopped and the drillstring lifted a distance off the bottom of the borehole. As the top drive is to be coupled to another stand, it is to be disconnected, which means that the drillstring is to be supported, which can be accomplished through use of the slips 705. The slips 705 can be set on a portion of the last stand (e.g., a pipe) to support the weight of the drillstring such that the top drive can be disconnected from the drillstring by operator(s), for example, using a top drive pipehandler. Once disconnected, the driller can then raise the top drive (e.g., the block 703) to an appropriate level such as a fingerboard level, where another stand of pipe (e.g., approximately 30 m) can be delivered to a set of drill pipe elevators hanging from the top drive. The stand (e.g., Stand X+1) can be raised and stabbed into the drillstring. The top drive can then be lowered until its drive stem engages an upper connection of the stand (e.g., Stand X+1). The top drive motor can be engaged to rotate the drive stem such that upper and lower connections of the stand are made up relatively simultaneously. In such an example, a backup tong may be used at the platform 704 (e.g., drill floor) to prevent rotation of the drillstring as the connections are being made. After the connections are properly made up, the slips 705 can be released (e.g., out-of-slips). Circulation of drilling fluid (e.g., mud) can commence (e.g., resume) and, once the bit of the bottom hole assembly 706 contacts the bottom of the borehole, the top drive can be utilized for drilling to deepen the borehole. The entire process, from the time the slips are set on the drillstring (e.g., in-slips), a new stand is added, the connections are made up, and the slips are released (e.g., out-of-slips), allowing drilling to resume, can take on the order of tens of seconds to minutes, generally less than 10 minutes where operations are normal and as expected.

As to the aforementioned top drive approach, the process of adding a new stand of pipe to the drillstring, and drilling down to the platform (e.g., the floor), can involve fewer actions and demand less involvement from a drill crew when compared to kelly drilling (e.g., rotary table drilling). Drillers and rig crews can become relatively proficient in drilling with top drives. Built-in features such as thread compensation, remote-controlled valves to stop the flow of drilling fluids, and mechanisms to tilt the elevators and links to the derrickman or floor crew can add to speed, convenience and safety associated with top drive drilling.

As an example, a top drive can be utilized when drilling with single joints (e.g., 10 m lengths) of pipe, although greater benefit may be achieved by drilling with triples (e.g., stands of pipe). As explained, with the drill pipe being supported and rotated from the top, an entire stand of drill pipe can be drilled down at one time. Such an approach can extend the time the bit is on bottom and can help to produce a cleaner borehole. Compared to kelly drilling, where a connection is made after drilling down a single joint of pipe, top drive drilling can result in faster drilling by reducing demand for two out of three connections.

As mentioned, a well can be a direction well, which is constructed using directional drilling. Directional wells have been a boon to oil and gas production, particularly in unconventional plays, where horizontal and extended-reach wells can help to maximize wellbore exposure through productive zones.

One or more of various technologies can be utilized for directional drilling. For example, consider a steerable mud motor that can be utilized to achieve a desired borehole trajectory to and/or through one or more target zones. As an example, a directional drilling operation can use a downhole mud motor when they kick off the well, build angle, drill tangent sections and maintain trajectory.

A mud motor can include a bend in a motor bearing housing that provides for steering a bit toward a desired target. A bend can be surface adjustable (e.g., a surface adjustable bend (SAB)) and, for example, set at an angle in a range of operational angles (e.g., consider 0 degrees to approximate 5 degrees, 0 degrees to approximately 4 degrees, 0 degrees to approximately 3 degrees, etc.). The bend can aim to be sufficient for pointing the bit in a given direction while being small enough to permit rotation of the entire mud motor assembly during rotary drilling. The deflection cause by a bend can be a factor that determines a rate at which a mud motor can build angle to construct a desired borehole. By orienting the bend in a specific direction, referred to as a toolface angle, a drilling operation can change the inclination and azimuth of a borehole trajectory. To maintain the orientation of the bend, the drillstring is operated in a sliding mode where the entire drillstring itself does not rotate in the borehole (e.g., via a top drive, a rotary table, etc.) and where bit rotation for drilling is driven by a mud motor of the drillstring.

A mud motor is a type of positive displacement motor (PDM) powered by drilling fluid. As an example, a mud motor can include an eccentric helical rotor and stator assembly drive. As drilling fluid (e.g., mud) is pumped downhole, the drilling fluid flows through the stator and turns the rotor. The mud motor converts hydraulic power to mechanical power to turn a drive shaft that causes a bit operatively coupled to the mud motor to rotate.

Through use of a mud motor, a directional drilling operation can alternate between rotating and sliding modes of drilling. In the rotating mode, a rotary table or top drive is operated to rotate an entire drillstring to transmit power to a bit. As mentioned, the rotating mode can include combined rotation via surface equipment and via a downhole mud motor. In the rotating mode, rotation enables a bend in the motor bearing housing to be directed equally across directions and thus maintain a straight drilling path. As an example, one or more measurement-while-drilling (MWD) tools integrated into a drillstring can provide real-time inclination and azimuth measurements. Such measurements may be utilized to alert a driller, a controller, etc., to one or more deviations from a desired trajectory (e.g., a planned trajectory, etc.). To adjust for a deviation or to alter a trajectory, a drilling operation can switch from the rotating mode to the sliding mode. As mentioned, in the sliding mode, the drillstring is not rotated; rather, a downhole motor turns the bit and the borehole is drilled in the direction the bit is point, which is controlled by a motor toolface orientation. Upon adjustment of course and reestablishing a desired trajectory that aims to hit a target (or targets), a drilling operation may transition from the sliding mode to the rotating mode, which, as mentioned, can be a combined surface and downhole rotating mode.

Of the two modes, slide drilling of the sliding mode tends to be less efficient; hence, lateral reach can come at the expense of penetration rate. The rate of penetration (ROP) achieved using a sliding technique tends to be approximately 10 percent to 25 percent of that attainable using a rotating technique. For example, when a mud motor is operated in the sliding mode, axial drag force in a curve portion and/or in a lateral portion acts to reduce the impact of surface weight such that surface weight is not effectively transferred downhole to a bit, which can lead to a lower penetration rate and lower drilling efficiency.

Various types of automated systems (e.g., auto drillers) may aim to help a drilling operation to achieve gains in horizontal reach with noticeably faster rates of penetration.

When transitioning from the rotating mode to the sliding mode, a drilling operation can halt rotation of a drillstring and initiate a slide by orienting a bit to drill, for example, in alignment with a trajectory proposed in a well plan. As to halting rotation of a drillstring, consider, as an example, a drilling operation that pulls a bit off-bottom and reciprocates drillpipe to release torque that has built up within the drillstring. The drilling operation can then orient a downhole mud motor using real-time MWD toolface measurements to ensure the specified borehole deviation is obtained. Following this relatively time-consuming orientation process, the drilling operation can set a top drive brake to prevent further rotation from the surface. In such an example, a sliding drilling operation can begin as the drilling operation eases off a drawworks brake to control hook load, which, in turn, affects the magnitude of weight imposed at the bit (e.g., WOB). As an example, minor right and left torque adjustments (e.g., clockwise and counter-clockwise) may be applied manually to steer the bit as appropriate to keep the trajectory on course.

As the depth or lateral reach increases, a drillstring tends to be subjected to greater friction and drag. These forces, in turn, affect ability to transfer weight to the bit (e.g., WOB) and control toolface orientation while sliding, which may make it more difficult to attain sufficient ROP and maintain a desired trajectory to a target (or targets). Such issues can result in increased drilling time, which may adversely impact project economics and ultimately limit length of a lateral section of a borehole and hence a lateral section of a completed well (e.g., a producing well).

The capability to transfer weight to a bit affects several aspects of directional drilling. As an example, a drilling operation can transfers weight to a bit by easing, or slacking off, a brake, which can transfer some of the hook load, or drillstring weight, to the bit. The difference between the weight imposed at the bit and the amount of weight made available by easing the brake at the surface is primarily caused by drag. As a horizontal departure of a borehole increases, longitudinal drag of the drillpipe along the borehole tends to increase.

Controlling weight at the bit throughout the sliding mode can be made more difficult by drillstring elasticity, which permits the pipe to move nonproportionally. Such elasticity can cause one segment of drillstring to move while other segments remain stationary or move at different velocities. Conditions such as, for example, poor hole cleaning may also affect weight transfer. In the sliding mode, hole cleaning tends to be less efficient because of a lack of pipe rotation; noting that pipe rotation facilitates turbulent flow in the annulus between the pipe (drillstring pipe or stands) and the borehole and/or cased section(s). Poor hole cleaning is associated with ability to carry solids (e.g., crushed rock) in drilling fluid (e.g., mud). As solids accumulate on the low side of a borehole due to gravity, the cross-sectional area of the borehole can decrease and cause an increase in friction on a drillstring (e.g., pipe or stands), which can make it more difficult to maintain a desired weight on bit (WOB), which may be a desired constant WOB. As an example, poor hole cleaning may give rise to an increased risk of sticking (e.g., stuck pipe).

Differences in frictional forces between a drillstring inside of casing versus that in open hole can cause weight to be released suddenly, as can hang-ups caused by key seats and ledges. A sudden transfer of weight to the bit that exceeds a downhole motor's capacity may cause bit rotation to abruptly halt and the motor to stall. Frequent stalling can damage the stator component of a mud motor, depending on the amount of the weight transferred. A drilling operation can aim to operate a mud motor within a relatively narrow load range in an effort to maintain an acceptable ROP without stalling.

As an example, a system can include a console, which can include one or more displays that can render one or more graphical user interfaces (GUIs) that include data from one or more sensors. As an example, an impending stall might be indicated by an increase in WOB as rendered to a GUI, for example, with no corresponding upsurge in downhole pressure to signal that an increase in downhole WOB has actually occurred. In such an example, at some point, the WOB indicator may show an abrupt decrease, indicating a sudden transfer of force from the drillstring to the bit. Increases in drag impede an ability to remove torque downhole, making it more difficult to set and maintain toolface orientation.

Toolface orientation can be affected by torque and WOB. When weight is applied to the bit, torque at the bit tends to increase. As mentioned, torque can be transmitted downhole through a drillstring, which is operated generally for drilling by turning to the right, in a clockwise direction. As weight is applied to the bit, reactive torque, acting in the opposite direction, can develop. Such left-hand torque (e.g., bit reaction torque in a counter-clockwise direction) tends to twist the drillstring due to the elastic flexibility of drillstring in torsional direction. In such conditions, the motor toolface angle can rotate with the twist of drillstring. A drilling operation can consider the twist angle due to reactive torque when the drilling operation tries to orient the toolface of a mud motor from the surface. Reactive torque tends to build as weight is increased, for example, reaching its maximum value when a mud motor stalls. As an example, reactive torque can be taken into account as a drilling operation tries to orient a mud motor from the surface. In practice, a drilling operation may act to make minor shifts in toolface orientation by changing downhole WOB, which alters the reactive torque. To produce larger changes, the drilling operation may act to lift a bit off-bottom and reorient the toolface. However, even after the specified toolface orientation is achieved, maintaining that orientation can be at times challenging. As mentioned, longitudinal drag tends to increases with lateral reach, and weight transfer to the bit can become more erratic along the length of a horizontal section, thus allowing reactive torque to build and consequently change the toolface angle. The effort and time spent on orienting the toolface can adversely impact productive time on the rig.

As explained, directional drilling can involve operating in the rotating mode and operating in the sliding mode where multiple transitions can be made between these two modes. As mentioned, drilling fluid can be utilized to drive a downhole mud motor and hence rotate a bit in a sliding mode while surface equipment can be utilized to rotate an entire drillstring in a rotating mode (e.g., a rotary table, a top drive, etc.), optionally in combination with drilling fluid being utilized to drive a downhole mud motor (e.g., a combined rotating mode). Directional drilling operations can depend on various factors, including operational parameters that can be at least to some extent controllable. For example, one or more factors such as mode transitions, lifting, WOB, RPM, torque, and drilling fluid flow rate can be controllable during a drilling operation.

Figure 8:
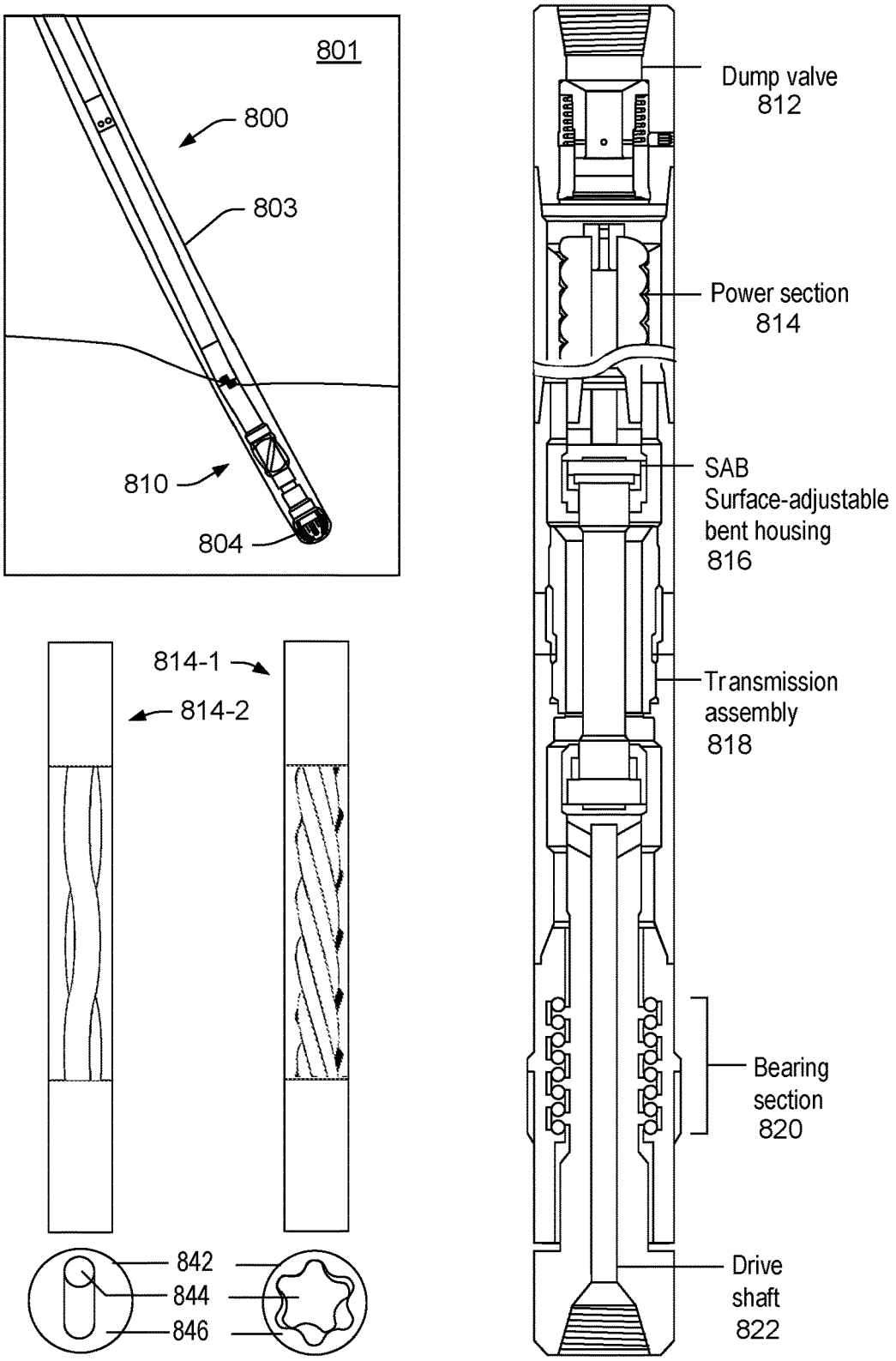
FIG. 8 illustrates examples of directional drilling equipment.

FIG. 8 shows an example of a drilling assembly 800 in a geologic environment 801 that includes a borehole 803 where the drilling assembly 800 (e.g., a drillstring) includes a bit 804 and a motor section 810 where the motor section 810 includes a mud motor that can drive the bit 804 (e.g., cause the bit 804 to rotate and deepen the borehole 803).

As shown, the motor section 810 includes a dump valve 812, a power section 814, a surface-adjustable bent housing 816, a transmission assembly 818, a bearing section 820 and a drive shaft 822, which can be operatively coupled to a bit such as the bit 804. Flow of drilling fluid through the power section 814 can generate power that can rotate the drive shaft 822, which can rotate the bit 804.

As to the power section 814, two examples are illustrated as a power section 814-1 and a power section 814-2 each of which includes a housing 842, a rotor 844 and a stator 846. The rotor 844 and the stator 846 can be characterized by a ratio. For example, the power section 814-1 can be a 5:6 ratio and the power section 814-2 can be a 1:2 ratio, which, as seen in cross-sectional views, can involve lobes (e.g., a rotor/stator lobe configuration). The motor section 810 of FIG. 8 may be a POWERPAK family motor section (Schlumberger Limited, Houston, Texas) or another type of motor section. The POWERPAK family of motor sections can include ratios of 1:2, 2:3, 3:4, 4:5, 5:6 and 7:8 with corresponding lobe configurations.

A power section can convert hydraulic energy from drilling fluid into mechanical power to turn a bit. For example, consider the reverse application of the Moineau pump principle. During operation, drilling fluid can be pumped into a power section at a pressure that causes the rotor to rotate within the stator where the rotational force is transmitted through a transmission shaft and drive shaft to a bit.

A motor section may be manufactured in part of corrosion-resistant stainless steel where a thin layer of chrome plating may be present to reduce friction and abrasion. As an example, tungsten carbide may be utilized to coat a rotor, for example, to reduce abrasion wear and corrosion damage. As to a stator, it can be formed of a steel tube, which may be a housing (see, e.g., the housing 842) with an elastomeric material that lines the bore of the steel tube to define a stator. An elastomeric material may be referred to as a liner or, when assembled with the tube or housing, may be referred to as a stator. As an example, an elastomeric material may be molded into the bore of a tube. An elastomeric material can be formulated to resist abrasion and hydrocarbon induced deterioration. Various types of elastomeric materials may be utilized in a power section and some may be proprietary. Properties of an elastomeric material can be tailored for particular types of operations, which may consider factors such as temperature, speed, rotor type, type of drilling fluid, etc. Rotors and stators can be characterized by helical profiles, for example, by spirals and/or lobes. A rotor can have one less fewer spiral or lobe than a stator (see, e.g., the cross-sectional views in FIG. 8).

During operation, the rotor and stator can form a continuous seal at their contact points along a straight line, which produces a number of independent cavities. As fluid is forced through these progressive cavities, it causes the rotor to rotate inside the stator. The movement of the rotor inside the stator is referred to as nutation. For each nutation cycle, the rotor rotates by a distance of one lobe width. The rotor nutates each lobe in the stator to complete one revolution of the bit box. For example, a motor section with a 7:8 rotor/stator lobe configuration and a speed of 100 RPM at the bit box will have a nutation speed of 700 cycles per minute. Generally, torque output increases with the number of lobes, which corresponds to a slower speed. Torque also depends on the number of stages where a stage is a complete spiral of a stator helix. Power is defined as speed times torque; however, a greater number of lobes in a motor does not necessarily mean that the motor produces more power. Motors with more lobes tend to be less efficient because the seal area between the rotor and the stator increases with the number of lobes.

The difference between the size of a rotor mean diameter (e.g., valley to lobe peak measurement) and the stator minor diameter (lobe peak to lobe peak) is defined as the rotor/stator interference fit. Various motors are assembled with a rotor sized to be larger than a stator internal bore under planned downhole conditions, which can produce a strong positive interference seal that is referred to as a positive fit. Where higher downhole temperatures are expected, a positive fit can be reduced during motor assembly to allow for swelling of an elastomeric material that forms the stator (e.g., stator liner). Mud weight and vertical depth can be considered as they can influence the hydrostatic pressure on the stator liner. A computational framework such as, for example, the POWERFIT framework (Schlumberger Limited, Houston, Texas), may be utilized to calculate a desired interference fit.

As to some examples of elastomeric materials, consider nitrile rubber, which tends to be rated to approximately 138 C (280 F), and highly saturated nitrile, which may be formulated to resist chemical attack and be rated to approximately 177 C (350 F).

The spiral stage length of a stator is defined as the axial length for one lobe in the stator to rotate 360 degrees along its helical path around the body of the stator. The stage length of a rotor differs from that of a stator as a rotor has a shorter stage length than its corresponding stator. More stages can increase the number of fluid cavities in a power section, which can result in a greater total pressure drop. Under the same differential pressure conditions, the power section with more stages tends to maintain speed better as there tends to be less pressure drop per stage and hence less leakage.

Drilling fluid temperature, which may be referred to as mud temperature or mud fluid temperature, can be a factor in determining an amount of interference in assembling a stator and a rotor of a power section. As to interference, greater interference can result in a stator experiencing higher shearing stresses, which can cause fatigue damage. Fatigue can lead to premature chunking failure of a stator liner. As an example, chlorides or other such halides may cause damage to a power section. For example, such halides may damage a rotor through corrosion where a rough edged rotor can cut into a stator liner (e.g., cutting the top off an elastomeric liner). Such cuts can reduce effectiveness of a rotor/stator seal and may cause a motor to stall (e.g., chunking the stator) at a low differential pressure. For oil-based mud (OBM) with supersaturated water phases and for salt muds, a coated rotor can be beneficial.

As to differential pressure, as mentioned, it is defined as the difference between the on-bottom and off-bottom drilling pressure, which is generated by the rotor/stator section (power section) of a motor. As mentioned, for a larger pressure difference, there tends to be higher torque output and lower shaft speed. A motor that is run with differential pressures greater than recommended can be more prone to premature chunking. Such chunking may follow a spiral path or be uniform through the stator liner. A life of a power section can depend on factors that can lead to chunking (e.g., damage to a stator), which may depend on characteristics of a rotor (e.g., surface characteristics, etc.).

As to trajectory of a wellbore to be drilled, it can be defined in part by one or more dogleg severities (DLSs). Rotating a motor in high DLS interval of a well can increase risk of damage to a stator. For example, the geometry of a wellbore can cause a motor section to bend and flex. A power section stator can be relatively more flexible that other parts of a motor. Where the stator housing bends, the elastomeric liner can be biased or pushed upon by the housing, which can result in force being applied by the elastomeric liner to the rotor. Such force can lead to excessive compression on the stator lobes and cause chunking.

A motor can have a power curve. A test can be performed using a dynamo meter in a laboratory, for example, using water at room temperature to determine a relationship between input, which is flow rate and differential pressure, to power output, in the form of RPM and torque. Such information can be available in a motor handbook. However, what is actually happening downhole can differ due to various factors. For example, due to effect of downhole pressure and temperature, output can be reduced (e.g., the motor power output). Such a reduction may lead one to conclude that a motor is not performing. In response, a driller may keep pushing such that the pressure becomes too high, which can damage elastomeric material due to stalling (e.g., damage a stator).

Figure 9:
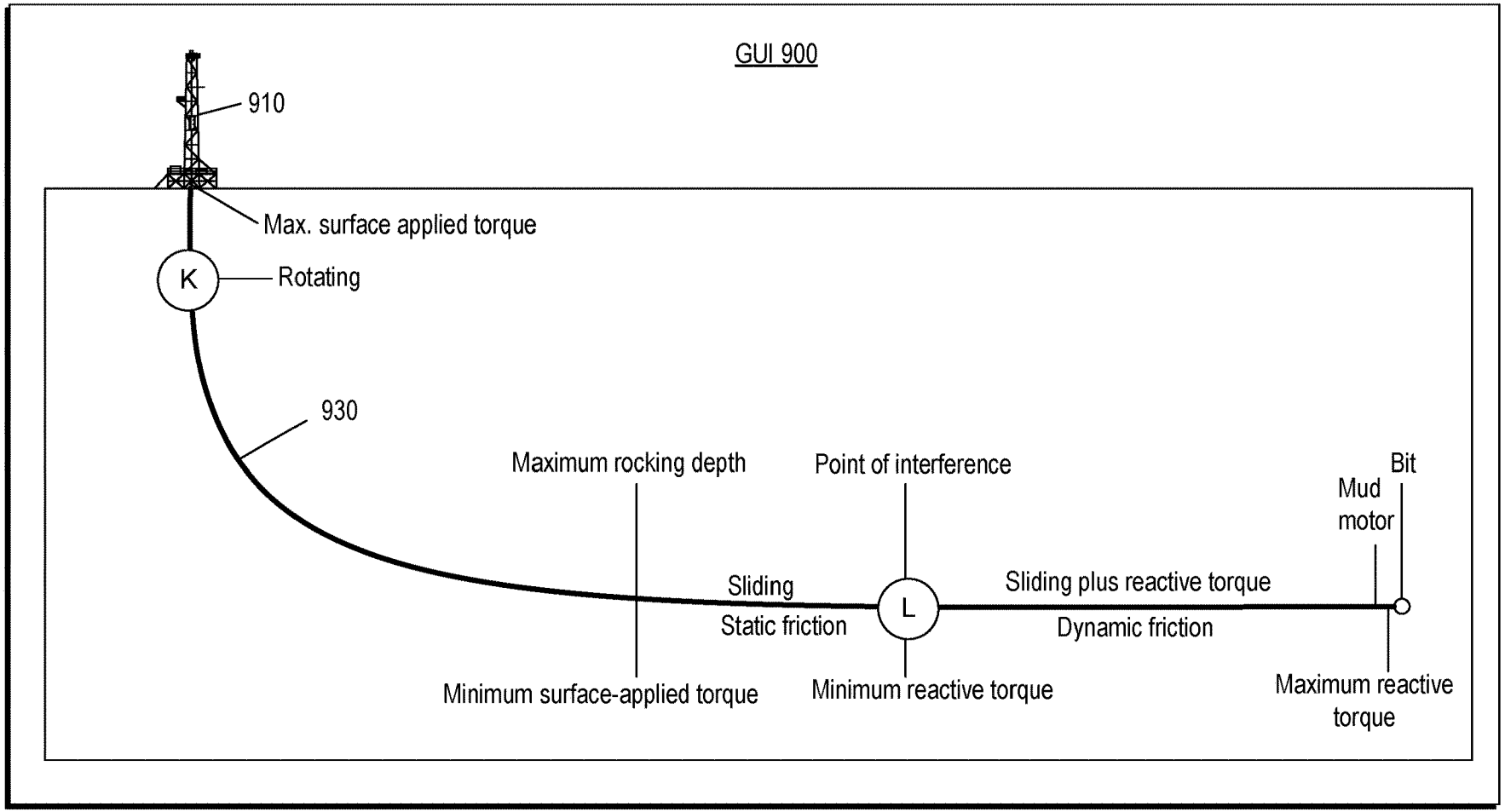
FIG. 9 illustrates an example of a graphical user interface.

FIG. 9 shows an example of a graphical user interface 900 that includes a graphic of a system 910 and a graphic of a trajectory 930 where the system 910 can perform directional drilling to drill a borehole according to the trajectory 930. As shown, the trajectory 930 includes a substantially vertical section, a dogleg and a substantially lateral section (e.g., a substantially horizontal section). As an example, the dogleg can be defined between a kickoff point (K) and a landing point (L), which are shown approximately as points along the trajectory 930. The system 910 can be operated in various operational modes, which can include, for example, rotary drilling and sliding.

In the example of FIG. 9, longitudinal drag along the drillstring can be reduced from the surface down to a maximum rocking depth, at which friction and imposed torque are in balance. As an example, a drilling operation can include manipulating surface torque oscillations such that the maximum rock depth may be moved deep enough to produce a substantial reduction in drag. As an example, reactive torque from a bit can create vibrations that propagate back uphole, breaking friction and longitudinal drag across a bottom section of a drillstring up to a point of interference, where the torque is balanced by static friction. As shown in the example of FIG. 9, an intermediate zone may remain relatively unaffected by surface rocking torque or by reactive torque. In the example of FIG. 9, a drilling operation can include monitoring torque, WOB and ROP while sliding. As an example, such a drilling operation may aim to minimize length of the intermediate zone and thus reduce longitudinal drag.

A drilling operation in the sliding mode that involves manual adjustments to change and/or maintain a toolface orientation can be challenging. As an example, a drilling operation in the sliding mode can depend on an ability to transfer weight to a bit without stalling a mud motor and an ability to reduce longitudinal drag sufficiently to achieve and maintain a desired toolface angle. As an example, a drilling operation in the sliding mode can aim to achieve an acceptable ROP while taking into account one or more of various other factors (e.g., equipment capabilities, equipment condition, tripping, etc.).

In a drilling operation, as an example, amount of surface torque (e.g., STOR) supplied by a top drive can largely dictate how far downhole rocking motion can be transmitted. As an example, a relationship between torque and rocking depth can be modeled using a torque and drag framework (e.g., T&D framework). As an example, a system may include one or more T&D features.

As an example, a system may utilize inputs from surface hook load and standpipe pressure as well as downhole MWD toolface angle. In such an example, the system may automatically determine the amount of surface torque that is appropriate to transfer weight downhole to a bit, which may allow an operation to not come off-bottom to make a toolface adjustment, which can results in a more efficient drilling operation and reduced wear on downhole equipment. Such a system may be referred to as an automation assisted system.

Figure 10:
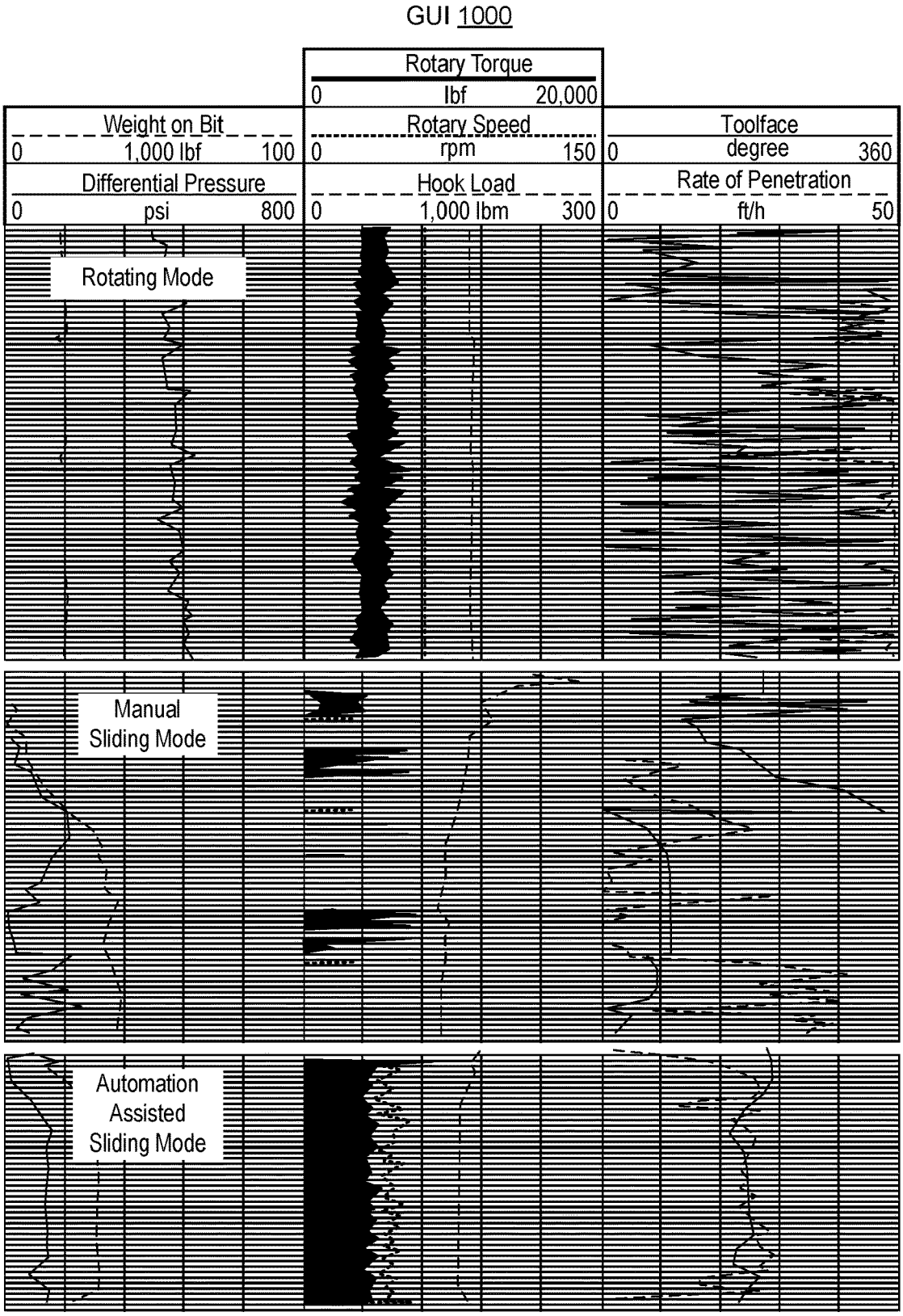
FIG. 10 illustrates an example of a graphical user interface.

FIG. 10 shows an example of a graphical user interface 1000 that includes various tracks for different types of operations, which include rotating, manual sliding, and automation assisted sliding according to a provided amount of surface torque. As shown in the GUI 1000, comparisons can be made for rotating and sliding drilling parameters for the rotating mode and the sliding mode. As shown, rate of penetration (ROP) and toolface orientation control can depend large on an ability of a system to transfer weight to the bit and counter the effects of torque and drag between rotating and sliding modes. As shown, the best ROP is achieved while rotating; however, toolface varies drastically, as there is no attempt to control it (Track 3). Hook load (Track 2) and weight on bit (WOB) remain fairly constant while differential pressure (Track 1) shows a slight increase as depth increases. To begin manual sliding, a drilling operation can act to pull off-bottom to release trapped torque; during this time, WOB (Track 1) decreases while hook load (Track 2) increases. As drilling proceeds, inconsistencies in differential pressure (e.g., difference between pressures when the bit is on-bottom versus off-bottom) indicate poor transfer of weight to the bit (Track 1). Spikes of rotary torque indicate efforts to orient and maintain toolface orientation (Track 2). As shown, toolface control may be poor because of trouble transferring weight to bit, which is also reflected by poor ROP (Track 3). Using an automation assisted sliding mode system, a directional driller can more quickly gain toolface orientation. When the WOB increased, differential pressure was consistent, demonstrating good weight transfer (Track 1). In the example of FIG. 10, weight on bit during a sliding operation is lower than during a manual sliding operation. Left-right oscillation of the drillpipe is relatively constant through the slide (Track 2). Average ROP is substantially higher than that attained during the manual slide, and toolface orientation is more consistent (Track 3).

FIG. 11 shows an example of a graphical user interface 1100 that includes various types of information for construction of a well where times are rendered for corresponding actions. In the example of FIG. 11, the times are shown as an estimated time (ET) in hours and a total or cumulative time (TT), which is in days. Another time may be a clean time, which can be for performing an action or actions without occurrence of non-productive time (NPT) while the estimated time (ET) can include NPT, which may be determined using one or more databases, probabilistic analysis, etc. In the example of FIG. 11, the total time (TT or cumulative time) may be a sum of the estimated time column. As an example, during execution and/or replanning the GUI 1100 may be rendered and revised accordingly to reflect changes. As shown in the example of FIG. 11, the GUI 1100 can include selectable elements and/or highlightable elements. As an example, an element may be highlighted responsive to a signal that indicates that an activity is currently being performed, is staged, is to be revised, etc. For example, a color coding scheme may be utilized to convey information to a user via the GUI 1100.

As an example, the GUI 1100 can be operatively coupled to one or more systems that can assist and/or control one or more drilling operations. For example, consider the aforementioned automation assisted sliding mode system, which provides a desired toolface angle for a mud motor and a drilling distance for the sliding mode. As another example, consider a system that generates rate of penetration values, which may be, for example, rate of penetration set points. Such a system may be an automation assisted system and/or a control system. For example, a system may render a GUI that displays one or more generated rate of penetration values and/or a system may issue one or more commands to one or more pieces of equipment to cause operation thereof at a generated rate of penetration. In the example GUI 1100, an entry 1110 corresponds to a drilling run, drill to depth operation, which specifies a distance (e.g., a total interval to be drilled) along with a time estimate. In such an example, the drill to depth operation can be implemented using agent-based guidance that, for example, provides for a sequence of drilling parameters (e.g., mode, toolface angle, etc.). As an example, a time estimate may be given for the drill to depth operation using manual, automated and/or semi-automated drilling. For example, where a driller enters a sequence of modes, the time estimate may be based on that sequence; whereas, for an automated approach, a sequence can be generated (e.g., an estimated automated sequence, a recommended estimated sequence, etc.) with a corresponding time estimate. In such an approach, a driller may compare the sequences and select one or the other or, for example, generate a hybrid sequence (e.g., part manual and part automated, etc.).

Figure 12:
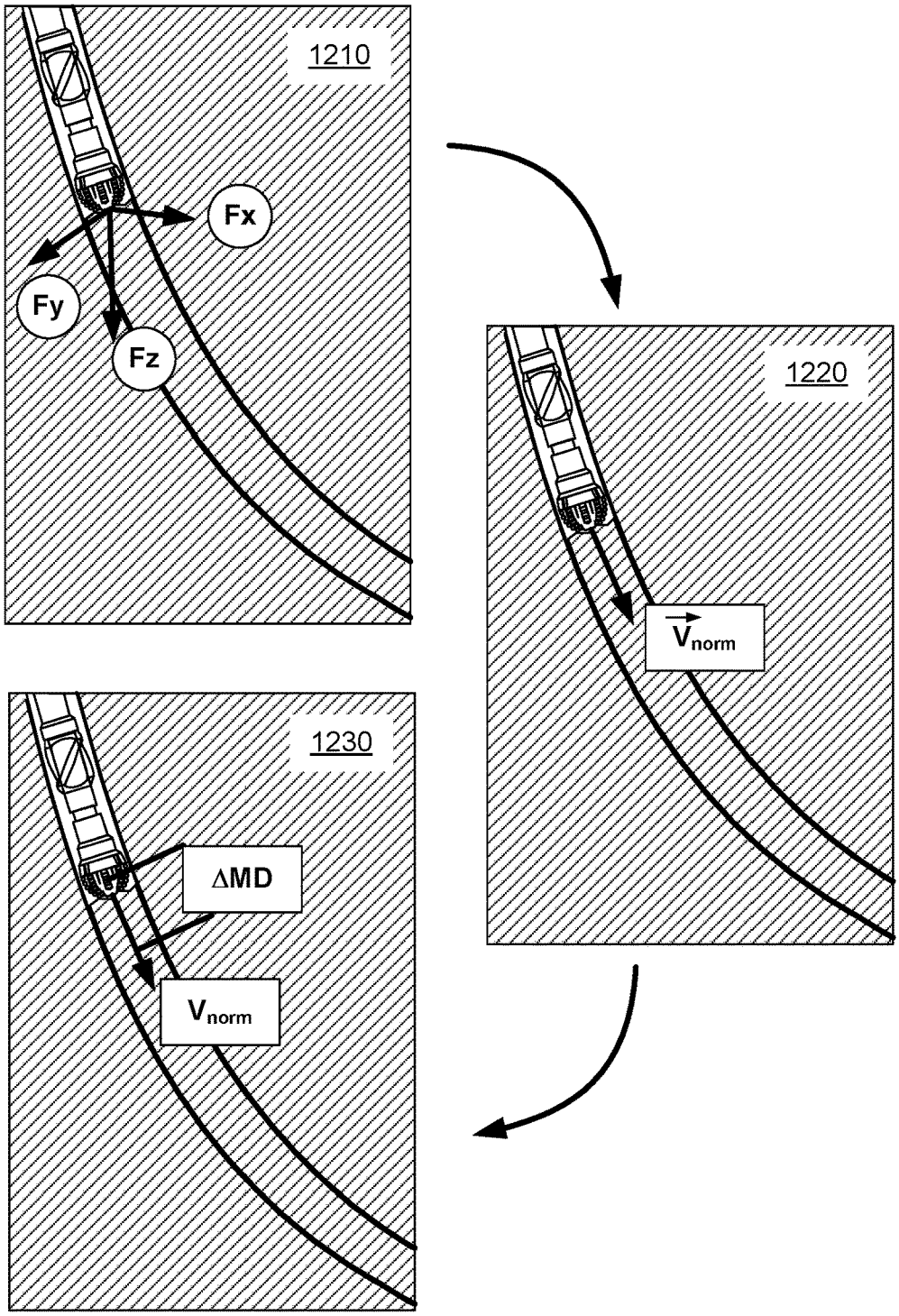
FIG. 12 illustrates an example of a method.

FIG. 12 shows an example of a method 1200 that can output a predicted propagation direction of a drill bit based on forces and bit characteristics. The method 1200 can utilize a computational framework that includes one or more features of a framework such as, for example, the IDEAS framework (Schlumberger Limited, Houston, Texas). The IDEAS framework utilizes the finite element method (FEM) to model various physical phenomena, which can include reaction force at a bit (e.g., using a static, physics-based model). The FEM utilizes a grid or grids that discretize one or more physical domains. Equations such as, for example, continuity equations, are utilized to represent physical phenomena. The IDEAS framework, as with other types of FEM-based approaches, provides for numerical experimentation that approximates real-physical experimentation. In various instances, a framework can be a simulator that performs simulations to generation simulation results that approximate results that have occurred, are occurring or may occur in the real-world. In the context of drilling, such a framework can provide for execution of scenarios that can be part of a workflow or workflows as to planning, control, etc. As to control, a scenario may be based on data acquired by one or more sensors during one or more well construction operations such as, for example, directional drilling. In such an approach, determinations can be made using scenario result(s) that can directly and/or indirectly control one or more aspects of directional drilling. For example, consider control of sliding and/or rotating as modes of performing directional drilling.

In FIG. 12, the method 1200 commences in a force determination block 1210 for determining forces on a bit, which are utilized in a vector determination block 1220 for determining a vector as to how a drill bit of a BHA may be expected to move in a formation during drilling (e.g., according to one or more drilling modes). In the block 1230, a sufficiently small drilling distance (e.g., hole propagation length) is added to the bore along the direction of the vector determined by the drilling directional determination block 1220. The process can be repeated until the specified total drilling distance (e.g., pipe length, stand length, etc.) is completed.

As explained, a mud motor can be a directional drilling tool that can help to deliver a desired directional capability to land a borehole in a production zone. As explained a directional motor can include various features such as, for example, a power unit, a bent sub, etc. To drill a curved hole, the bend can be pointed to a desired orientation while rotation from the surface rig (e.g., table or top drive) may be stopped such that circulation of mud (e.g., drilling fluid) acts to drive the mud motor to rotate the bit downhole. As mentioned, in some instances, there can be a combination of surface rotation and downhole rotation. In general, where surface rotation is not provided, the drillstring is in a sliding mode as it slides downward as drilling ahead occurs via rotation of the bit via operation of the mud motor. Such an operation can be referred to as a sliding operation (e.g., sliding mode). Another mode can be for holding the borehole direction tangent where surface equipment rotates the drillstring such that the motor bend also rotates with drillstring. In such a mode, the BHA does not have a particular drill-ahead direction. Such an operation can be referred to as a rotating operation (e.g., a rotating mode or rotary mode).

As an example, for a bent motor, a "rotating mode" (or rotary mode) can be for surface_RPM>0 and motor_RPM>0 (e.g., flow of drilling fluid driving a mud motor) and, a "sliding mode" can be for surface_RPM=0 and motor_RPM>0.

During a directional drilling planning phase, a well trajectory tends to be designed to ensure better reservoir exposure and less collision risk. A given trajectory in a curved section can include one or more arcs with constant curvatures (DLS) and straight holding sections. For a motor-based directional drilling plan, drilling can be improved if it is known a priori (e.g., or during drilling) when to use a particular mode (e.g., and when to switch modes). Additionally, it is desirable to know if a particular BHA is able to deliver a desired DLS. As explained, a method can include utilizing various types of data to determine what sliding and rotating sequence can be utilized to improve drilling efficiency for a particular BHA (or BHAs) to adhere to designed trajectory. As to BHA capabilities, a method can include performing one or more sliding simulations with given motor BHA specifications to check if a corresponding motor sliding DLS capability is higher than that of a desired DLS. Such a method may be performed prior to performing a method that can determine one or more sequences (e.g., mode sequences) for a BHA where such one or more sequences can help to improve an ability to create a desired or desirable borehole trajectory.

For a given motor BHA design, DLS capability adjustability is limited in the sliding operation. To match motor DLS output with a designed trajectory, an operation sequence mixing sliding and rotating can be utilized. However, switching between rotating and sliding tends to be undesirable as it can be time-consuming (e.g., non-productive time (NPT)). For example, switching operational modes can involve stopping equipment of a rig and reorienting a motor bent toolface angle (TFA). Further, switching can compromise borehole quality, for example, by introducing ledges. Therefore, it can be quite helpful to plan a motor operation sequence in a manner whereby a desired or desirable DLS can be achieved, for example, with high drilling efficiency (e.g., limited or reduced NPT).

As explained, drilling a directional well in the oil and gas industry can help to ensure better reservoir exposure and less wellbore collision risk. In various high-volume drilling markets, mud motors can be utilized for directional drilling. As explained, a mud motor can be capable of delivering a desired well curvature via operations that can include switching between rotating and sliding modes (e.g., rotate mode and slide mode). To follow a predefined well trajectory, drilling operations can aim to determine an optimal operation control sequence of a mud motor or mud motors. In various examples, a method can include training an agent for motor directional drilling using deep reinforcement learning (DRL).

As an example, mud motor-based directional drilling (e.g., downhole motor-based directional drilling) can be framed into a reinforcement learning scheme with an automatic drilling system. As an example, a trained machine model or trained machine learning model (trained ML model) can be referred to as an agent, which can be trained with respect to interactions with an environment (e.g., formations, wellbore geometry, equipment, etc.), for example, through choices of controls in a sequence.

As an example, an agent can receive information such that it can perceive states (e.g., inclination, MD, TVD at survey points and the planned trajectories, etc.). The information can be from an environment where the agent can utilize the information to decide on a best action such as sliding or rotating. In such an example, the decisions (or choices) made by an agent can be to achieve a maximum in total rewards, which can be appropriately defined to suit one or more drilling operations. As an example, a loop can exist where the environment is affected by the agent's actions and where a reward calculator (e.g., reward computational component or components) returns corresponding rewards to the agent. As an example, a reward can be positive (such as drilling to target) or negative (such as offset distance to the planned trajectory, cost of drilling and action switching).

To train an agent, a drilling simulator can be utilized that simulates drilling in a multi-dimensional spatial environment such as, for example, a 2D and/or a 3D environment of a layered earth model with layer depths and BHA directional responses in layers. As an example, various attributes of a drilling system may be constant and/or varied and handled by a simulator. As an example, for training, a planned trajectory can be provided, which can be part of a goal-based approach where, for example, an end target may be a high priority goal.

As an example, a directional-drilling agent (DD agent) can be trained for hundreds or thousands or more episodes. As an example, an agent can be trained to successfully drill to a target in a simulated environment through making of decisions as to sliding and rotating and/or, for example, toolface angle. As an example, an agent can provide for a system that can implement an automated directional drilling method based on deep reinforcement learning, which makes a sequence of decisions of rotating and sliding actions to follow a planned trajectory.

As explained, a driller can drill a straight hole in a "rotary" mode, while building a curve in a "sliding" mode. To automate the decisions of "rotary" or "sliding" (e.g., and optionally toolface), a reinforcement learning approach can be utilized.

Figure 13:
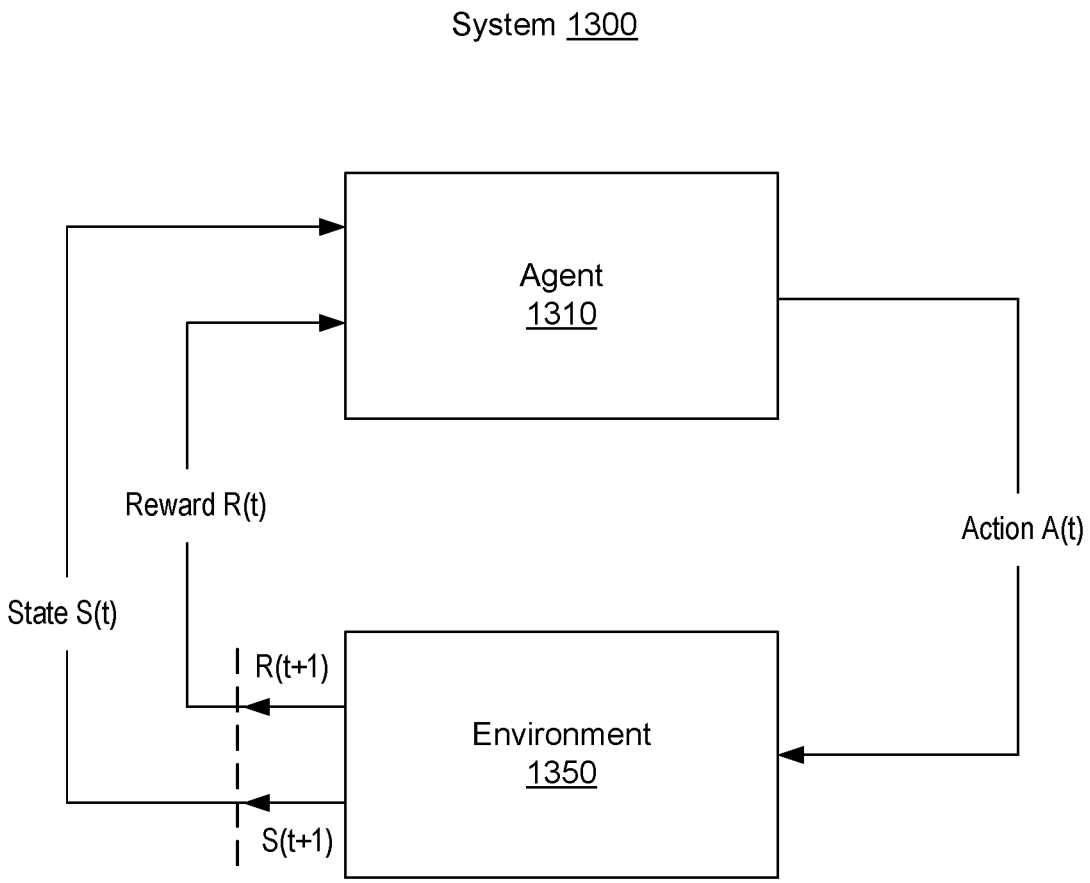
FIG. 13 illustrates an example of a system.

FIG. 13 shows an example of a system 1300 that includes an agent 1310 and an environment 1350 where the agent 1310 interacts with the environment 1350 though action (A), state (S), and reward (R).

For example, the agent 1310 can observe a state from the environment 1350, and make a decision as to one or more actions. An action (or actions) can then be applied to the environment 1350, and the environment 1350 can yield a reward as a feedback to the agent 1310, together with a new state which the agent 1310 observes in a subsequent round (e.g., a next round). The goal of the agent 1310 can be to take actions that maximize the total future rewards. In the drilling decision making, the motor-based directional drilling agent can interact with the environment (e.g., formations, wellbore geometry, and equipment), through choices of controls in a sequence, which may include mode controls, toolface controls and/or other controls. For example, in a 3D environment, toolface angle may be considered and modeled such that an agent can learn to control toolface angle (e.g., output actions as instructions as to toolface angle changes). As another example, consider decisions as to surveys such as checkpoint surveys or check shot surveys. Such surveys can involve time as a factor, which may be a negative in terms of reward (e.g., greater time being more negative); however, a survey can provide an indication of location of a portion of a drillstring, which can help to assess whether or not, and to what degree, a drilled borehole may be complying with a planned trajectory.

As an example, an agent can be trained using rewards where an action can have an associated reward scheme. As mentioned, an action can have positive aspects and/or negative aspects with respect to one or more goals.

As an example, an agent can be trained and/or implemented using one or more safety constrains. For example, a safety constraint can be utilized to help assure that an optimal sequence of control instructions abides by one or more safety constraints and/or does not get implemented without assessment with respect to one or more safety constraints.

As mentioned, a directional drilling agent can be trained in a simulated environment. For example, consider a multi-dimensional earth model with building rates of formation and thickness attributes. In such an example, the agent perceives the states (e.g., inclination, MD, TVD at survey points and the planned trajectories) from the environment, and then decides the best action of sliding or rotating to achieve the maximum total rewards. The environment can be affected by the agent's actions and returns corresponding rewards to the agent through, for example, a hole propagation model, a reward calculator and a definition of completed.

As to a hole propagation model, which can implement at least some basic drilling mechanisms, it can be a part of the environment component (see, e.g., the environment 1350). For example, a simulator can take each of the commands of "sliding up", "sliding down", and "rotation" from an agent, and proceed with a corresponding simulation using a hole propagation model. In such an example, at each interval, a build rate can be sampled from a rock model. In addition, to train with uncertainty, noise such as a Gaussian noise of approximately 10 percent standard deviation of the build rate may be added in each interval.

As to a reward calculator, it can receive a state from a simulator, and calculate the rewards to feedback to an agent. In such an example, the reward calculator evaluates the reward based on one or more considerations such as, for example, accuracy and operation efficiency. For accuracy, it can take a planned survey as an input, and compare it with actual drilled locations, and return a scalar based on a deviation to the plan. Rewards can be positive (e.g., such as drilling to target) or negative (e.g., such as offset distance to the planned trajectory, cost of drilling and action switching).

As to a definition of "completed" (e.g., done), the completion of drilling can be, for example, "failed" or "successful". A successful one can be defined as reaching a drilling target within a tolerance of inclination and a bounding box (e.g., a predefined bounding box), otherwise, it can be defined as a failed one.

FIG. 14 shows an example of a method 1400 that involves a Q function approach for reinforcement learning using a deep neural network. An article by Mnih et al., Human-level control through deep reinforcement learning, Nature, Vol. 518: pp. 529-533, is incorporated by reference herein.

In the example of FIG. 14, an example of a Q-learning diagram 1410 is shown along with an example of a graph of trials 1430 and an example of a graph with trial results 1450. As an example, a method can include deep Q-learning using a deep Q-learning network (DQN). As to some other types of examples, consider a deep deterministic policy gradient (DDPG) network or a proximal policy optimization (PPO).

As an example, an agent can be trained using reinforcement learning through estimating a Q function using a deep neural network. In such an example, the Q-value can be referred to as an action value, which can be defined as the expected long-term return with discount when taking a given action. Given a policy $\pi$, state s, and action a, the Q value can be estimated as:

$$Q^{\pi}(s,a)=E[r_{t+1}+\gamma r_{t+2}+\gamma^2 r_{t+3}+\ldots \mid s,a],$$

where $\gamma$ is the discount factor or the reward r, and t is the step count.

As an example, t can be an interval count, for example, consider an interval as to a distance such as a measured distance along an axis of a trajectory of a borehole, which can be a planned trajectory.

As to the Q-function, it is a prediction of future reward based on state and action pair. To act optimally with policy $\pi^*$, an action is chosen that yields the highest optimal Q-function ($Q^*$) value among possible actions at the current step t.

$$\pi^*(s) = \underset{a}{\operatorname{argmax}} Q^*(s, a)$$

The $Q^*$ function can be expressed into a Bellman equation in a recurrent form, where s' and a' are the next state and next action:

$$Q^*(s, a) = E[r + \gamma \max_{a'} Q^*(s', a') \mid s, a].$$

The Bellman equation can be solved iteratively, and $Q^*$ can then be estimated through a neural network.

As an example, a neural network for a 2D implementation can include five fully-connected layers with three outputs which map to the actions of "Sliding Up", "Sliding Down", and "Rotating". In such an example, the first two layers have 1024 neurons, the third and fourth layers have 512 neurons, and the last layer has 256 neurons. To train the neural network, a loss function may be defined as the mean-square-error of the predicted $Q^*$ using the Bellman equation. The loss can then minimized by stochastic gradient descent and back propagation. Such an approach generates weights that define the agent and make the agent trained for receiving input and generating output.

In a trial example, training of a directional-drilling agent involved 8000 trials of drilling simulation, or episodes. The drilling trajectories during the training and evaluation processes are shown in the graphs 1430 and 1450. In the graph 1430, horizontal lines are the boundaries of formations in the simulated environment and the lines are plans used in the training process, which are random plans with fixed length of 3000 ft in total.

As to the graph 1450, it shows decision results generated by the agent as evaluated with input for a random drilling plan. In each interval, a small amount of random noise is added to the formation build rate value and the agent is trained to handle such an uncertainty and make appropriate decisions. As in the graph 1430, the horizontal lines are formation layers while thinner lines represent rotating operation and thicker lines represent sliding operation. As demonstrated, the agent succeeded drilling to the target by suitable adherence to the plan in the simulated environment.

As an example, a noise approach can be implemented that utilizes a noisy layer. In such an example, noise can be parameter noise, which may allow for expedited training compared to approaches without parameter noise (e.g., consider comparing parameter noise to action noise). Parameter noise can add adaptive noise to parameters of a neural network policy, rather than to its action space. Action space noise acts to change the likelihoods associated with each action an agent might take from one moment to the next. Parameter space noise injects randomness directly into parameters of an agent, altering the types of decisions it makes such that they depend on what the agent currently senses.

As an example, training can utilize deep reinforcement learning (DRL) and parameter noise. As an example, noise may be introduced via simulation such as via a hole propagation model simulator.

As an example, the type of noise applied to a neural network (e.g., parameter noise) can differ from the type of noise applied to a simulator. For example, parameter space noise can be applied via a noisy layer that can provide for improved exploration of a DRL agent while domain randomization can be a noise that is applied to a simulator that can provide for a more robust agent and that can facilitate transfer from a simulated environment to a real-world environment.

As explained, parameter noise can help algorithms explore their environments more effectively, leading to higher scores and more elegant behaviors. Such an approach can be viewed as adding noise in a deliberate manner to the parameters of a policy, which can make an agent's exploration more consistent across different timesteps; whereas, adding noise to the action space (e.g., epsilon-greedy exploration) tends to lead to more unpredictable exploration which may not be correlated to an agent's parameters.

As demonstrated in FIG. 14, a multi-dimensional automated directional drilling decision agent can provide for making, through deep reinforcement learning (DRL), a sequence of decisions of rotating and sliding actions to follow a planned trajectory, and drill to target.

Figure 19:
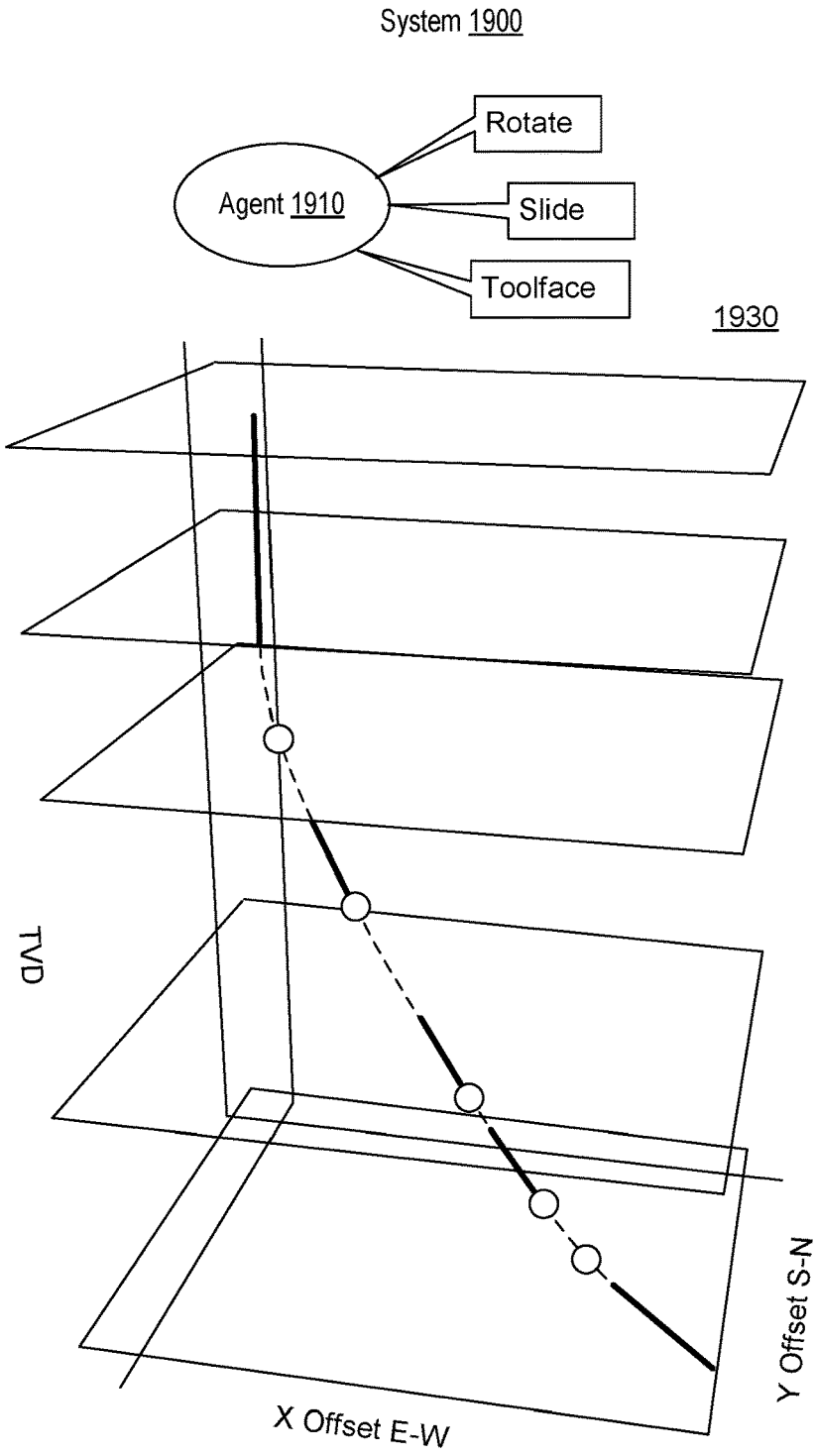
FIG. 19 illustrates an example of a system.

As to a 3D environment with a 3D agent, graphs such as the graphs 1430 and 1450 can be represented in three spatial dimensions (see, e.g., FIG. 19, FIG. 20, etc.).

Figure 15:
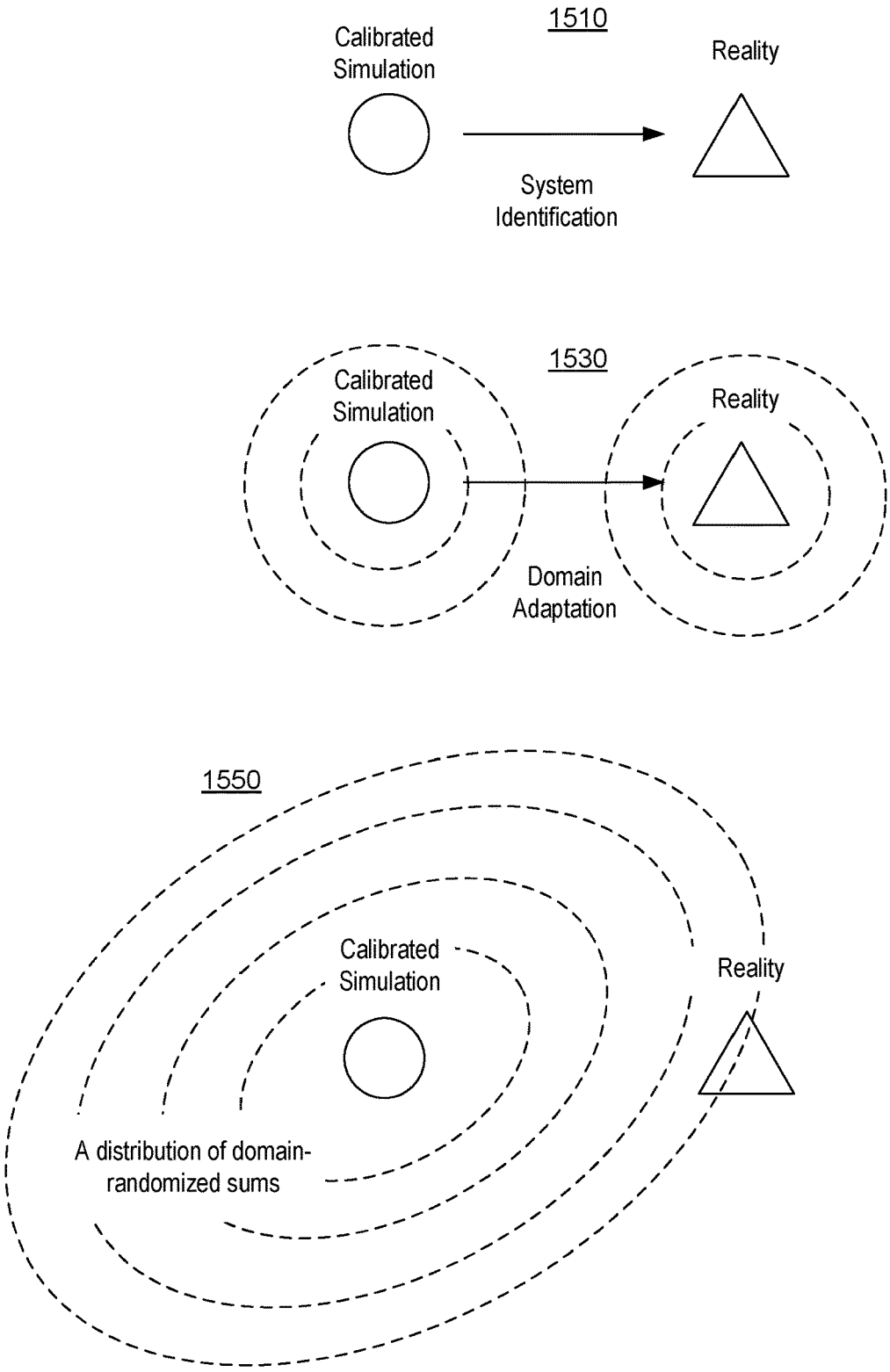
FIG. 15 illustrates examples of approaches to link simulation and reality.

FIG. 15 shows various examples of approaches for handling simulation and reality. For example, in an approach 1510, a calibrated simulation aims to provide for system identification as to reality; in an approach 1530, domain adaptation is utilized to bridge a calibrated simulation with reality; and, in an approach 1550, a distribution of domain-randomized sums is utilized to encapsulate at least a portion of reality.

As an example, domain randomization can be utilized for enhanced simulation. Such an approach can help to assure that a trained model does better in the real-world. For example, a model trained on simulation without some type of probabilistic variations (e.g., randomizations or "noise") may perform well in a "world" that behaves like the simulation but is likely to be suboptimal as to the types of variations that can and do occur in the real-world.

As to types of randomizations, these can be dependent on the types of tasks. For example, for a robot that utilizes machine vision, appearance, scene/object and/or physics randomization may be utilized. As to appearance, aspects such as color, lighting, reflectivity, etc., may be utilized. As to scene/object, aspects such as real and unreal objects may be utilized where training on unreal objects may enhance training as to real objects. As to physics, aspects such as dimensions, masses, friction, damping, actuator gains, joint limits and gravity may be utilized.

As an example, randomization may be for mass and dimensions of objects, mass and dimensions of robot bodies, damping, friction of the joints, gains for a PID controller (e.g., P term), joint limit, action delay, observation noise, etc.

As an example, domain randomization can be implemented in a hole propagation model for simulating hole propagation. Such an approach can act to introduce some amount of noise to a system. As an example, another type of noise can be parameter noise, which may be introduced via a noisy layer. As an example, a system may utilize one or more types of noises (e.g., via domain randomization, via a noisy layer, etc.).

As an example, safety can be a desirable aspect of reinforcement learning when a physical system operates in the real-world, particularly where equipment, humans, formations, the environment, etc., may be damaged. Various techniques may be utilized for purposes of safety. For example, consider a system that integrates temporal logic guided reinforcement learning (RL) with control barrier functions (CBFs) and control Lyapunov functions. Such an approach can be beneficial in sim-to-real transfer whereby real-world control via a trained agent occurs with some assurances as to safety concerns.

Figure 16:
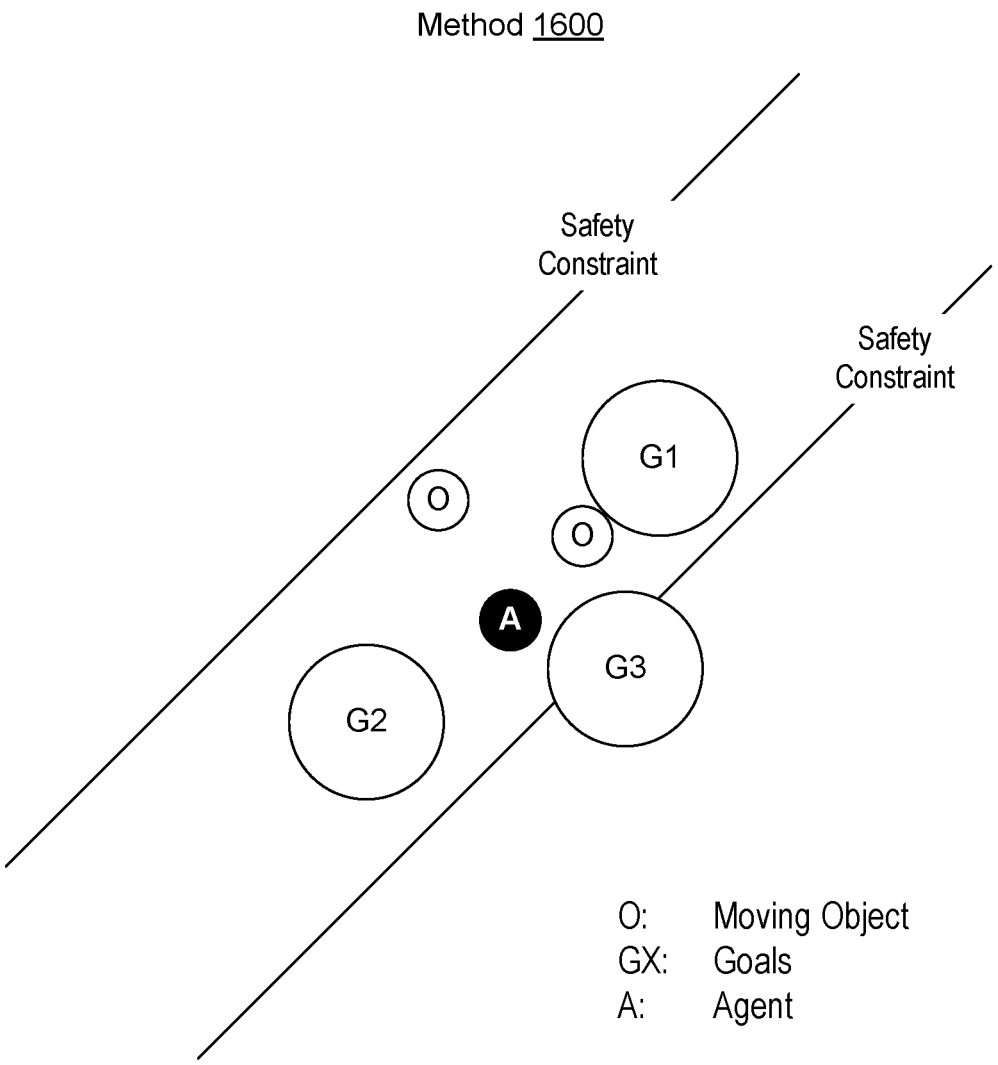
FIG. 16 illustrates an example of a method.

As shown in FIG. 16, a local control system can be configured to verify instructions against its own set of constraints. In particular, FIG. 16 shows an example of a simulation environment that includes an agent with known dynamics, safety constraints in the form of two straight lines forming a channel that the agent has to stay within, three circular goal regions whose positions are kept fixed in an episode but can be randomized between episodes, and two obstacles that move in the vicinity of the channel and whose dynamics are unknown.

In the example of FIG. 16, for a reinforcement learning (RL) component, a learning algorithm can employ proximal policy optimization. For example, a policy can be represented by a feed-forward neural network (NN). As an example, consider a feed-forward NN with 3 hidden layers of 300, 200, 100 ReLU units, respectively. In such an approach, the value function can be of the same architecture type. As to episodes, consider each episode having a horizon T=200 steps and positions of goal regions being randomized between episodes (e.g., goals may initiate outside the safe channel). In such an approach, a process can collect a batch of 5 trajectories for each update iteration. And, during learning, an episode can terminate when the horizon is reached or the task is completed. As an example, depending on CBFs being enabled or not, an agent may (not enabled) or may not (enabled) be allowed to travel outside the safety channel (e.g., safety constraints) and collide with a moving obstacle(s) during learning (e.g., to receive a penalty).

As an example, a minimum distance between an agent and one or more moving obstacles as a function of policy updates can be tracked to show that, as learning progresses, the agent learns to stay away from the moving obstacles. As to actual task oriented behaviors, the agent A in FIG. 16 may start close to and try to move towards G2; however, via learning, the agent A can know that if it keeps trying to get to G2 it will get stuck at the border (safety constraint) and receive a low return. Therefore, near the border (safety constraint) the agent A chooses to instead move towards G1 and eventually finish the task. Depending on training, a RL agent may choose an obstacle free path and try to make a tradeoff between accomplishing the task, avoiding obstacles and minimizing safety violations (e.g., as may be controlled by weights, etc.).

As an example, during an evaluation phase, during evaluation an episode can terminate in a number of circumstances such as, for example, a horizon is reached, a task is accomplished and an RL agent collides with a moving obstacle (e.g., defined by a minimum threshold on relative distance, etc.). As explained, to ensure safety, one or more control barrier functions (CBFs) can be enabled (e.g., turned on). As an example, RL agents trained with CBFs can exhibit higher success rates as, for example, RL agents trained without CBF sometimes rely on traveling outside a safe zone (e.g., safety constraints) to avoid obstacles and get to goals. As an example, an agent may be trained using reinforcement learning with one or more control barrier functions (CBFs).

Figure 17:
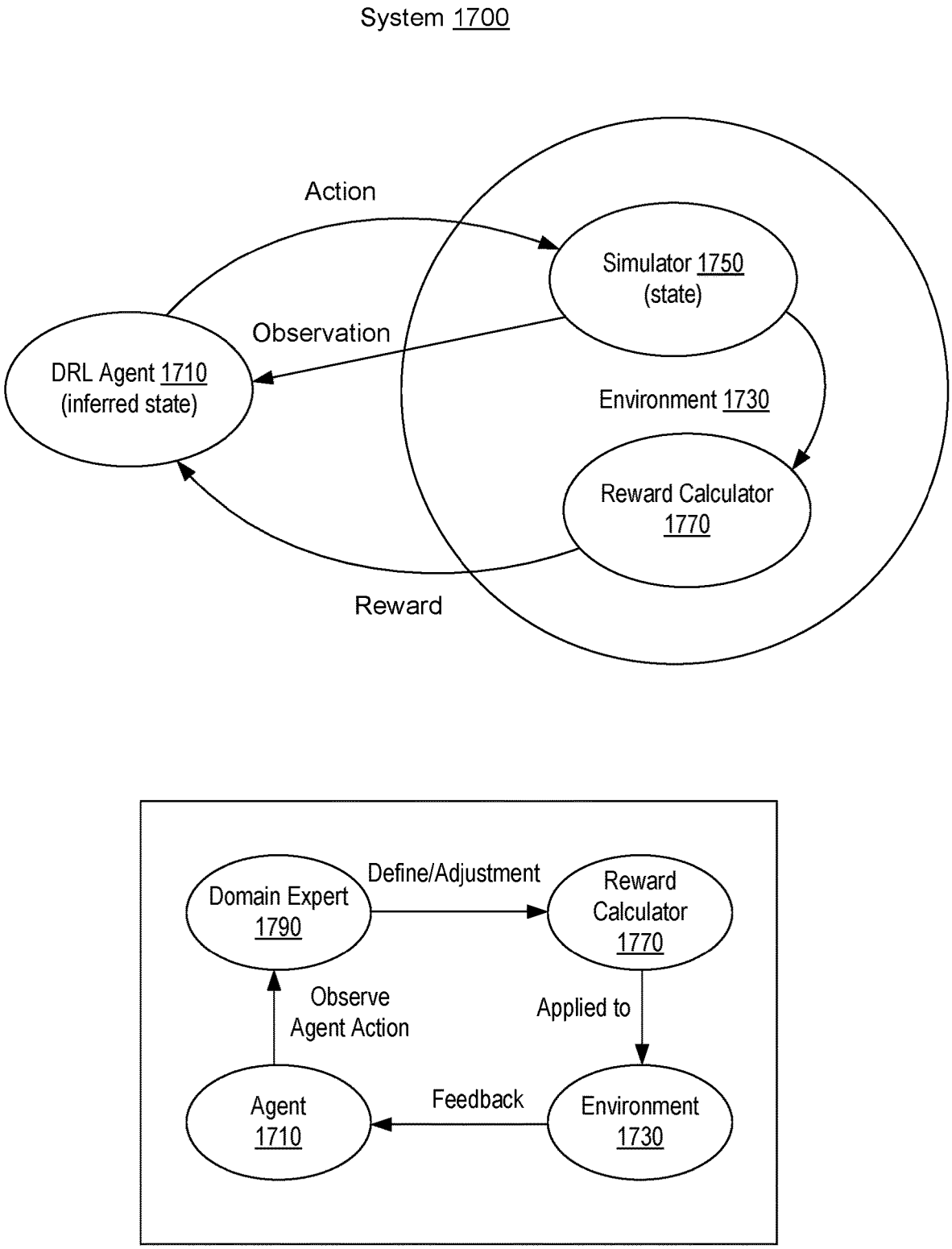
FIG. 17 illustrates an example of a system.

FIG. 17 shows an example of a system 1700 that can be utilized for training an agent such as a deep reinforcement learning agent (DRL agent) 1710 using an environment 1730 that includes a simulator 1750 and a reward calculator 1770. As an example, a trained agent can provide for automated directional drilling in a geologic environment (see, e.g., FIG. 27, FIG. 28, etc.).

As shown in FIG. 17, the agent 1710 issues an action to the simulator 1750 in the environment 1730 where the simulator 1750 provides information to the reward calculator 1770 that can generate a reward that is transmitted to the agent 1710 (e.g., to impact operation of the agent 1710). As shown, the simulator 1750 can provide an observation to the agent 1710, which can provide for assessment of an inferred state. For example, the simulator 1750 can generate a simulated state while the agent 1710, which is outside of the environment 1730, can perceive an inferred state.

FIG. 17 also shows an example of a loop where a domain expert 1790 may be utilized that can make one or more adjustments to and/or one or more definitions for operation of the reward calculator 1770. For example, feedback from the environment 1730 can cause the agent 1710 to issue an action, which can be observed (e.g., assessed, analyzed, etc.) by the domain expert 1790 where, based at least in part on such observation, the reward calculator 1770 may be adjusted, further defined, etc. As shown, the reward calculator 1770 can be applied to the environment 1730, as shown in the system 1700. In such an approach, the agent 1710 can be further trained, honed, etc., using domain expertise (e.g., a domain expert and/or other domain expertise). As an example, domain expertise may be from one or more wells that have been drilled using an agent or not using an agent.

As to an example of an earth model that can be utilized for purposes of simulation, consider the following example specified according to various parameters in Table 1, below.

TABLE 1

| Example Earth Model | | | | | |
|---|---|---|---|---|---|
| Formation Layer Index | Thick-ness (ft) | Dog Leg Severity (DLS) deg/100 ft | Natural Build Rate (deg/100 ft) | Walk Rate (deg/100 ft) | Toolface Offset (TFO, deg) |
| 1 | 600 | 8 | −1.2 | 0.8 | 5 |
| 2 | 1200 | 12 | −0.8 | 0.3 | 15 |
| 3 | 950 | 10.5 | −2.1 | 0.5 | 23 |
| 4 | 2000 | 8.2 | −1.2 | 0.6 | 14 |
| 5 | 1000 | 10.1 | −3.1 | 0.2 | 16 |

As mentioned, a system can utilize a reward calculator such as the reward calculator 1770, which can determine rewards as may be defined with respect to various factors. For example, consider factors such as taking planned survey points, taking actual drilled point locations from a simulator, evaluating done or not done, accuracy to plan, operational efficiency, goal achievement, etc. As an example, a reward can be based on one or more operational parameter such as, for example, sliding ration and survey interval (e.g., reward=(1−|sliding ratio|)*survey_interval*k, where k is a predefine parameter such as 0.5).

As explained, actions can be for sliding (e.g., sliding mode) or rotating (e.g., rotary mode). As to sliding, sliding can include sliding up or sliding down. As explained, one or more actions may be taken as to toolface such as setting a toolface angle.

As an example, an agent can be trained through use of a drilling simulator that operates in a simulated multi-dimensional geologic environment as may be defined via an earth model (e.g., a 2D earth model, a 3D earth model, etc.). Such an earth model can be a layered earth model with layer depths and BHA directional responses in layers. An agent can be trained with respect to a trajectory, which may be a planned trajectory. Training may utilize one or more of known plans, random plans, etc.

As to actions output by an agent, consider an approach that provides for actions with respect to stands, which can include, for example, one or more of the following, which are listed with stand numbering:

Stand#1-2, HD: 0.0-180.0, ROTATING
Stand#3-90ft, HD:180.0-270.0, SET TOOLFACE:−150 deg, Sliding Ratio (slide->rotate):1.0
Stand#4-90ft, HD:270.0-360.0, SET TOOLFACE:−150 deg, Sliding Ratio (slide->rotate):1.0
Stand#5-90ft, HD:360.0-451.0, ROTATING
* * *
Stand#20-90ft, HD:1716.0-1806.0, SET TOOLFACE:−15 deg, Sliding Ratio (slide->rotate):1.0
Stand#21-90ft, HD:1806.0-1896.0, SET TOOLFACE:−135 deg, Sliding Ratio (slide->rotate):0.2
Stand#22-90ft, HD:1896.0-1986.0, SET TOOLFACE:75 deg, Sliding Ratio (slide->rotate):0.2
Stand#23-90ft, HD:1986.0-2076.0, SET TOOLFACE:15 deg, Sliding Ratio (slide->rotate):0.2
Stand#24-90ft, HD:2076.0-2166.0, SET TOOLFACE:15 deg, Sliding Ratio (slide->rotate):0.2
Stand#25-90ft, HD:2166.0-2256.0, SET TOOLFACE:15 deg, Sliding Ratio (slide->rotate):0.2
* * *
Stand#30-90ft, HD:2616.0-2706.0, SET TOOLFACE:75 deg, Sliding Ratio (slide->rotate):0.2
Stand#31-90ft, HD:2706.0-2796.0, SET TOOLFACE:15 deg, Sliding Ratio (slide->rotate):0.2
Stand#32-90ft, HD:2796.0-2886.0, SET TOOLFACE:−135 deg, Sliding Ratio (slide->rotate):0.2
Stand#33-90ft, HD:2886.0-2976.0, SET TOOLFACE:0 deg, Sliding Ratio (slide->rotate):0.8
Stand#34-90ft, HD:2976.0-3066.0, SET TOOLFACE:180 deg, Sliding Ratio (slide->rotate):0.2
Stand#35-90ft, HD:3066.0-3156.0, SET TOOLFACE:−135 deg, Sliding Ratio (slide->rotate):0.2
* * *
Stand#48-90ft, HD:4236.0-4327.0, ROTATING
Stand#49-90ft, HD:4327.0-4418.0, ROTATING
Stand#50-90ft, HD:4418.0-4508.0, SET TOOLFACE:−135 deg, Sliding Ratio (slide->rotate):0.2
Stand#51-90ft, HD:4508.0-4598.0, SET TOOLFACE:0 deg, Sliding Ratio (slide->rotate):0.8
Stand#52-90ft, HD:4598.0-4688.0, SET TOOLFACE:−135 deg, Sliding Ratio (slide->rotate):0.2
* * *
Stand#70-30ft, HD:6222.0-6252.0, SET TOOLFACE:75 deg, Sliding Ratio (slide->rotate):0.2
Stand#71-30ft, HD:6252.0-6282.0, SET TOOLFACE:75 deg, Sliding Ratio (slide->rotate):0.2
Stand#72-30ft, HD:6282.0-6300.0, SET TOOLFACE:75 deg, Sliding Ratio (slide->rotate):0.2
HD:6300.0, SET TOOLFACE:75 deg, Sliding Ratio (slide->rotate):0.2
Target Location: X:3282.56, Y:0.00, Z:4989.28
Done. Success! , Reward: 18045.251893914232

In the foregoing examples, drilling is completed upon reaching the target location (e.g., X:3282.56, Y:0.00, Z:4989.28) where the agent that provides the actions has operated in a manner that maximizes total rewards (e.g., Reward: 18045.251893914232).

Figure 18:
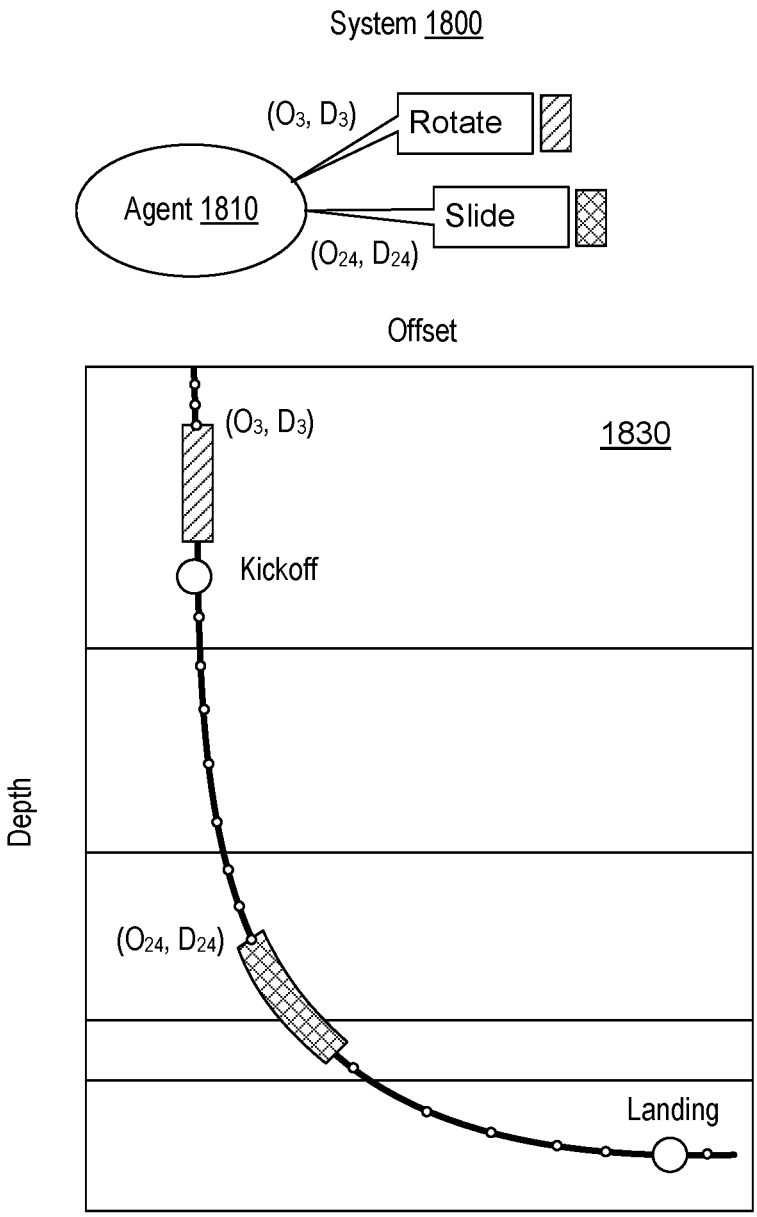
FIG. 18 illustrates an example of a system.

FIG. 18 shows an example of a system 1800 for training an agent 1810 (see, e.g., the agent 1710) in a simulated environment 1830 such as the environment 1730 of FIG. 17. As shown, the simulated environment 1830 is multidimensional and includes a lateral dimension as offset and a depth dimension as depth. The simulated environment 1830 shows a trajectory where drilling can be via rotation (e.g., rotate or rotary) or via sliding (e.g., slide). In the example of FIG. 18, the agent 1810 can issue one or more control instructions that can instruction drilling equipment to operation in a particular mode, which can include a rotate mode and a slide mode (e.g., slide up or slide down). In the example, above the kickoff point, the agent 1810 issues an instruction to drill in a rotate mode while at a position below the kickoff point and prior to the landing point, the agent 1810 issues an instruction to drill in a slide mode. As an example, where two modes exist, an instruction can be to transition from one mode to the other (e.g., consider a binary state transition as from 0 to 1 or 1 to 0 where a rotate mode is 0 and a slide mode is 1 or vice versa). As an example, where three modes exist, an instruction can be to transition from one mode to another one of the modes (e.g., consider an instruction such as −1, 0, +1 for slide down, rotary, and slide up).

In the example of FIG. 18, the agent 1810 can be trained using information as to a formation (e.g., various types of materials, lithologies, etc.), a planned trajectory (e.g., or trajectories for multi-lateral wells, etc.), one or more actions (e.g., modes of drilling, etc.), a physical model of drilling (e.g., a drilling simulator, etc.), and one or more types of rewards.

FIG. 19 shows an example of a system 1900 for training an agent 1910 (see, e.g., the agent 1710) in a simulated environment 1930 such as the environment 1730 of FIG. 17. As shown, the environment 1930 can be three-dimensional with dimensions such as total vertical depth (e.g., Z), offset in an E-W direction (e.g., X) and offset in an S-N direction (e.g., Y). In the environment 1930, various surfaces are illustrate that may represent horizons and/or other structural features as may be discerned through various field operations (e.g., drilling, seismic surveys, etc.).

In the example of FIG. 19, the agent 1910 can be trained to issue control instructions as to mode and toolface, which can account for more than two-dimensions in space. For example, the agent 1910 can include three-dimensional capabilities to make one or more decisions (e.g., issue one or more control instructions, etc.) as to one or more operational parameters that can be defined in a three-dimensional space. For example, consider toolface (TF) as being defined in a three-dimensional space. In the example of FIG. 19, the agent 1910 is shown as issuing instructions for drilling operations that include rotate, slide and toolface instructions. As shown, a thick line represents rotate mode, a dashed line represents slide mode and open circles represent toolface changes. As shown, the agent 1910 can be trained to issue various types of instructions for performing drilling using drilling equipment that can include surface equipment and downhole equipment.

FIG. 20 shows examples of graphical user interfaces 2010, 2030 and 2050 as to evaluation of a three-dimensional agent to drill according to a planned trajectory. In the GUIs 2010, 2030 and 2050, a dashed line represents the planned trajectory while solid lines represent evaluations of the agent, which show some amount of deviations with respect to the planned trajectory.

The GUIs 2010, 2030 and 2050 can also present information as to controls. For example, consider highlighting rotate, slide and/or toolface control instructions. As to specific portions, a graphical control can be utilized to render a specific control instruction to a display. For example, consider: Delta_TF_RIGHT_12: Delta clockwise 12 deg, no drill; Delta_TF_LEFT_12: Delta Anti-clockwise 12 deg, no drill; Set_TF (0, 90, 180, 270), etc. As an example, a toolface control may call for continuous settings or, for example, a schedule over an interval.

As to some examples of three-dimensional control instructions, consider the following examples where Example A is without natural tendency and where Example B is with natural tendency.

Example A

Set MTF 90, GTFO
Rotate 500 ft
Slide 200 ft
GTF_Right_12
Slide 200 ft
Rotate 200 ft
GTF_Right_12
Slide 300 ft
Rotate 200 ft
GTF_Left_12
Slide 100 ft
Rotate 200 ft
GTF_Left_12
Slide 150 ft
GTF_Left_12
Slide 100 ft
Rotate 300 ft Example B Set TF 90
Rotate 500 ft
Slide 200 ft
TF_Right
Slide 200 ft
Rotate 200 ft
TF_Right
Slide 300 ft
Rotate 200 ft
TF_Left
Slide 100 ft
Rotate 200 ft
TF_Left
Slide 150 ft
TF_Left
Slide 100 ft
Rotate 300 ft As an example, an agent can be trained using information pertaining to one or more of azimuth, build rate, walk rate, toolface changes, noise, etc. As an example, a model can be a multi-dimensional spatial model that is in two dimensions or three dimensions.

As an example, an agent can operate iteratively, for example, according to intervals, which may be distance along a borehole (e.g., measured distance intervals). For example, consider a 1 ft interval (e.g., approximately a 30 cm interval) where an action compressor is utilized to interpret an action sequence of an interval to one or more actions that can be utilized by drilling equipment (e.g., directional drilling (DD) equipment). As an example, a driller may receive the output of an action compressor where the output is in the form of one or more actions that the driller may take to perform one or more drilling operations.

As an example, a trained neural network (e.g., DD-Net) can be run in a simulator to generate a full sequence of a next interval and then pass that sequence to an action compressor (AC). In such an example, the AC can generate a sequence of actions in a compressed version that can be passed to a directional driller (DD) to execute (e.g., automatically, semi-automatically and/or manually). After execution of one or more of the actions (e.g., as appropriately selected, etc.), a new observation can be made and fed to the trained neural network (e.g., DD-Net, etc.). As an example, consider the following approach to operation of an action compressor (AC: [sliding, rotating, changing TF, sliding, sliding, . . . ] to [Rotating 10 ft, change TF to 30 deg, sliding 20 ft, . . . ]. In such an example, the actions output as a sequence (e.g., sliding, rotating, etc.) can be transformed into a sequence of understandable and distance coordinate actions, which may be suitable for a directional driller. As an example, an action compressor (AC) may output actions that are in code or other types of commands that can be suitable for one or more computerized controllers to act upon (e.g., in an appropriate sequence, etc.).

As to a simulator, as mentioned, a hole propagation model may be utilized, which can be implemented in a multi-dimensional environment (e.g., 2D or 3D). As an example, a simulator can be in the form of a computational framework executable using computational resources, which can be dedicated, distributed (e.g., cloud-based or other), non-distributed, etc.

As to drilling in a formation, various parameters can include depth, dogleg severity (DLS), build rate (e.g., natural tendency), walk rate (e.g., natural tendency), toolface offset (TFO), etc. (see, e.g., Table 1).

As to a reward or rewards, as mentioned, a system can include one or more reward calculators. As an example, a reward can be an accuracy-based reward. For example, consider a trajectory and/or a well plan and a reward or rewards that are based on how accurate drilling proceeds as informed by an agent according to the trajectory and/or the well plan. For example, deviation from the trajectory and/or one or more other aspects of a well plan can result in no reward, a lesser reward, a penalty, etc. As another example, consider one or more of a cost and/or efficiency based reward or rewards. As to a goal achievement approach, consider a reward based on a target that can be a target of a trajectory, which may be a particular point or points in a reservoir of a formation. As explained, upon reaching a target, an agent can accumulate a total number of rewards where the agent acts to maximize that number.

Below, an example of a reward scheme is presented for operational rewards.

Cost:

Slide −3, Rotate: −0.3

Toolface settings: −50 (first), −100 (immediate next)

Transition:

Rotate to Slide: −5

Slide to Rotate: −1

Toolface changes to Rotate: −200

Toolface left/right to Toolface right/left: −200

As indicated, rewards can be for modes and/or transitions from one mode to another mode and/or for toolface settings and/or transitions in toolface settings. Such rewards can be based on physical parameters germane to operation of equipment to drill. For example, a particular mode can be more taxing on equipment than another mode and transitions from one mode to another mode may be taxing on equipment and pose some increased operational risks (e.g., to equipment, borehole, formation, humans, etc.).

As an example, rewards can be based on one or more measurements. For example, consider the following reward scheme:

Tortuosity

Distance to plan

Distance reward (−): At bit point

Closer reward (−0.1): If the bit is getting away to plan

Drilling reward (+)

Staged 1000-2000 ft, dist2plan<10: +7

2000-2500 ft, dist2plan<20: +10

2500-finish, dist2plan<30: +20

Final bonus: 10000

As an example, a method can include using a measurement reward weight scheduling such as, for example:

reward= measure_reward*measure_reward_weight

+op_reward*(1−measure_reward_weight)

+drilling_reward

As an example, a reward scheme can include various parts such as, for example, a measure reward, an operation reward and a drilling reward. As explained, various weights may be utilized to tailor a reward scheme. In the forgoing example, a measure_reward_weight is utilized where the operation reward is weighted by the equation 1-measure_reward_weight and where the drilling reward is not explicitly weighted. As explained with respect to FIG. 17, a reward scheme can be adjustable such that an agent acts in a desirable manner as it aims to maximize total rewards for a series of actions to drill a borehole in an environment.

FIG. 21 shows various examples of graphical user interfaces 2110, 2130 and 2150 that can plot rewards as determined during training. The GUI 2110 shows an accuracy reward, the GUI 2130 shows an operational reward and the GUI 2150 shows a total reward. In the GUIs 2110, 2130 and 2150, various types of statistical analyses may be performed on reward data, for example, to understand how one or more definitions, adjustments, etc., may be refined. For example, a portion of reward data can be selected and rendered to a display with respect to a plot such as the plot of the GUI 2010, which can provide zoom functionality. In such an approach, a trajectory can be viewed in combination with reward data as to how an agent is behaving. As the plot of the GUI 2010 can include data corresponding to an environment, an analysis may determine that one or more environmental parameters may be giving rise to certain actions and corresponding rewards. In such an example, a reward calculator may be adjusted, redefined, etc., to account for the behavior, for example, in a manner that may depend on lithology, dogleg severity, type of equipment, etc.

As an example, an agent (e.g., DRL agent, etc.) can issue an action according to an interval, which may be fixed. In the example of FIG. 18, various small open circles are shown with respect to the trajectory, which may be, for example, intervals, which may optionally be adjusted by a driller, a planner, etc. As an example, one or more types of markers may be utilized (e.g., triggers) that can be for purposes of agent-based control of one or more aspects of drilling operations (e.g., agent action, survey action, tripping action, etc.).

As an example, an agent may be updated as to a state according to a length or distance. For example, consider an update that corresponds to a length of pipe, which may be a single pipe or multiple pipes (e.g., a stand). As an example, an update as to state can be on a 10 meter basis (e.g., 30 ft), a 30 meter basis (e.g., 90 ft), etc.

As an example, an agent can make an inference as to a state where the agent has been trained to learn and predict a current state. As explained, such an inference can be based on data acquired at a rigsite where such data can be considered observable data. Observable data or observables may be insufficient to characterize a state with specificity sufficient to make a decision as to an action to be recommended or taken. As explained, a trained agent can through inference characterize a state such that the trained agent can make a decision as to an action to be recommended or taken. As explained, a trained agent can aim to maximize rewards that accumulate over a series of action where each of the actions, when taken, affect an environment, which, in turn, can be characterized at least in part via observables (e.g., data acquired via one or more sensors, etc.).

As explained, directional drilling can be performed using an agent that can optimize a sequence of actions (e.g., sliding up, sliding down, rotating actions, etc.) such that the directional drilling can desirably follow a plan trajectory. In such an example, drilling may be via one or more of a steerable motor, via a rotary steerable system, or another directional drilling technique.

FIG. 22 shows an example of a system 2200 that includes various graphical user interfaces (GUIs) 2201, 2202 and 2203. As shown, the GUI 2201 can include a geographic map with various labeled regions such as basins, plays, and prospective plays. In such an example, a graphic control can be utilized to select a region and, for example, a rig or rigsite in the region. As shown, a graphical control is utilized to render another graphical control with information and menu items such as trajectory file, digital well plan, and other. As an example, upon receipt of a command responsive to input (e.g., a mouse click, a hover, a touch, a stylus position, a voice command, etc.), the system 2200 can access a database that includes information as to various agents where such the system 2200 can select one or more agents, optionally ranking them, for use with a project such as, for example, a particular Marcellus rig at a rigsite in the Marcellus basin. In such an example, the system 2200 can tailor the selection or selections using data about the rig, the play, drillstring equipment, etc.

In the example of FIG. 22, the GUI 2202 shows various directional drilling (DD) agents along with some indicia as to capabilities such as, for example, rotate/slide modes, toolface, custom, etc. Upon receipt of an instruction responsive to selection of one of the DD agents, the GUI 2203 may be rendered to a display, where various details about the selected DD agent can be seen. For example, consider details about activity (e.g., where an instance of the agent may be currently in use), personal (e.g., how trained, when trained, trained for what conditions, etc.), experience (e.g., past use, whether simulated and/or real), expertise (e.g., types of equipment, types of formations, types of dogleg severities, etc.), and professional (e.g., associated resources that may be available through one or more service providers, etc.).

As shown, such a system can facilitate decision making, planning, drilling, etc., in one or more regions. After selection of an agent, or agents, equipment at a rigsite can be operatively coupled to computational resources for execution of the agent or agents. In such an example, the agent or agents may generate control instructions suitable for automated, semi-automated and/or manual control of one or more drilling operations (e.g., consider a rotate instruction, a slide instruction, a toolface instruction, etc.). As an example, consider the system 470 of FIG. 4 being operatively coupled to one or more agents for purposes of drilling a borehole at least in part according to a planned trajectory of a digital well plan.

Figure 23:
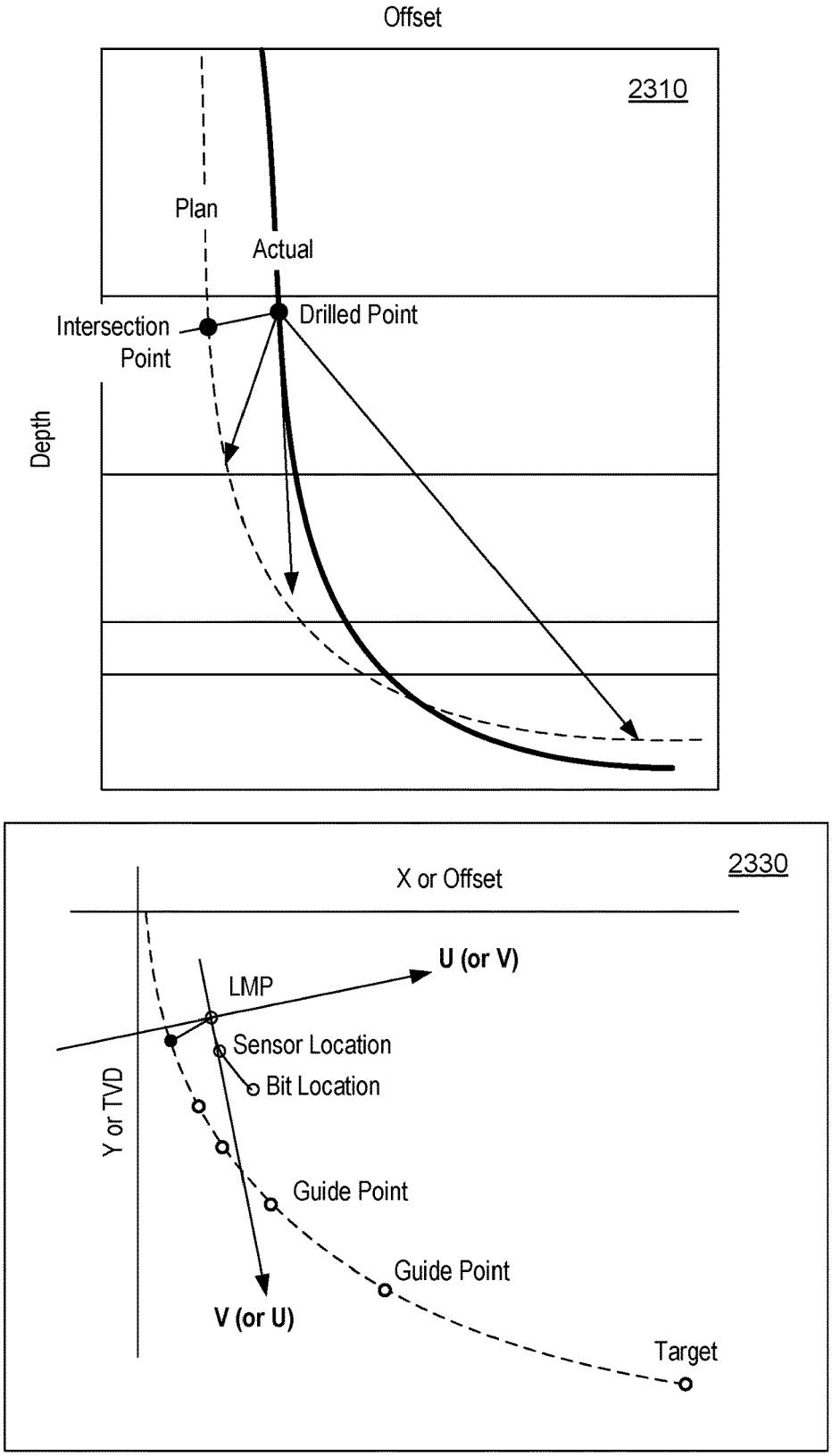
FIG. 23 illustrates an example of a method.

FIG. 23 shows an example of a method that includes a coordinate transformation with respect to an example of an environment 2310 and an example of a transformation 2330 of the environment 2310 where a planned trajectory is shown and another trajectory is shown that represents at least some amount of an actually drilled borehole. As shown, there are some deviations from the planned trajectory where an actual drilled point can be compared to a planned point where the planned point may be an intersection point. In the transformation 2330, U, V coordinates are shown, where V represents an axial direction (e.g., axial direction of a bit) and where U is orthogonal to V; noting that the coordinates U and V may be represented as V and U, for example, where U is the axial direction (e.g., axial direction of a bit).

As to the environment 2310, as mentioned, it can involve a layered earth model, which can specify build rate of formation p and thickness (ft). As shown, the planned trajectory can be specified by points (e.g., multi-dimensional points such as x, y, z points). An environment and/or a planned trajectory can be specified, for example, planned survey points, and inclination, MD, TVD at survey points.

As explained, motor-based directional drilling can be instituted via a reinforcement learning framework with an automatic drilling system (e.g., including an agent) that interacts with an environment (e.g., earth, well, equipment, etc.) through choices of controls in a sequence, etc. The agent can perceive states (e.g., inclination, MD, TVD at survey points and the planned trajectories) from the environment, and then decides the best action, for example, to slide or to rotate to achieve the maximum total rewards. As explained, the environment is affected by the agent's actions, and returns corresponding rewards to the agent. The rewards can be positive (such as drilling to target) or negative (such as off distance to the planned trajectory, cost of drilling and action switching).

As explained, there can be a reward definition or definitions. A reward calculator may determine one or more reward values at each interval. For example, at each measurement point, get the intersection point (e.g., project the actual drilling point onto the planed trajectory), and calculate the distance. The reward value can be less negative with shorter distance. At each interval, there can be a negative reward: sliding (e.g., −3); rotating (e.g., −1). As an example, there can be a reward at occasional points (+/−): each rotating to sliding change, there is a negative reward (−3); each sliding up/down change, there is a negative reward (−3); each sliding to rotating change, there is a negative reward (−1). As an example, there can be future reward(s): taking check shot, there is a negative reward (−10); some position reward when reaching at particular points (+10). As an example, there can be a reward at end of drilling. For example, consider a positive reward is given based on MD projected on intersect point drilled; for a successful "done", a bonus is given; a reward for smoothness (e.g., borehole condition, etc.); at each measurement, a tortuosity based reward; a future reward as to ROP at each interval; etc.

As an example, a reward calculator may be utilized to implement one or more constraints. For example, consider one or more of a minimum slide length, a maximum allowed deviation from a planned trajectory, a maximum DLS per survey interval, a maximum number of slides per length of pipe and/or stand, etc.

As mentioned, an agent may issue an action on a fixed interval (e.g., each step, pipe, stand, etc.). As an example, an agent may be updated as to state information at a fixed length interval (e.g., 30 meters, etc.). As an example, an agent can via inference learn and predict a current state.

As to an agent state definition, consider the following example that may be applied in a 2D representation of a geologic environment:

a. Inferred:
   i. MD of last measurement
   ii. Hole Bottom Position (TVD, NS)
   iii. Hole Bottom Inclination
b. From Observables:
   i. Hole depth: each step (e.g., interval)
   ii. Measured depth: at measurement point
   iii. Position at MD (TVD, NS): at measurement point
   iv. Inclination at MD: at measurement point
   v. Whether current step at measurement point
c. Planned Trajectory Intersect Point at MD and at bottom:
   i. MD
   ii. Inclination
   iii. Position
   iv. Guiding points along the trajectory (x, y, incl.): Several intervals ahead, such as 10, 100, 200, 300, 500, 1000, 1500 ft ahead
   v. History:
      1. Inclinations (previous N measurements)
      2. Actions taken
d. Agent Coordinate Transformation
   i. Coordinate is transformed from original offset/TVD to U, V coordinates, which are relative to the agent location of the last measured point (LMP) (see, e.g., the plot 2330 of FIG. 23).

As to transformed sensor state elements, consider the following approach with reference to the plot 2330 of FIG. 23:

a. Inclination at last measure point (LMP)
b. At_measure: a flag to show if current location is at LMP
c. Distance of bit to LMP (HD-MD)
d. Target location (x, y, inclination) converted to U, V coordinates
e. Distance to target
f. Intercept point (relative to LMP) projected to U, V coordinates including inclination
g. Guide points from plan projected to U, V coordinates including inclinations
h. Previous actions (e.g., 4 shots×30 ft) in history
i. Previous inclinations in U, V coordinates (e.g., 4×30) in history As explained, actions can include one or more of sliding up, sliding down, rotating, toolface orientation, taking measurement (e.g., default measurement is updated each survey interval), etc.

As to a definition of "completed" (e.g., "done"), failed can be more than the maximum allowed deviation from the planned trajectory; can include defining a boundary plane (e.g., by the target point and tolerance) where if the drilling passes the plane, it is deemed to have failed; can involve more than a maximum allowed MD (e.g., twice of the planned trajectory MD); and/or can involve drilling to the target within a boundary box, where inclination is out of tolerance range. As to a definition of success, consider reaching a drilling target within the tolerance of inclination, position (e.g., x, y, and z), etc.

As an example, training can involve preliminary training of an agent with various random environments and plans; saving the trained agent network parameters; from offset wells, deriving a target environment as a prior; lightly training with the specific target environment (e.g., formations in a selected basin and specific plans) from the saved network parameters with a modified reward profile; adjusting the target environment (e.g., as may be learnt from other models), and repeating the training using the adjusted target environment.

Referring again to FIG. 23, in such an example, a planned trajectory intersection point at a measured depth and at bottom may be taken into account. For example, consider an approach that defines current parameters as follows:

Measured depth (MD)
Inclination (from last measurement)
Azimuth
Position: x, y, z (from last measurement)
Distance to last measurement
Flags of survey, toolface (TF) measurement
Interception point location As to future parameters, consider, for example, future guiding points along a trajectory (e.g., x, y, z, including azimuth):

Near: from 4 ft to 100 ft each 4 ft
Far: from 200 ft to 1500 ft each 100 ft

As to past parameters, consider, for example:

Inclinations of previous N measurements (e.g., size: 8)
Last actions taken in previous N measurements (e.g., size: 8*30)

In the foregoing examples as to current, future and past, there can be a total of approximately 536 state dimensions. Such dimensions can be part of a neural network architecture where a trained neural network can receive inputs and output an action from a group of actions as to one or more drilling operations.

As to another example, consider the following definitions for planned trajectory intersection point at MD and at bottom.

Current: MD; inclination (from last measurement); position: x, y (from last measurement); distance to last measurement.
Future: Guiding points along the trajectory (x, y, inclination): Near: from 4 ft to 100 ft each 4 ft; and Far: from 200 ft to 1500 ft each 100 ft.
Past: Inclinations of previous 8 measurements (size: 8); Last actions took in previous 8 measurements (size: 8*30).
Plan points: X, Y.

Such an approach provides for a total of 372 state dimensions. As demonstrated, a number of state dimensions can depend on definitions as to various current, future and past aspects of an agent state.

As an example, a neural network architecture may be selected to include a number of channels where the number of channels can be determined at least in part via a number of dimensions such as state dimensions. As an example, one or more types of transforms may facilitate handling of spatial dimensions in relationship to state dimensions.

As an example, a transform can make an agent more robust to various plans (e.g., random plans, dynamic plans, etc.), which can be in contrast to an approach that utilizes an original coordinate system of an entire fixed plan (e.g., a fixed plan in an x, y coordinate system, an x, y and z coordinate system, etc.). For example, a transform can make the "view" of an agent relative where, for example, a last measured point (LMP) can be a "new" origin for an agent.

Training of an agent through use of a coordinate transform can help train the agent in a relative space such that the agent can handle changes to a plan. Such a relative space (e.g., transformed space) can be part of an agent's state (e.g., an agent state defined in a U and V or a U, V and W space).

Referring again to FIG. 23, a coordinate transform can facilitate training of an agent and/or use of an agent (e.g., which may make the agent more robust to various plans, etc.). As shown in FIG. 23, coordinates can include U and V (e.g., a 2D agent) or, for example, U, V and W (e.g., 3D agent). As an example, a last measured point (LMP) can provide via one or more sensors an inclination, which can be utilized for setting a direction of an axial axis, which can be a tangent line of a curved portion of a borehole.

Figure 24:
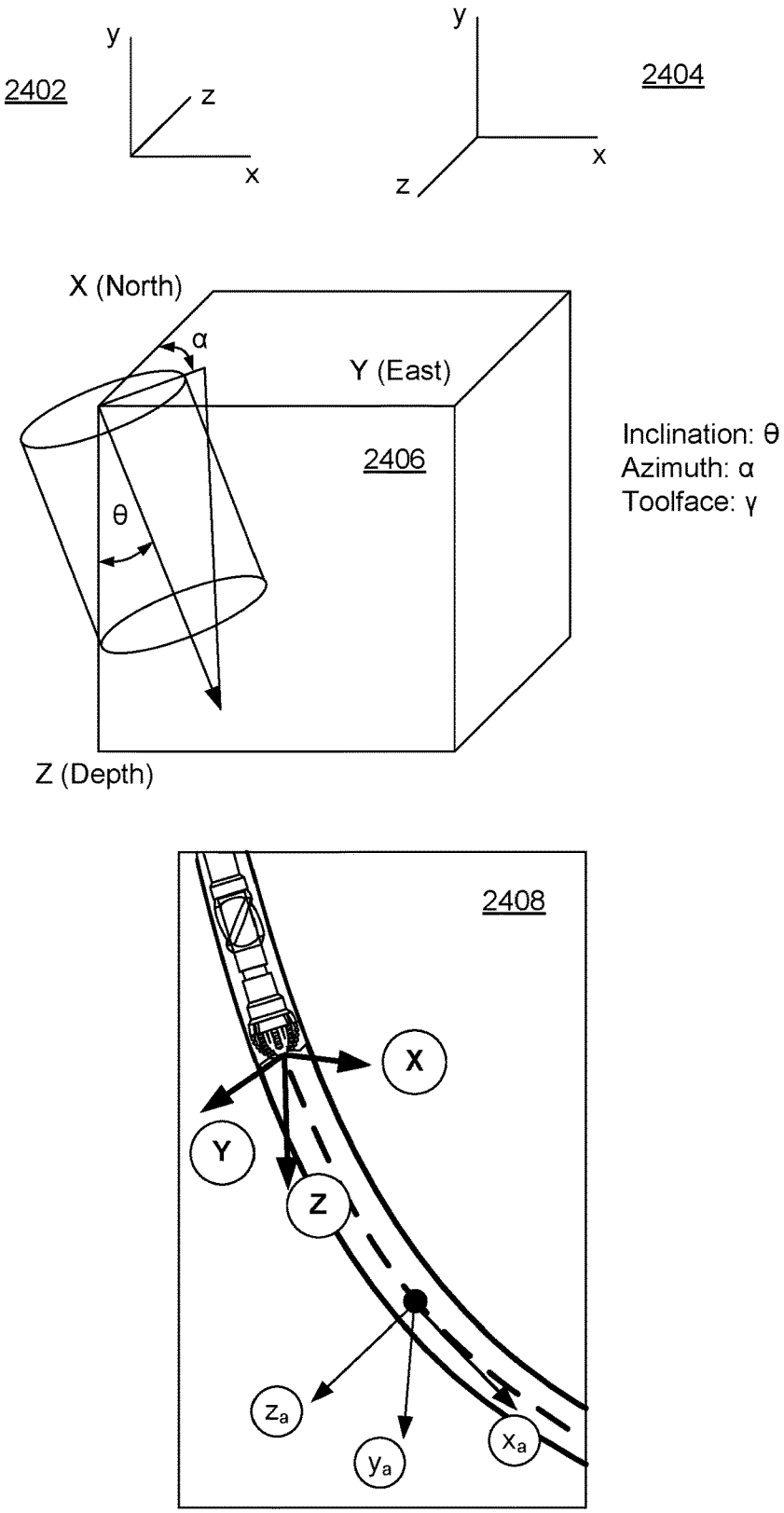
FIG. 24 illustrates examples of coordinate systems.

FIG. 24 shows various examples of coordinate system in space, which include a right hand Cartesian coordinate system 2402 with x, y, and z; a left hand Cartesian coordinate system 2404 with x, y, and z; a hybrid cylindrical and Cartesian coordinate system 2406 with X (North), Y (East), and Z (Depth) along with inclination θ (theta), azimuth α (alpha) and toolface angle γ (gamma), and coordinate systems 2408 of a computational framework with X (North and "i"), Y (East and "j"), and Z (Earth's core and "k") and $x_a$ (tangent to well axis), $y_a$ (to right side and looking downwardly) and $z_a$ (lower side).

Inclination can be expressed in degrees, defined as a deviation from vertical, which can be irrespective of compass direction. Inclination may be measured using one or more types of sensors. For example, consider one or more of a pendulum mechanism, an accelerometer, a gyroscope, etc. As to azimuth, it can be expressed in degrees, defined as a compass direction of a directional survey or of a wellbore as planned or measured by a directional survey. As an example, azimuth can be specified in degrees with respect to the geographic or magnetic north pole. As to toolface, it can be an angle measured in a plane perpendicular to a drillstring axis that is between a reference direction on the drillstring and a fixed reference. For near-vertical wells, as an example, North can be a fixed reference and the angle can be a magnetic toolface. For more-deviated wells (e.g., directionally drilled wells), as an example, the top of a borehole can be a fixed reference and the angle can be the gravity toolface, or high side toolface.

FIG. 25 shows various examples of coordinate details, including a toolface representation 2510 with definitions of examples of U, V and W coordinates and a toolface representation with alternative definitions of examples of U and V in U, V and W coordinates. In the toolface representations 2510 and 2530, the toolface γ (e.g., toolface angle) is illustrated. As an example, an approach can include performing a well system to global geographical system transformation via a matrix $T_{GLWE}$.

As to examples of equations for representing features in a U, V and W coordinate system, consider the following:

$$\text{Axial } U\text{: } \sin\theta\cos\alpha, \sin\theta\sin\alpha, \cos\theta)$$

$$\text{Lateral } V = W \times U = (-\sin\alpha, \cos\alpha, 0)$$

$$\text{Up } W\text{: } (-\cos\theta\cos\alpha, -\cos\theta\sin\alpha, \sin\theta)$$

As mentioned, axial and lateral may be switched as indicated in the toolface representations 2510 and 2530. As to a well system to global geographical system transformation matrix $T_{GLWE}$, consider the following example equations:

$$\vec{x}_a = l_1\vec{i} + m_1\vec{j} + n_1\vec{k} = \{\sin\theta\cos\alpha, \sin\theta\sin\alpha, \cos\theta\}^T$$

$$\vec{y}_a = l_2\vec{i} + m_2\vec{j} + n_2\vec{k} = \frac{\vec{Z}\times\vec{x}_a}{\left|\vec{Z}\times\vec{x}_a\right|}$$

$$\vec{z}_a = l_3\vec{i} + m_3\vec{j} + n_3\vec{k} = \vec{x}_a \times \vec{y}_a$$

$$[T_{GLWE}] = \begin{bmatrix} l_1 & l_2 & l_3 \\ m_1 & m_2 & m_3 \\ n_1 & n_2 & n_3 \end{bmatrix} = \begin{bmatrix} l_1 & \frac{-m_1}{\sqrt{1-n_1^2}} & \frac{-n_1 l_1}{\sqrt{1-n_1^2}} \\ m_1 & \frac{l_1}{\sqrt{1-n_1^2}} & \frac{-n_1 m_1}{\sqrt{1-n_1^2}} \\ n_1 & 0 & \sqrt{1-n_1^2} \end{bmatrix}$$

As mentioned, a method can include performing one or more coordinate transforms. For example, consider the following:

$$M = \begin{bmatrix} \sin\theta\cos\alpha & \sin\theta\sin\alpha & \cos\theta \\ -\sin\alpha & \cos\alpha & 0 \\ -\cos\theta\cos\alpha & -\cos\theta\sin\alpha & \sin\theta \end{bmatrix}$$

$$P_{U,V,W} = M \times (P_{x,y,z} - C_{x,y,z})$$

In the foregoing equations, C is the origin of the U, V and W coordinates in x, y, z values, such as for a bit position or for a measure point. With reference to the transformation 2330 of FIG. 23, coordinate axes for U and V are illustrated and with reference to the toolface representations 2510 and 2530, coordinate axes for U, V and W are illustrated.

Figure 26:
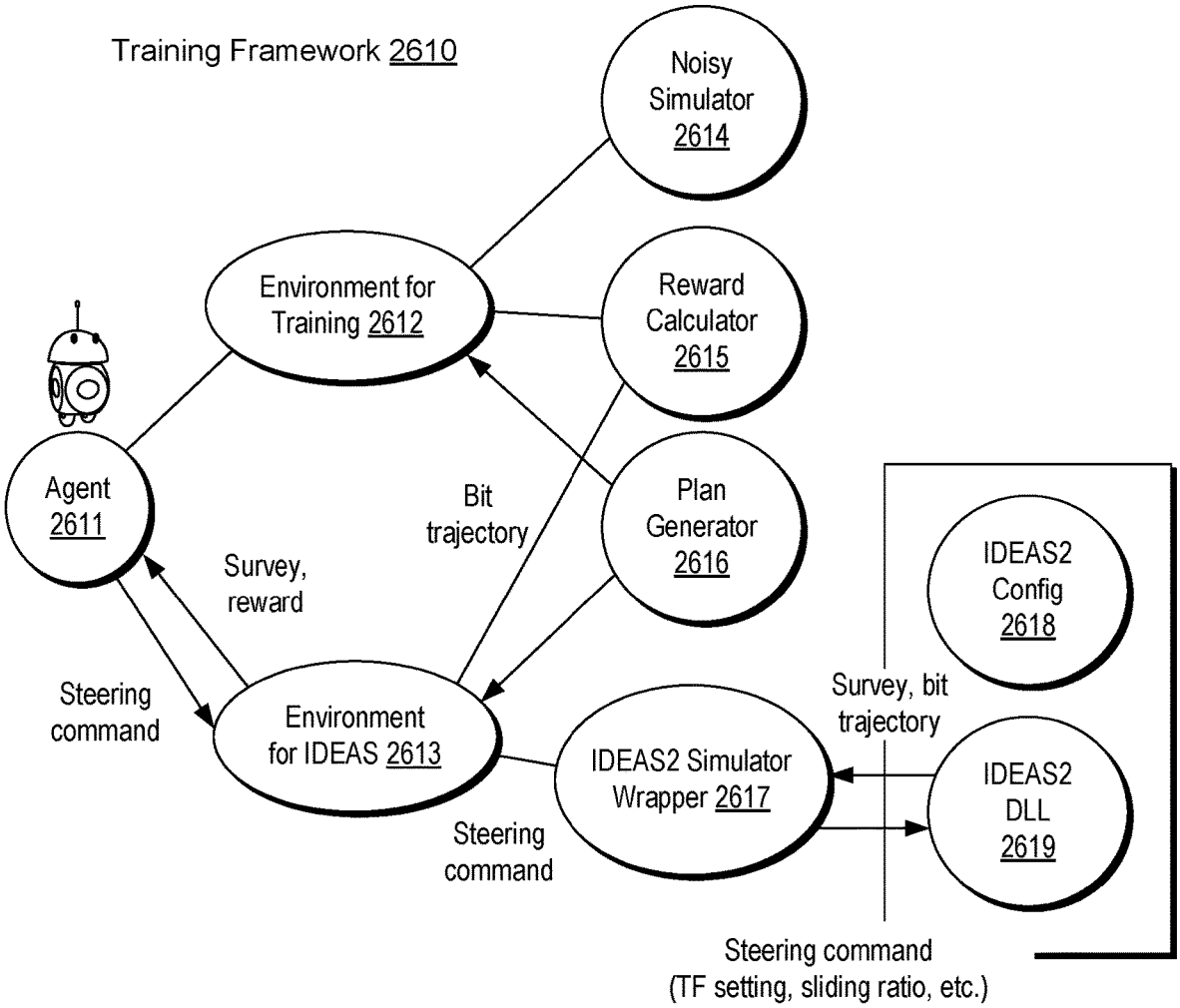
FIG. 26 illustrates an example of a training framework.

FIG. 26 shows an example of a training framework 2610 that can generate one or more trained agents. The training framework 2610 can include an agent 2611, an environment for training 2612, an environment for IDEAS 2613 (e.g., a computational drilling framework), a noisy simulator 2614, a reward calculator 2615, a plan generator 2616, an IDEAS2 simulator wrapper 2617, an IDEAS2 configuration file 2618 and an IDEAS2 DLL (dynamic link library) 2619. As shown, various interactions can occur for generating a trained agent. As an example, a trained agent may be stored in a repository such that it may be selected for a particular job, for example, as explained with respect to the system 2200 of FIG. 22. As an example, as shown in FIG. 22, the GUI 2202 can provide for access to one or more custom agents. In such an example, a training framework may be customized to generate a custom agent. As an example, an approach such as the domain expert approach may be utilized, as explained with respect to FIG. 17, to define, adjust, etc., one or more aspects of a system that can generate a trained agent.

Figure 27:
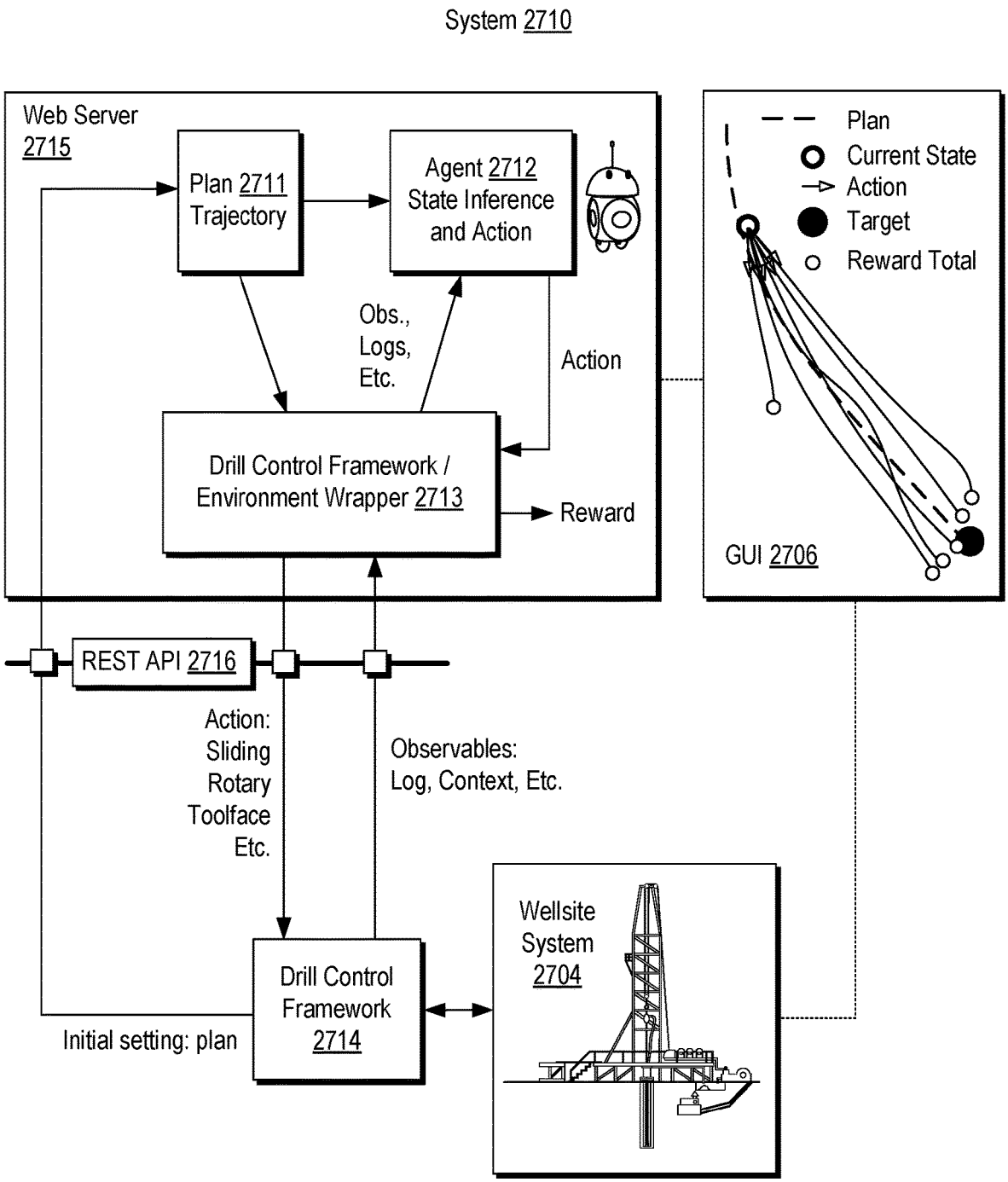
FIG. 27 illustrates an example of a system.

FIG. 27 shows an example of a system 2710 that can include a front-end and a back-end where the front-end can be implemented via a web server 2715 that can utilize API calls (e.g., REST API 2716, etc.) to a computational framework such as a drill control framework 2714 that is operatively coupled to equipment of a wellsite system 2704. The drill control framework 2714 can be, for example, a software product implemented using hardware that can output advisory actions to a driller or drillers. For example, an action output by an agent may be transmitted to the drill control framework 2714 for rendering to a display where a driller can view the display and implement the action, which may be implemented using a manual approach, a semi-automated approach, or an automated approach. For example, a manual approach can involve manual setting of equipment, a semi-automated approach can include interacting with a computerized controller, and an automated approach can include automatic implementation of an action via an automated controller.

As shown, the system 2710 can include a plan component 2711, an agent 2712 (e.g., for state inference and action generation), an environment wrapper 2713 that can transfer information to the framework 2714 (e.g., an action) and that can receive information from the framework 2714 (e.g., observables). As shown, observables and logs can be transferred where observables can include various types of information (e.g., HD, survey location, inclination, azimuth, toolface orientation, etc.). As to logs (e.g., data logs), consider a number of actual toolface settings, sliding ratios, inclinations, azimuths, etc. (e.g., four or more, etc.). As to context, it can include information such as bit location. As an example, the agent 2712 may be trained using a training framework such as the training framework 2610 of FIG. 26. As an example, the agent 2712 may be selectable using one or more GUIs such as one or more of the GUIs of FIG. 22. As explained, rewards can be utilized for training and, as shown in the example of FIG. 27, rewards may optionally be determined for one or more purposes.

FIG. 27 also shows an example of a GUI 2706, which includes a plan trajectory, a current state, actions, a target and reward totals. As explained, rewards can be utilized for training (see, e.g., the reward calculator 2615 of FIG. 26). In the example GUI 2706, reward values may be utilized for one or more other purposes.

In the example of the GUI 2706, various actions are shown with corresponding paths to end points with corresponding reward totals. As an example, in execution (e.g., simulating or real), a method can include projecting trajectories to the future and maximizing: argmax_i P(Action_i|S_t+noise, Agent_j, Simulator_k). Such a process can be utilized for one or more purposes such as, for example, monitoring, risk reduction, etc. As an example, such a process may be utilized for decision monitoring and stabilization of one or more drilling operations.

As an example, during drilling, one or more operations as to an agent may be performed such as, for example, further learning that improves the agent using information acquired during the drilling (e.g., information as to a dogleg severity, etc.). As to another approach, further learning that improves the agent may be performed after reaching the target where the improved agent is utilized for drilling another borehole (e.g., or a lateral from a common borehole, etc.). As an example, where multiple boreholes are drilled from a common pad, an agent may be improved progressively with each of the boreholes such that the last borehole drilled utilized a most improved agent. In such an approach, improvement may be with respect to dogleg severity. For example, a range of dogleg severity used to train a generation X agent may be specified for a formation (e.g., 3 to 7) where upon drilling in the formation, a next generation agent (e.g., X+1) can be trained with a narrower range of dogleg severity (e.g., 5 to 6) for the formation, which can reduce uncertainty (e.g., a more adapted agent). As explained, where uncertainty is greater (e.g., a greater range of dogleg severity, etc.), an agent may take greater actions (e.g., actions that differ from a plan); whereas, with less uncertainty, an agent may take lesser actions (e.g., actions that differ less from a plan). Where accuracy to a plan is a factor, lesser uncertainty can result in greater accuracy to a plan.

As to equipment-related uncertainty, consider acquiring information during drilling of a borehole in a formation with a particular BHA where uncertainty of behavior of the BHA may be utilized to improve an agent, which may be for further drilling of the borehole and/or for drilling a subsequent borehole. As an example, an agent may be general or specific with respect to equipment (e.g., consider a mud motor specific agent, etc.). As an example, where drilling commences with a first mud motor (e.g., to drill a first section of a borehole) and where the mud motor is changed to a second mud motor (e.g., to drill a second section of a borehole), a first agent may be selected for drilling using the first mud motor and a second agent may be selected for drilling using the second mud motor.

As an example, the system 2710 can be operatively coupled to the training framework 2610 such that learning can be performed during drilling, after reaching a target, etc. As explained with respect to FIG. 17, domain expertise may be utilized in a training process.

As an example, a framework can utilize a Representational State Transfer (REST) API, which is of a style that defines a set of constraints to be used for creating web services. Web services that conform to the REST architectural style, termed RESTful web services, provide interoperability between computer systems on the Internet. RESTful web services can allow one or more requesting systems to access and manipulate textual representations of web resources by using a uniform and predefined set of stateless operations. One or more other kinds of web services may be utilized (e.g., such as SOAP web services) that may expose their own sets of operations.

As an example, a computational controller operatively coupled to equipment at a rigsite (e.g., a wellsite, etc.) can utilize one or more APIs to interact with a computational framework that includes an agent or agents. In such an example, one or more calls may be made where, in response, one or more actions are provided (e.g., control actions for drilling). In such an example, a call may be made with various types of data (e.g., observables, etc.) and a response can depend at least in part on such data. For example, observables may be transmitted and utilized by an agent to infer a state where an action is generated based at least in part on the inferred state and where the action can be transmitted and utilized by a controller to control drilling at a rigsite.

Figure 28:
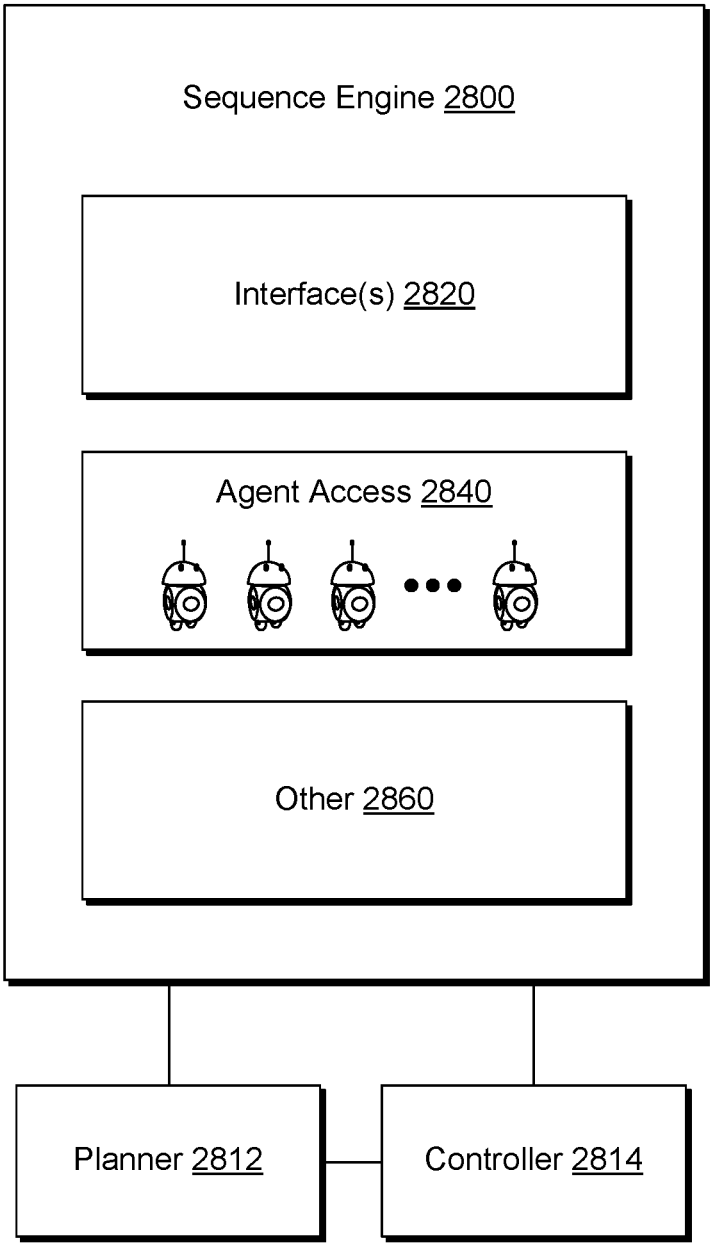
FIG. 28 illustrates an example of a sequence engine.

FIG. 28 shows an example of a sequence engine 2800. As shown, the sequence engine 2800 can include one or more interfaces 2820, an agent access component 2840 and one or more other components 2860. As shown, the sequence engine 2800 can be operatively coupled to a planning component or system 2812 and/or a control component or system 2814 (e.g., a drill control framework, etc.). As an example, the one or more interfaces 2820 can be or include one or more application programming interfaces (APIs) where one or more calls may be made such that the sequence engine 2800 performs some action, which may be for purposes of planning and/or control. As an example, a call may come from one or more of the planning component or system 2812 and the control component or system 2814. As an example, a driller may utilize a computing device to make a call, which may return sequence information as to one or more of a mode or modes (e.g., sliding mode, rotating mode, etc.), toolface, survey point, etc. As an example, a mode may include a combination of surface rotation and mud motor rotation.

Figure 29:
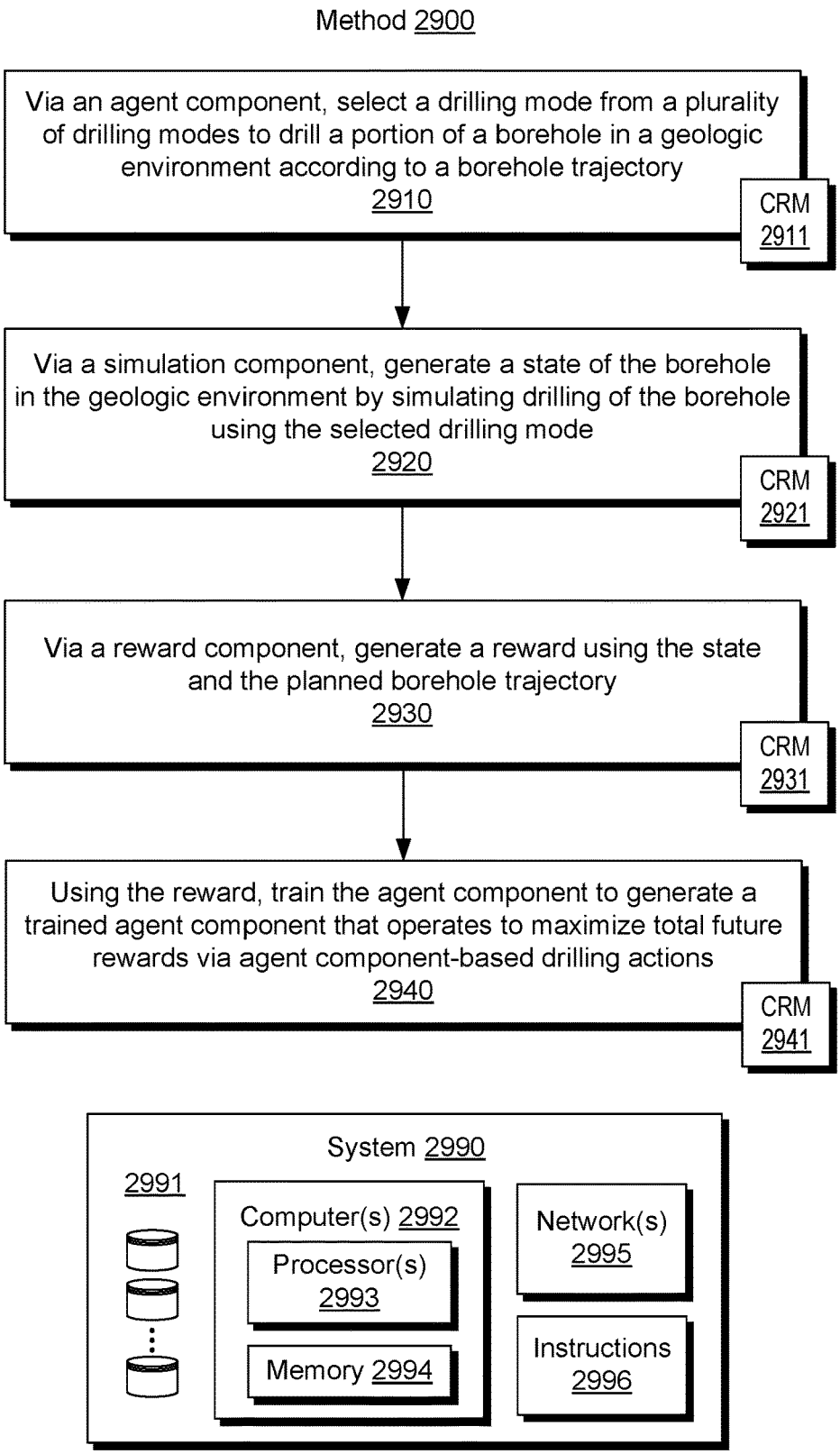
FIG. 29 illustrates an example of a method and an example of a system.

FIG. 29 shows an example of a method 2900 and an example of a system 2990. As shown, the method 2900 includes a selection block 2910 for, via an agent component, selecting a drilling mode from a plurality of drilling modes to drill a portion of a borehole in a geologic environment according to a borehole trajectory; a generation block 2920 for, via a simulation component, generating a state of the borehole in the geologic environment by simulating drilling of the borehole using the selected drilling mode; a generation block 2930 for, via a reward component, generating a reward using the state and the planned borehole trajectory; and, a train block 2940 for, using the reward, training the agent component to generate a trained agent component that operates to maximize total future rewards via agent component-based drilling actions. In such an example, the agent component can be an agent and the trained agent component can be a trained agent.

The method 2900 is shown as including various computer-readable storage medium (CRM) blocks 2911, 2921, 2931 and 2941 that can include processor-executable instructions that can instruct a computing system, which can be a control system, to perform one or more of the actions described with respect to the method 2900.

In the example of FIG. 29, the system 2990 includes one or more information storage devices 2991, one or more computers 2992, one or more networks 2995 and instructions 2996. As to the one or more computers 2992, each computer may include one or more processors (e.g., or processing cores) 2993 and memory 2994 for storing the instructions 2996, for example, executable by at least one of the one or more processors 2993 (see, e.g., the blocks 2911, 2921, 2931 and 2941). As an example, a computer may include one or more network interfaces (e.g., wired or wireless), one or more graphics cards, a display interface (e.g., wired or wireless), etc.

Figure 30:
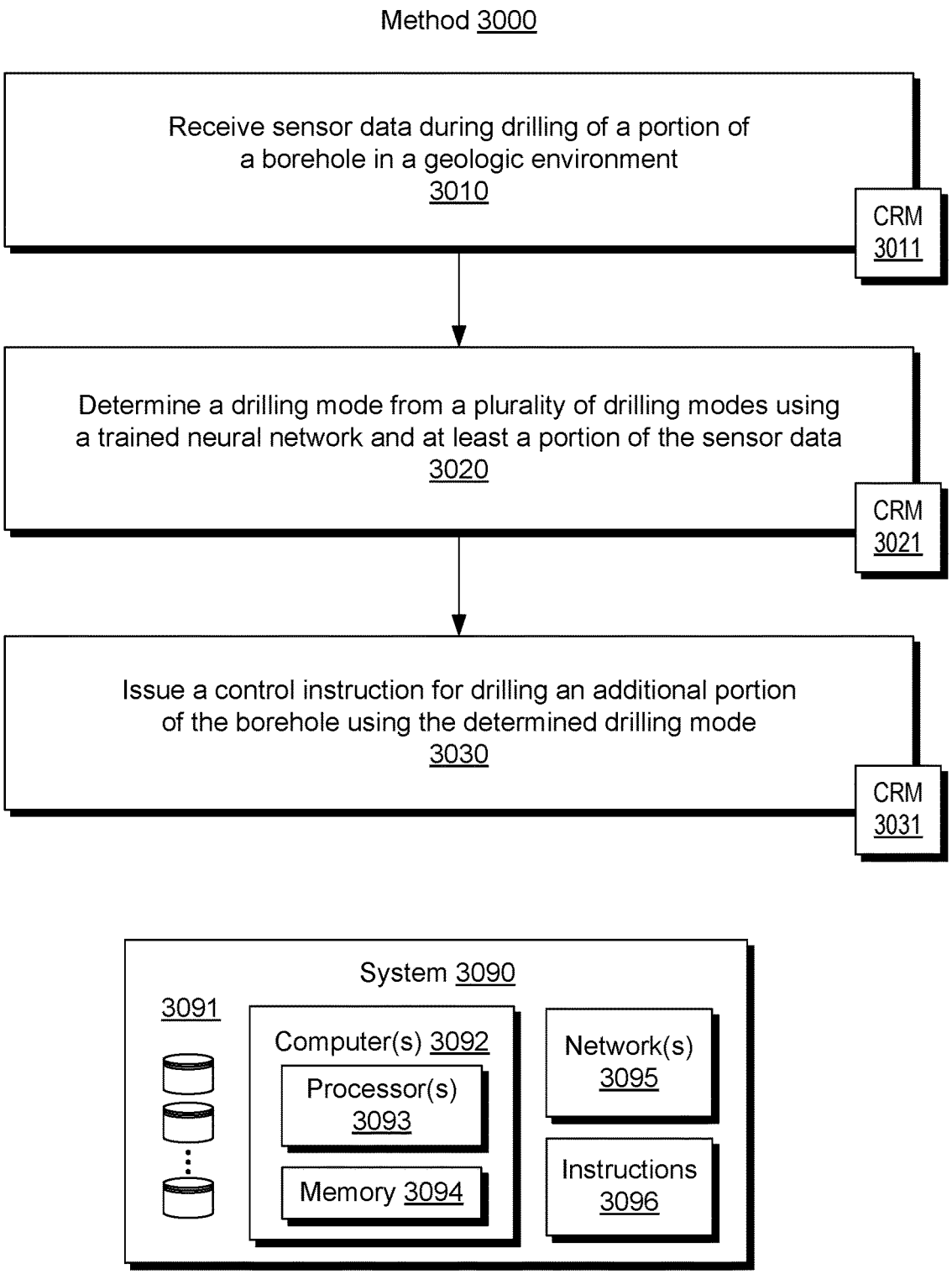
FIG. 30 illustrates an example of a method and an example of a system.

FIG. 30 shows an example of a method 3000 and an example of a system 3090. As shown, the method 3000 includes a reception block 3010 for receiving sensor data during drilling of a portion of a borehole in a geologic environment; a determination block 3020 for determining a drilling mode from a plurality of drilling modes using a trained neural network and at least a portion of the sensor data; and an issuance block 3030 for issuing a control instruction for drilling an additional portion of the borehole using the determined drilling mode.

The method 3000 is shown as including various computer-readable storage medium (CRM) blocks 3011, 3021 and 3031 that can include processor-executable instructions that can instruct a computing system, which can be a control system, to perform one or more of the actions described with respect to the method 3000.

In the example of FIG. 30, the system 3090 includes one or more information storage devices 3091, one or more computers 3092, one or more networks 3095 and instructions 3096. As to the one or more computers 3092, each computer may include one or more processors (e.g., or processing cores) 3093 and memory 3094 for storing the instructions 3096, for example, executable by at least one of the one or more processors 3093 (see, e.g., the blocks 3011, 3021 and 3031). As an example, a computer may include one or more network interfaces (e.g., wired or wireless), one or more graphics cards, a display interface (e.g., wired or wireless), etc.

As an example, the method 2900 and/or the method 3000 may be a workflow that can be implemented using one or more frameworks that may be within a framework environment. As an example, the system 2990 and/or the system 3090 can include local and/or remote resources. For example, consider a browser application executing on a client device as being a local resource with respect to a user of the browser application and a cloud-based computing device as being a remote resources with respect to the user. In such an example, the user may interact with the client device via the browser application where information is transmitted to the cloud-based computing device (or devices) and where information may be received in response and rendered to a display operatively coupled to the client device (e.g., via services, APIs, etc.).

Figure 31:
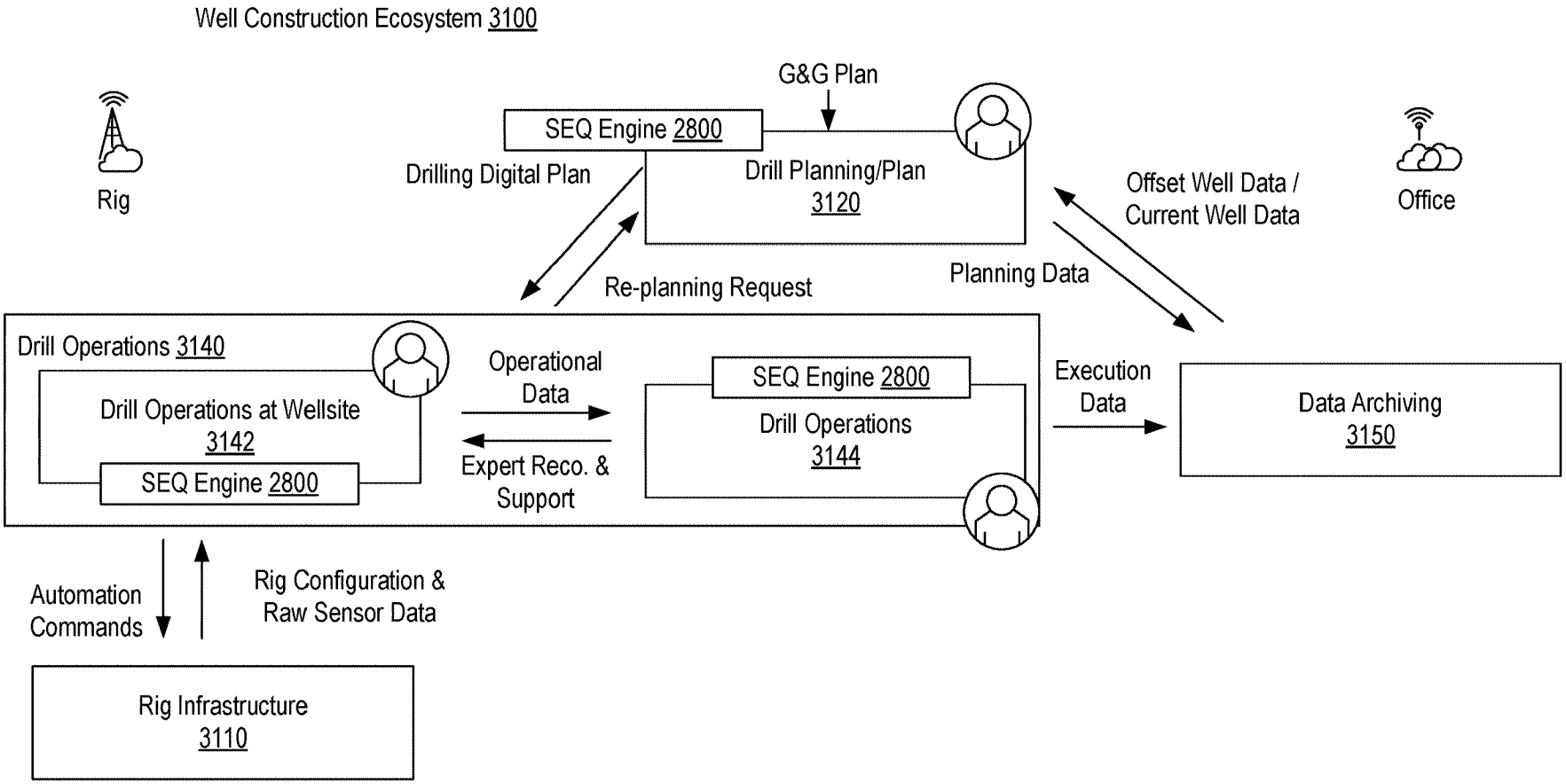
FIG. 31 illustrates an example of a system.

FIG. 31 shows an example of a system 3100 that can be a well construction ecosystem. As shown, the system 3100 can include one or more instances of the sequence engine 2800 (SEQ Engine) and can include a rig infrastructure 3110 and a drill plan component 3120 that can generation or otherwise transmit information associated with a plan to be executed utilizing the rig infrastructure 3110, for example, via a drilling operations layer 3140, which includes a wellsite component 3142 and an offsite component 3144. As shown, data acquired and/or generated by the drilling operations layer 3140 can be transmitted to a data archiving component 3150, which may be utilized, for example, for purposes of planning one or more operations (e.g., per the drilling plan component 3120).

In the example of FIG. 31, the sequence engine 2800 is shown as being implemented with respect to the drill plan component 3120, the wellsite component 3142 and/or the offsite component 3144.

As an example, the sequence engine 2800 can interact with one or more of the components in the system 3100. As shown, the sequence engine 2800 can be utilized in conjunction with the drill plan component 3120. In such an example, data accessed from the data archiving component 3150 may be utilized to assess output of the sequence engine 2800 or, for example, may be utilized as input to the sequence engine 2800. As an example, the data archiving component 3150 can include drilling data for one or more offset wells and/or one or more current wells pertaining to specifications for and/or operations of one or more types of bits, one or more types of mud motors, etc. As an example, data may be utilized in combination with a framework such as, for example, the IDEAS framework.

As shown in FIG. 31, various components of the drilling operations layer 3140 may utilize the sequence engine 2800 and/or a drilling digital plan as output by the drill plan component 3120. During drilling, execution data can be acquired, which may be utilized by the sequence engine 2800, for example, to update one or more sequences. Such execution data can be archived in the data archiving component 3150, which may be archived during one or more drill operations and may be available by the drill plan component 3120, for example, for re-planning, etc.

As an example, the system 3100 may be utilized for purposes of reward definition, reward adjustment, etc. As an example, the system 3100 may be utilized for purposes of one or more safety constraints (e.g., formulation, adjustment, etc., of a safety constraint, etc.).

As an example, a method can include, via an agent component, selecting a drilling mode from a plurality of drilling modes to drill a portion of a borehole in a geologic environment according to a borehole trajectory; via a simulation component, generating a state of the borehole in the geologic environment by simulating drilling of the borehole using the selected drilling mode; via a reward component, generating a reward using the state and the planned borehole trajectory; and, using the reward, training the agent component (e.g., the agent) to generate a trained agent component (e.g., a trained agent) that operates to maximize total future rewards via agent component-based drilling actions (e.g., agent-based drilling actions).

As an example, a trained agent can include an action-value function. As an example, a trained agent component can include a trained value-based network as a trained neural network. As an example, a trained agent component can include weights (e.g., weights of a trained neural network, etc.). In such an example, training can include computing the weights using a loss function. In such an example, training can include computing the weights by optimizing the loss function via a stochastic gradient descent.

As an example, a method can include generating a state of a borehole in a geologic environment by generating a borehole position where, for example, generating a reward includes determining a distance between the borehole position and a position of the planned borehole trajectory.

As an example, a method can include generating a reward by determining if a selected drilling mode corresponds to a switch in drilling modes where, for example, generating the reward includes decreasing the reward for a switch in drilling modes. As an example, generating a reward can include tracking a number of switches in drilling modes where, for example, more switches can cause a decrease in a reward.

As an example, a borehole trajectory can be a planned borehole trajectory or, for example, a borehole trajectory can be a random borehole trajectory.

As an example, a method for training an agent can include transforming coordinates of a portion of a borehole of a geologic environment from a first coordinate system to coordinates of a second coordinate system. As an example, a method for implementing a trained agent for drilling can include transforming coordinates of a portion of a borehole of a geologic environment from a first coordinate system to coordinates of a second coordinate system. In such examples, the second coordinate system can be a relative coordinate system, which may be local to a position such as, for example, a last measured position (LMP), a position of a portion of a drillstring (e.g., a BHA) based on a sensed position, etc.

As explained with respect to FIGS. 23, 24 and 25, a transformation can transform features of an environment from a first coordinate system to a second coordinate system that can be, for example, a 2D coordinate system (e.g., U and V) or a 3D coordinate system (e.g., U, V and W) that can be utilized to define an agent state.

As an example, a sensor or sensors of a drillstring can provide sensor data for an inclination angle (e.g., inclination), which may be utilized to determine (e.g., or define) an axial direction of the drillstring. For example, in FIG. 24, the Cartesian coordinate system 2406 in X (North), Y (East), and Z (depth) is shown with respect to a cylinder that can represent a portion of a drillstring (e.g., an end portion at the bit end) to illustrate an inclination θ (inclination angle) with respect to the depth axis (Z) and an azimuth α (azimuth angle) with respect to the North axis (X). In the example of FIG. 23, the transformed environment 2330 shows U and V along with X (or offset) and Y (or total vertical depth); whereas, in FIG. 25, the transformed example toolface representations 2510 and 2530 show U, V and W. As to depth, it may be aligned with gravity (g) as shown in FIG. 25. As an example, a coordinate transform can act to encode input in a manner suitable for agent training, agent inference, agent action, etc. As an example, a coordinate transform can be a processing operation that processes data (e.g., observables, etc.) for purposes of improved agent training and trained agent implementation.

As an example, a reward calculator can utilize a transformed coordinate system (e.g., U and V or U, V and W) for calculating one or more portions of a reward (e.g., where a reward is a sum of various portions).

As an example, a method can include selecting one of a plurality of drilling modes where the drilling modes can include a sliding mode and a rotary mode. As an example, a plurality of drilling modes can include a sliding up mode and a sliding down mode.

As an example, a method can include generating a state of a borehole in a geologic environment using a multi-dimensional model, which may be a two-dimensional model of the geologic environment or a three-dimensional model of the geologic environment.

As an example, a method can include, via an agent component, selecting a survey interval from a plurality of survey intervals to perform a downhole survey. For example, consider a method that includes generating a reward by using a selected survey interval. In such an example, generating the reward can include decreasing the reward based on a distance of the selected survey interval. As mentioned, more frequent surveys may result in improved data as to location but at a cost of time.

As an example, a trained agent can be trained to, based on received input, output at least one of a drilling mode, a toolface orientation and a survey interval.

As an example, a method can include introducing noise in at least one of a hole propagation model simulator (e.g., using a domain randomization technique) and a network layer (e.g., using a noisy layer technique).

As an example, a trained agent component can operate using inferred conditions and observable conditions. For example, inferred conditions can include measured depth of a last measurement, bottom hole position, bottom hole inclination and motor yield. As an example, observable conditions can include at least one of a hole depth (HD), a measured depth (MD) at a measurement point, a position at a measurement point, an inclination at a measurement point, an azimuth, a magnetic toolface, and a gravity toolface.

As an example, a system can include a processor; memory accessible to the processor; processor-executable instructions stored in the memory and executable by the processor to instruct the system to: via an agent component, select a drilling mode from a plurality of drilling modes to drill a portion of a borehole in a geologic environment according to a borehole trajectory; via a simulation component, generate a state of the borehole in the geologic environment by simulating drilling of the borehole using the selected drilling mode; via a reward component, generate a reward using the state and the planned borehole trajectory; and, using the reward, train the agent component to generate a trained agent component that operates to maximize total future rewards via agent-based drilling actions.

As an example, one or more computer-readable storage media can include computer-executable instructions executable to instruct a computing system to: via an agent component, select a drilling mode from a plurality of drilling modes to drill a portion of a borehole in a geologic environment according to a borehole trajectory; via a simulation component, generate a state of the borehole in the geologic environment by simulating drilling of the borehole using the selected drilling mode; via a reward component, generate a reward using the state and the planned borehole trajectory; and, using the reward, train the agent component to generate a trained agent component that operates to maximize total future rewards via agent-based drilling actions.

As an example, a method can include receiving sensor data during drilling of a portion of a borehole in a geologic environment; determining a drilling mode from a plurality of drilling modes using a trained neural network and at least a portion of the sensor data; and issuing a control instruction for drilling an additional portion of the borehole using the determined drilling mode. In such an example, the plurality of drilling modes can include a rotary drilling mode and a sliding drilling mode. As an example, a plurality of drilling modes can include a sliding up drilling mode and a sliding down drilling mode.

As an example, a method can include determining a toolface orientation from a plurality of toolface orientations using a trained neural network and at least a portion of sensor data. As to a toolface orientation, it can be a toolface angle (see, e.g., the angle gamma γ). As an example, a method can include issuing a control instruction where the control instruction includes an instruction for using the determined toolface orientation.

As an example, a method can include determining a tool survey interval from a plurality of tool survey intervals using a trained neural network and at least a portion of sensor data. In such an example, the method can include issuing a control instruction where the control instruction includes an instruction for using the determined tool survey interval (e.g., by performing a downhole tool survey, etc.).

As an example, a method can include issuing a control instruction for drilling an additional portion of a borehole where the additional portion corresponds to drilling a length of pipe. Such a method can include drilling the additional portion of the borehole (e.g., drilling a portion for a pipe, a stand, etc.).

As an example, a method can include issuing an application programming interface call using at least a portion of the sensor data and receiving a determined drilling mode in response to the application programming interface call where the determined drilling mode is determined using a trained neural network. In such an example, a computer at a rigsite can issue the API call via a network interface to a network interface for remote computing resources, which can provide for execution of instructions that implement the trained neural network (e.g., according to weights, etc.). In such an example, the API call can include data sufficient for the trained neural network to infer a state and determine an action, which can be a drilling mode. As mentioned, an agent may operate with respect to a coordinate system, which may be defined in part using sensor data such as data indicative of an inclination of a portion of a drillstring (e.g., a BHA, a bit, etc.) in a borehole in a formation. In such an example, an API call can include an inclination where the inclination is utilized to orient a coordinate system for an agent where a determined action may be reference with respect to that coordinate system.

As an example, a method can include determining a drilling mode at least in part by defining a coordinate system for a portion of a drillstring using at least a portion of sensor data. In such an example, the sensor data can include an inclination of the portion of the drillstring where the coordinate system includes an axial direction defined using the inclination.

As an example, a coordinate system can be a two-dimensional coordinate system where a plurality of drilling modes can include a sliding up drilling mode, a sliding down drilling mode and a rotary drilling mode.

As an example, a coordinate system can be a three-dimensional coordinate system where a plurality of drilling modes can include a sliding drilling mode and a rotary drilling mode and where a method can include determining a toolface orientation (e.g., using a trained neural network and at least a portion of sensor data).

As an example, a method can include receiving sensor data during drilling of a portion of a borehole in a geologic environment by performing a survey using sensors of a drillstring that is utilized to perform the drilling where the sensors acquire the sensor data. In such an example, the method can further include determining a survey interval using the trained neural network and at least a portion of the sensor data and performing a subsequent survey according to the determined survey interval using the sensors of the drillstring.

As an example, a method can include determining a survey interval using a trained neural network and at least a portion of sensor data and performing a survey according to the determined survey interval using sensors of a drillstring that is utilized to perform drilling.

As an example, a method can include receiving a planned trajectory for a borehole where the method includes determining a drilling mode based at least in part on the planned trajectory. As an example, a planned trajectory can include a curved portion and a target where decisions can be made as to drilling modes to drill a borehole that is at least in part curved to reach the target (e.g., within a specified distance, etc.).

As an example, a controller can include an agent component that selects a drilling mode using sensor data. In such an example, the drilling mode can be selected from a plurality of drilling modes, which may include one or more of a sliding mode (e.g., sliding up, sliding down, etc.), a rotary mode, a survey interval, etc.

As an example, a system can include a processor; memory accessible to the processor; processor-executable instructions stored in the memory and executable by the processor to instruct the system to: receive sensor data during drilling of a portion of a borehole in a geologic environment; determine a drilling mode from a plurality of drilling modes using a trained neural network and at least a portion of the sensor data; and issue a control instruction for drilling an additional portion of the borehole using the determined drilling mode.

As an example, one or more computer-readable storage media can include computer-executable instructions executable to instruct a computing system to: receive sensor data during drilling of a portion of a borehole in a geologic environment; determine a drilling mode from a plurality of drilling modes using a trained neural network and at least a portion of the sensor data; and, issue a control instruction for drilling an additional portion of the borehole using the determined drilling mode.

As an example, a method may be implemented in part using computer-readable media (CRM), for example, as a module, a block, etc. that include information such as instructions suitable for execution by one or more processors (or processor cores) to instruct a computing device or system to perform one or more actions. As an example, a single medium may be configured with instructions to allow for, at least in part, performance of various actions of a method. As an example, a computer-readable medium (CRM) may be a computer-readable storage medium (e.g., a non-transitory medium) that is not a carrier wave.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 32:
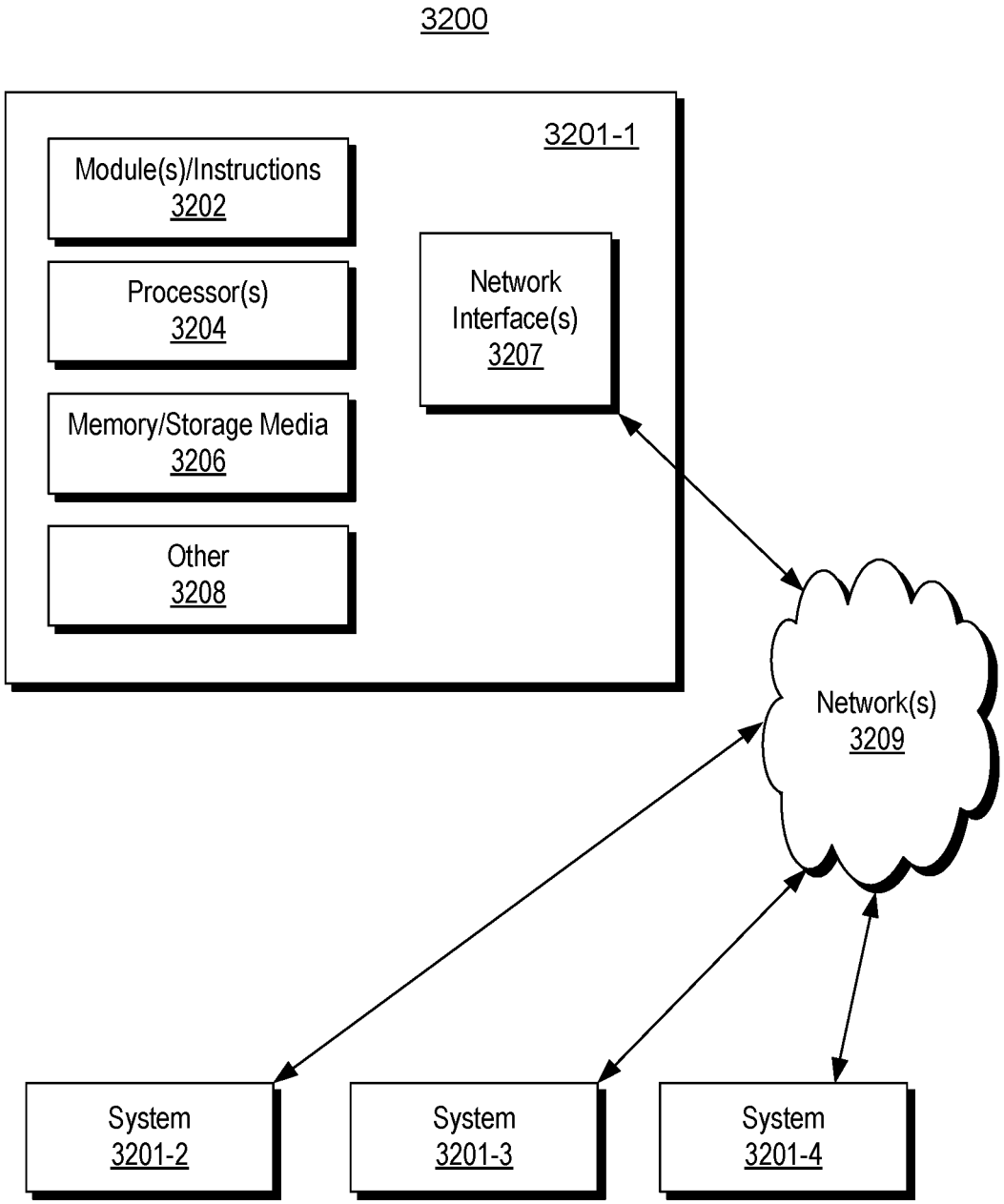
FIG. 32 illustrates an example of a computing system.

In some embodiments, a method or methods may be executed by a computing system. FIG. 32 shows an example of a system 3200 that can include one or more computing systems 3201-1, 3201-2, 3201-3 and 3201-4, which may be operatively coupled via one or more networks 3209, which may include wired and/or wireless networks.

As an example, a system can include an individual computer system or an arrangement of distributed computer systems. In the example of FIG. 32, the computer system 3201-1 can include one or more modules 3202, which may be or include processor-executable instructions, for example, executable to perform various tasks (e.g., receiving information, requesting information, processing information, simulation, outputting information, etc.).

As an example, a module may be executed independently, or in coordination with, one or more processors 3204, which is (or are) operatively coupled to one or more storage media 3206 (e.g., via wire, wirelessly, etc.). As an example, one or more of the one or more processors 3204 can be operatively coupled to at least one of one or more network interface 3207. In such an example, the computer system 3201-1 can transmit and/or receive information, for example, via the one or more networks 3209 (e.g., consider one or more of the Internet, a private network, a cellular network, a satellite network, etc.).

As an example, the computer system 3201-1 may receive from and/or transmit information to one or more other devices, which may be or include, for example, one or more of the computer systems 3201-2, etc. A device may be located in a physical location that differs from that of the computer system 3201-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 3206 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general purpose processors or application specific chips (e.g., or chipsets), such as ASICs, FPGAs, PLDs, or other appropriate devices.

Figure 33:
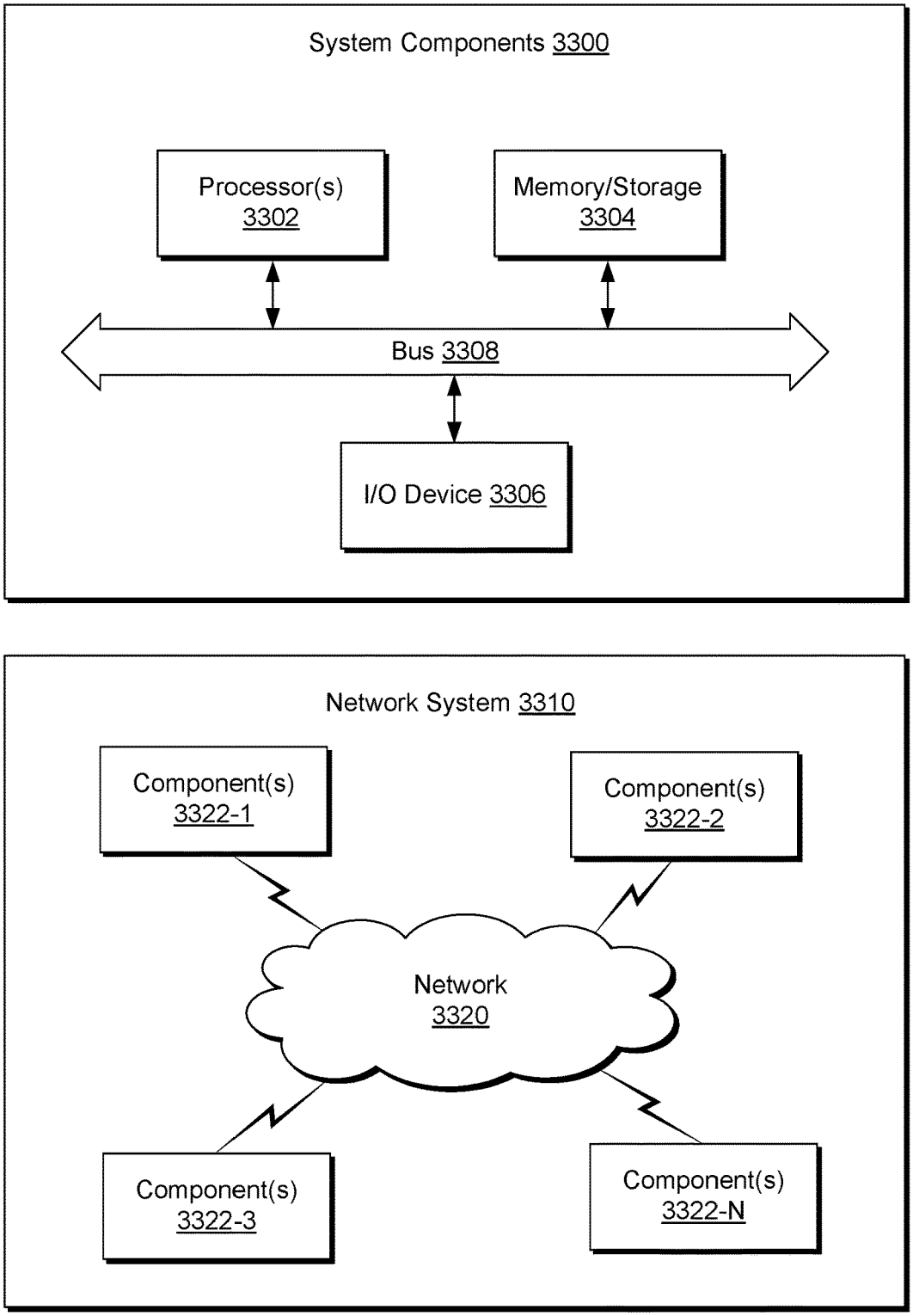
FIG. 33 illustrates example components of a system and a networked system.

FIG. 33 shows components of a computing system 3300 and a networked system 3310. The system 3300 includes one or more processors 3302, memory and/or storage components 3304, one or more input and/or output devices 3306 and a bus 3308. According to an embodiment, instructions may be stored in one or more computer-readable media (e.g., memory/storage components 3304). Such instructions may be read by one or more processors (e.g., the processor(s) 3302) via a communication bus (e.g., the bus 3308), which may be wired or wireless. The one or more processors may execute such instructions to implement (wholly or in part) one or more attributes (e.g., as part of a method). A user may view output from and interact with a process via an I/O device (e.g., the device 3306). According to an embodiment, a computer-readable medium may be a storage component such as a physical memory storage device, for example, a chip, a chip on a package, a memory card, etc.

According to an embodiment, components may be distributed, such as in the network system 3310. The network system 3310 includes components 3322-1, 3322-2, 3322-3, . . . 3322-N. For example, the components 3322-1 may include the processor(s) 3302 while the component(s) 3322-3 may include memory accessible by the processor(s) 3302. Further, the component(s) 3322-2 may include an I/O device for display and optionally interaction with a method. The network may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A method comprising:

receiving sensor data during drilling of a portion of a borehole in a geologic environment;

selecting a drilling mode from a plurality of drilling modes based at least on a portion of the sensor data using a trained neural network, wherein the trained neural network infers a state of the borehole in the geologic environment, wherein the trained neural network selects the drilling mode based at least in part on the state of the borehole, and wherein the trained neural network model is trained using at least one drilling mode defined reward; and issuing a control instruction for drilling an additional portion of the borehole using the selected drilling mode.

2. The method of claim 1, wherein selecting the drilling mode comprises defining a coordinate system for a portion of a drillstring using at least a portion of the sensor data.

3. The method of claim 1, wherein the drilling mode comprises a rotary drilling mode.

4. The method of claim 1, wherein the drilling mode comprises a sliding drilling mode.

5. The method of claim 1, wherein the plurality of drilling modes comprises a sliding up drilling mode and a sliding down drilling mode.

6. The method of claim 1, using a reward calculator, determining a reward value associated with the selected drilling mode.

7. The method of claim 1, wherein the trained neural network is trained using deep reinforcement learning that embodies a penalty for selecting a sliding drilling mode in comparison to selecting a rotary drilling mode from the plurality of drilling modes.

8. The method of claim 1, wherein the trained neural network is trained using deep reinforcement learning that embodies a penalty for selecting a rotary drilling mode to sliding drilling mode transition and a reward for forward drilling.

9. The method of claim 1, wherein the selecting and the issuing occur responsive to an application programming interface call to a server, wherein the application programming interface call provides for receiving the sensor data.

10. The system of claim 1, wherein to select and to issue occur responsive to an application programming interface call, wherein the application programming interface call provides for receiving the sensor data.

11. A system comprising:

a processor;

memory accessible by the processor;

processor-executable instructions stored in the memory and executable to instruct the system to:

receive sensor data during drilling of a portion of a borehole in a geologic environment;

select a drilling mode from a plurality of drilling modes based at least on a portion of the sensor data using a trained neural network, wherein the trained neural network infers a state of the borehole in the geologic environment, wherein the trained neural network selects the drilling mode based at least in part on the state of the borehole, and wherein the trained neural network model is trained using at least one drilling mode defined reward; and issue a control instruction for drilling an additional portion of the borehole using the selected drilling mode.

12. The system of claim 11, wherein the instructions to select the drilling mode comprise defining a coordinate system for a portion of a drillstring using at least a portion of the sensor data.

13. The system of claim 11, wherein the drilling mode comprises a rotary drilling mode.

14. The system of claim 11, wherein the drilling mode comprises a sliding drilling mode.

15. The system of claim 11, wherein the plurality of drilling modes comprises a sliding up drilling mode and a sliding down drilling mode.

16. The system of claim 11, wherein the instructions further include instructions for, using a reward calculator, determine a reward value associated with the selected drilling mode.

17. The system of claim 11, wherein the trained neural network is trained using deep reinforcement learning that embodies a penalty for selecting a sliding drilling mode in comparison to selecting a rotary drilling mode from the plurality of drilling modes.

18. The system of claim 11, wherein the trained neural network is trained using deep reinforcement learning that embodies a penalty for selecting a rotary drilling mode to sliding drilling mode transition and a reward for forward drilling.

19. A non-transitory computer-readable storage medium storing instructions that when executed by a computer, which includes a processor performs a method, the method comprising:

receiving sensor data during drilling of a portion of a borehole in a geologic environment;

selecting a drilling mode from a plurality of drilling modes based at least on a portion of the sensor data using a trained neural network, wherein the trained neural network infers a state of the borehole in the geologic environment, wherein the trained neural network selects the drilling mode based at least in part on the state of the borehole, and wherein the trained neural network model is trained using at least one drilling mode defined reward; and issuing a control instruction for drilling an additional portion of the borehole using the selected drilling mode.

20. The non-transitory computer-readable storage medium of claim 19, wherein the instructions further include instructions for, using a reward calculator, determining a reward value associated with the selected drilling mode.

* * * * *